US009904252B2

(12) United States Patent
Kato et al.

(10) Patent No.: US 9,904,252 B2
(45) Date of Patent: Feb. 27, 2018

(54) TIMEPIECE

(71) Applicant: CITIZEN WATCH CO., LTD., Nishitokyo-shi, Tokyo (JP)

(72) Inventors: Akira Kato, Tokorozawa (JP); Kazuya Imamura, Iida (JP); Shoichiro Morita, Higashikurume (JP); Yuji Yano, Kodaira (JP)

(73) Assignee: CITIZEN WATCH CO., LTD., Nishitokyo-shi (JP)

( * ) Notice: Subject to any disclaimer, the term of this patent is extended or adjusted under 35 U.S.C. 154(b) by 0 days.

(21) Appl. No.: 15/279,847

(22) Filed: Sep. 29, 2016

(65) Prior Publication Data

US 2017/0017206 A1 Jan. 19, 2017

Related U.S. Application Data

(63) Continuation of application No. PCT/JP2015/058997, filed on Mar. 24, 2015.

(30) Foreign Application Priority Data

Apr. 1, 2014 (JP) ..... 2014-075797

(51) Int. Cl.
*G04C 3/14* (2006.01)
*G04B 19/24* (2006.01)
(Continued)

(52) U.S. Cl.
CPC ..... *G04C 3/143* (2013.01); *G04B 19/24* (2013.01); *G04C 3/14* (2013.01); *G04R 20/00* (2013.01); *G04R 20/08* (2013.01)

(58) Field of Classification Search
CPC ..... G04R 20/00; G04R 20/08; G04B 19/24; G04C 3/14; G04C 3/143
See application file for complete search history.

(56) References Cited

U.S. PATENT DOCUMENTS 4,420,263 A * 12/1983 Besson ..... G04C 3/14 368/157
5,270,993 A * 12/1993 Besson ..... G04C 3/14 368/184
(Continued)

FOREIGN PATENT DOCUMENTS

JP 2004-226132 A 8/2004
JP 3872688 B2 1/2007
(Continued)

OTHER PUBLICATIONS

International Search Report, PCT/JP2015/058997, dated Apr. 28, 2015, 5 pages.
Extended European Search Report, dated Sep. 28, 2017, 5 pages.

*Primary Examiner* — Vit W Miska
(74) *Attorney, Agent, or Firm* — Foley & Lardner LLP

(57) ABSTRACT

Whether a bright state or a dark state is established is determined each time a motor is driven one step, based on a presence or absence of a passing of light through a detection hole disposed in a detection wheel that rotates associated with rotations of a hand wheel coupled with the motor. A switching position X is identified at which the dark state is switched to the bright state when the dark state is determined and thereafter the bright state is determined. A position one step after the identified switching position X is set to be a reference position X+1 of the hand wheel. The reference positions X+1 and X−1 can thereby be set after a driving mechanism is assembled.

16 Claims, 19 Drawing Sheets

(51) Int. Cl.
*G04R 20/00* (2013.01)
*G04R 20/08* (2013.01)

(56) References Cited

U.S. PATENT DOCUMENTS

| | | | | |
|---|---|---|---|---|
| 7,633,075 | B2 | 12/2009 | Ono et al. | |
| 8,091,604 | B2 * | 1/2012 | Kluck | A47H 5/0325 160/1 |
| 2004/0125702 | A1 * | 7/2004 | Kitajima | G04C 3/14 368/80 |
| 2009/0016172 | A1 * | 1/2009 | Fujii | G04C 3/14 368/80 |
| 2009/0084936 | A1 | 4/2009 | Ono et al. | |
| 2009/0296533 | A1 * | 12/2009 | Kojima | G04C 3/14 368/185 |
| 2009/0296534 | A1 | 12/2009 | Kojima et al. | |
| 2010/0020336 | A1 * | 1/2010 | Hosobuchi | G04C 3/14 356/614 |
| 2011/0141858 | A1 * | 6/2011 | Aoki | G04C 3/146 368/80 |

FOREIGN PATENT DOCUMENTS

| | | | |
|---|---|---|---|
| JP | 2009-085754 | A | 4/2009 |
| JP | 2009-288139 | A | 12/2009 |

* cited by examiner

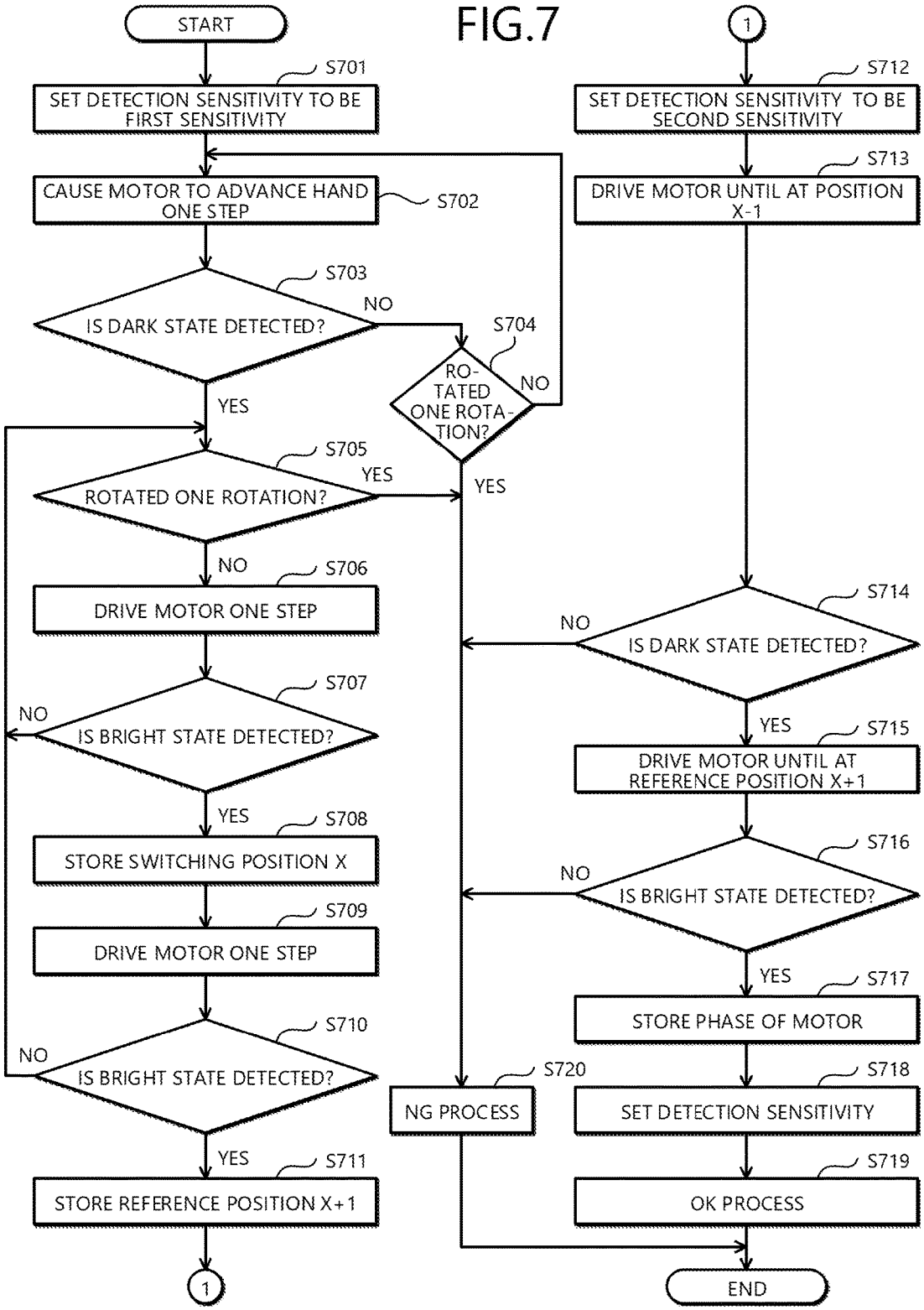
FIG.7
START
S701
SET DETECTION SENSITIVITY TO BE FIRST SENSITIVITY
CAUSE MOTOR TO ADVANCE HAND ONE STEP
S702
S703
IS DARK STATE DETECTED?
NO
S704
ROTATED ONE ROTATION?
NO
YES
S705
ROTATED ONE ROTATION?
YES
YES
NO
S706
DRIVE MOTOR ONE STEP
S707
IS BRIGHT STATE DETECTED?
NO
YES
S708
STORE SWITCHING POSITION X
S709
DRIVE MOTOR ONE STEP
S710
IS BRIGHT STATE DETECTED?
NO
YES
S711
STORE REFERENCE POSITION X+1
1
1
S712
SET DETECTION SENSITIVITY TO BE SECOND SENSITIVITY
S713
DRIVE MOTOR UNTIL AT POSITION X-1
S714
IS DARK STATE DETECTED?
NO
YES
S715
DRIVE MOTOR UNTIL AT REFERENCE POSITION X+1
S716
IS BRIGHT STATE DETECTED?
NO
YES
S717
STORE PHASE OF MOTOR
S718
SET DETECTION SENSITIVITY
S719
OK PROCESS
S720
NG PROCESS
END DETECTION LEVEL
REFERENCE X+1
ONE STEP BEFORE
SWITCHING POSITION X
TWO STEPS BEFORE
POSITION X-1
SECOND SENSITIVITY
THIRD SENSITIVITY
FIRST SENSITIVITY
0 1 2 3 4 5 6 7 8 9 10
NUMBER OF STEPS DETECTION LEVEL
REFERENCE X+1
ONE STEP BEFORE
SWITCHING POSITION X
TWO STEPS BEFORE
POSITION X-1
SECOND SENSITIVITY
THIRD SENSITIVITY
FIRST SENSITIVITY
0 1 2 3 4 5 6 7 8 9 10
NUMBER OF STEPS FIG.11B
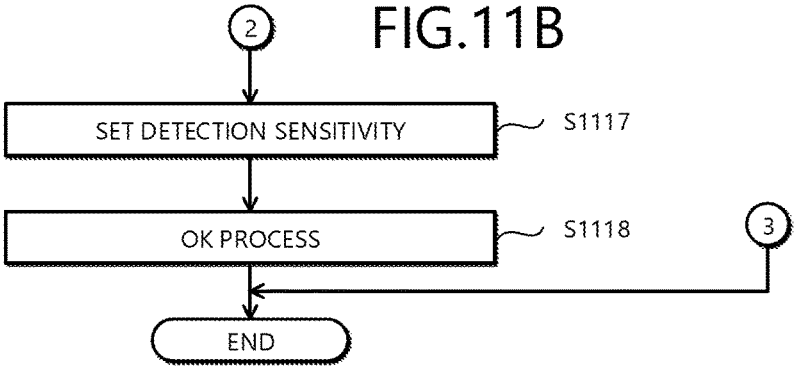
FIG.12
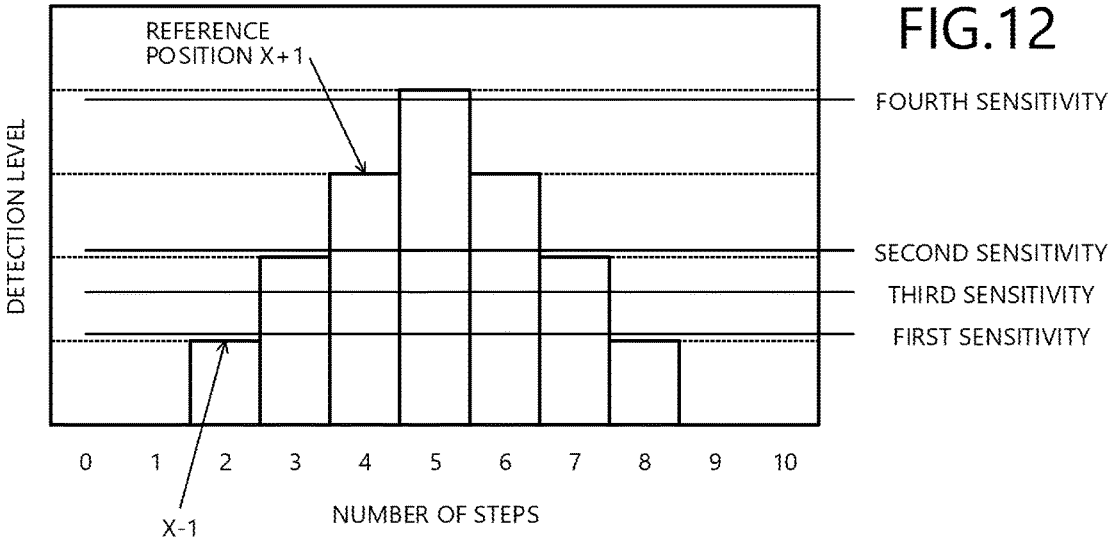
FIG.13
| NUMBER OF STEPS | 1 | 2 | 3 | 4 |
|---|---|---|---|---|
| FIRST SENSITIVITY | DARK | DARK | BRIGHT | BRIGHT |
| SECOND SENSITIVITY | DARK | DARK | DARK | BRIGHT |

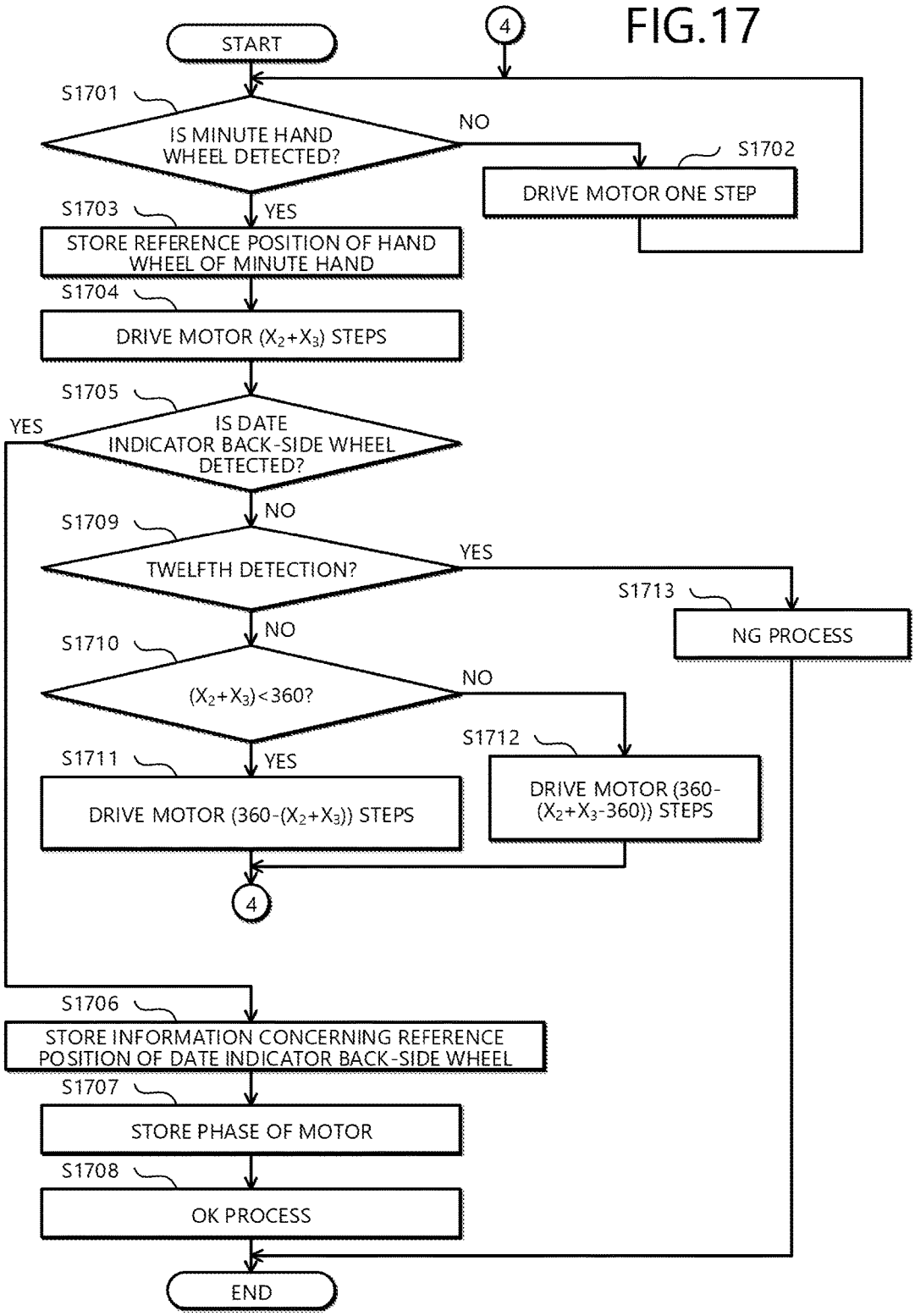
FIG.17
START
4
S1701
IS MINUTE HAND WHEEL DETECTED?
NO
S1702
DRIVE MOTOR ONE STEP
YES
S1703
STORE REFERENCE POSITION OF HAND WHEEL OF MINUTE HAND
S1704
DRIVE MOTOR ($X_2$+$X_3$) STEPS
S1705
IS DATE INDICATOR BACK-SIDE WHEEL DETECTED?
YES
NO
S1709
TWELFTH DETECTION?
YES
S1713
NG PROCESS
NO
S1710
($X_2$+$X_3$)<360?
NO
S1712
DRIVE MOTOR (360-($X_2$+$X_3$-360)) STEPS
S1711
YES
DRIVE MOTOR (360-($X_2$+$X_3$)) STEPS
4
S1706
STORE INFORMATION CONCERNING REFERENCE POSITION OF DATE INDICATOR BACK-SIDE WHEEL
S1707
STORE PHASE OF MOTOR
S1708
OK PROCESS
END

TIMEPIECE

CROSS REFERENCE TO RELATED APPLICATIONS

This is a continuation application of International Application PCT/JP2015/058997 filed on Mar. 24, 2015 which claims priority from a Japanese Patent Application No. 2014-075797 filed on Apr. 1, 2014, the contents of which are incorporated herein by reference.

BACKGROUND OF THE INVENTION

1. Field of the Invention

Embodiments of the present invention relate to a timepiece including a mechanism that detects positions of the hands.

2. Description of the Related Art

Conventionally, timepieces correct the position of the hands thereof such as a radio-controlled timepiece that counts the time based on a standard time calibration radio wave or a GPS radio wave, and a perpetual calendar timepiece. According to a known technique, a timepiece such as that above has a detection gear rotating at an equal speed as that of a gear supporting the hand, disposed in a wheel train that transmits the driving force of a motor to the gear supporting the hand, a detection hole disposed in a gear constituting the wheel train and another detection hole disposed in the detection gear are adapted to overlap each other every time the hand rotates by one rotation, and the position of the hand is detected by a light receiving element receiving light emitted by a light emitting element and passing through the overlapping detection holes.

For example, according to a known technique, the winding direction of a driving coil of a stepping motor, the orientation of the magnetic pole of the rotor, the positional relation among reference position detection gears are set in advance when a timepiece is assembled, a detection signal of a photo-detection sensor is synchronized with a timing of inputting a pulse into either a winding starting terminal or a winding ending terminal of the driving coil, and the detection signal is obtained once per two steps (for example, refer to Japanese Patent No. 3872688).

SUMMARY OF THE INVENTION

According to one aspect of the present invention, a timepiece includes a hand wheel configured to rotate around an axial center thereof; a motor coupled with the hand wheel and configured to rotate the hand wheel; a detection wheel configured to rotate around an axial center thereof, associated with rotation of the hand wheel; a detection hole that penetrates the detection wheel in a direction along the axial center; a photo sensor including: a light emitting element that emits light to a detection position on an orbit along which the detection hole moves associated with the rotation of the detection wheel, and a light receiving element that is disposed facing the light emitting element with the detection wheel therebetween; and a control unit configured to drive and control the motor. The control unit determines one of a first state and a second state different from the first state, based on an amount of light received by the light receiving element each time the motor is driven a predetermined number of steps. The control unit identifies a switching position at which the first state is switched to the second state when the control unit consecutively determines the first state for a first number of steps and thereafter consecutively determines the second state for a second number of steps. The control unit sets a position one step shifted from the identified switching position to be a reference position and stores information concerning the reference position to a storage unit.

In the timepiece, the control unit determines one of the first state and the second state in a state where a detection sensitivity of the photo sensor is set to be two or more different sensitivities.

In the timepiece, the control unit sets the detection sensitivity of the photo sensor by adjusting at least one of a light emission intensity of the light emitting element and a light receiving sensitivity of the light receiving element.

In the timepiece, the control unit determines a bright state in which the amount of light received is equal to or greater than a predetermined amount as the first state, and a dark state with which the amount of light received is less than the predetermined amount as the second state. The control unit determines one of the bright state and the dark state based on the amount of light received by the light receiving element each time the motor is driven a predetermined number of steps. The control unit identifies a switching position at which the second state is switched to the first state when the control unit consecutively determines the second state for the first number of steps and thereafter consecutively determines the first state for the second number of steps. The control unit sets a position one step after the identified switching position to be a reference position and stores information concerning the reference position to the storage unit.

In the timepiece, the control unit identifies the switching position and the reference position in a state where the detection sensitivity of the photo sensor is set to be a first sensitivity that is higher than a sensitivity used during normal movement of hands. The control unit determines whether the second state is established at a position one step before the switching position and determines whether the first state is established at the reference position in a state where the detection sensitivity of the photo sensor is set to be a second sensitivity that is equal to the sensitivity used during normal movement of the hands or that is lower than the sensitivity used during normal movement of the hands. The control unit stores to the storage unit, information concerning a phase of the motor at the reference position when the second state is established at the position one step before the switching position and the first state is established at the reference position.

In the timepiece, the control unit determines a dark state in which the amount of light received is less than a predetermined amount as the first state, and a bright state in which the amount of received light is equal to or greater than the predetermined amount as the second state. The control unit determines one of the bright state and the dark state, based on the amount of light received by the light receiving element each time the motor is driven the predetermined number of steps. The control unit identifies a switching position at which the second state is switched to the first state when the control unit consecutively determines the second state for the first number of steps and thereafter consecutively determines the first state for the second number of steps. The control unit sets a position one step before the identified switching position to be a reference position and stores information concerning the reference position to the storage unit.

In the timepiece, the control unit identifies the switching position and the reference position in a state where the detection sensitivity of the photo sensor is set to be a first sensitivity that is higher than a sensitivity used during normal movement of hands. The control unit determines whether the first state is established at a position one step after the switching position and determines whether the second state is established at the reference position in a state where the detection sensitivity of the photo sensor is set to be a second sensitivity that is equal to the sensitivity used during normal movement of the hands or that is lower than the sensitivity used during normal movement of the hands. The control unit stores to the storage unit, information concerning a phase of the motor at the reference position when the first state is established at the position one step after the switching position and the second state is established at the reference position.

In the timepiece, the control unit identifies the switching position and the reference position by rotating forward the motor in a state where the first sensitivity is set. The control unit, after identifying the switching position and the reference position, positions the detection wheel at a position one step or more before a detection position by rotating backward the motor and thereafter executes determination using the second sensitivity.

The timepiece further includes a time counting unit that counts time. The control unit, when identifying the phase of the reference position, determines during normal movement of hands, one of the first state and the second state at a timing of the identified phase using a third sensitivity that is lower than the first sensitivity and that is equal to the second sensitivity or higher than the second sensitivity, and counts time using the time counting unit in a state where a determination result at a position at least one step before the switching position and a determination result at a position one step after the switching position differ.

In the timepiece, the control unit identifies a non-detection level at which the photo sensor does not detect the bright state, the control unit identifying the non-detection level by varying stepwise the detection sensitivity of the photo sensor at two or more different sensitivities and determining one of the first state and the second state in a state where the control unit sets the detection sensitivity at each of the sensitivities. The control unit identifies as the first sensitivity and identifies based on the identified non-detection level, a detection sensitivity by which the control unit does not detect the bright state at a position other than the reference position. The control unit identifies the switching position and the reference position in a state where the first sensitivity is set.

The timepiece further includes a date indicator driving wheel coupled with the hand wheel. The control unit, when successfully storing the information concerning the reference position in response to a predetermined input operation to execute identification of the switching position, drives and controls the motor so as to change a date displayed by the date indicator driving wheel to a date that is advanced from a date of a time when the predetermined input operation is received. The control unit, when failing to store the information concerning the reference position in response to the predetermined input operation to execute the identification of the switching position, drives and controls the motor so as to change the date displayed by the date indicator driving wheel to a date that is before the date of the time when the predetermined input operation is received.

The timepiece further includes: a second hand wheel that rotates associated with the rotation of the hand wheel, the second hand wheel rotating by one rotation each time the hand wheel rotates a predetermined number of rotations; a second detection wheel that rotates associated with the second hand wheel, the second detection wheel rotating by a number of rotations higher than a number of rotations of the second hand wheel and lower than a number of rotations of the detection wheel; a second detection hole that penetrates the second detection wheel in a direction of an axial center of the second detection wheel; and a second photo sensor including: a second light emitting element that emits light to a detection position on an orbit along which the second detection hole moves associated with the rotation of the second detection wheel, and a second light receiving element that is disposed facing the second light emitting element with the second detection wheel therebetween. A number of rotations of the second detection wheel is a number of rotations by which the second photo sensor detects the second detection hole a predetermined number of steps after positioning of the detection wheel at the reference position once every time the second hand wheel rotates by one rotation. The control unit identifies a position of the second hand wheel based on an amount of light received by the second light receiving element a predetermined number of steps after positioning of the detection wheel at the reference position.

In the timepiece, the control unit identifies the position of the second hand wheel based on a number of steps during detection of the bright state by one of the photo sensor and the second photo sensor.

Objects, features, and advantages of the present invention are specifically set forth in or will become apparent from the following detailed description of the invention when read in conjunction with the accompanying drawings.

BRIEF DESCRIPTION OF THE DRAWINGS

FIG. 7 is a flowchart of a process procedure for a reference position setting operation executed by the radio-controlled timepiece of the first embodiment according to the present invention;

FIG. 11B is a flowchart (part 2) of the process procedure for the reference position setting operation executed by the radio-controlled timepiece 100 of the third embodiment according to the present invention;

FIG. 12 is an explanatory diagram of a concept of setting of the sensitivity;

FIG. 13 is an explanatory diagram of a concept of execution content of the procedure at (4) and (5) of a procedure for detection sensitivity adjustment of the photo sensors of a second hand and a minute hand;

FIG. 17 is a flowchart of a process procedure for the hand position detection of the minute hand and the hour hand executed by the radio-controlled timepiece of the fourth embodiment according to the present invention;

DETAILED DESCRIPTION OF THE INVENTION

Preferred embodiments of a timepiece according to the present invention will be described in detail with reference to the accompanying drawings.

Figure 1:
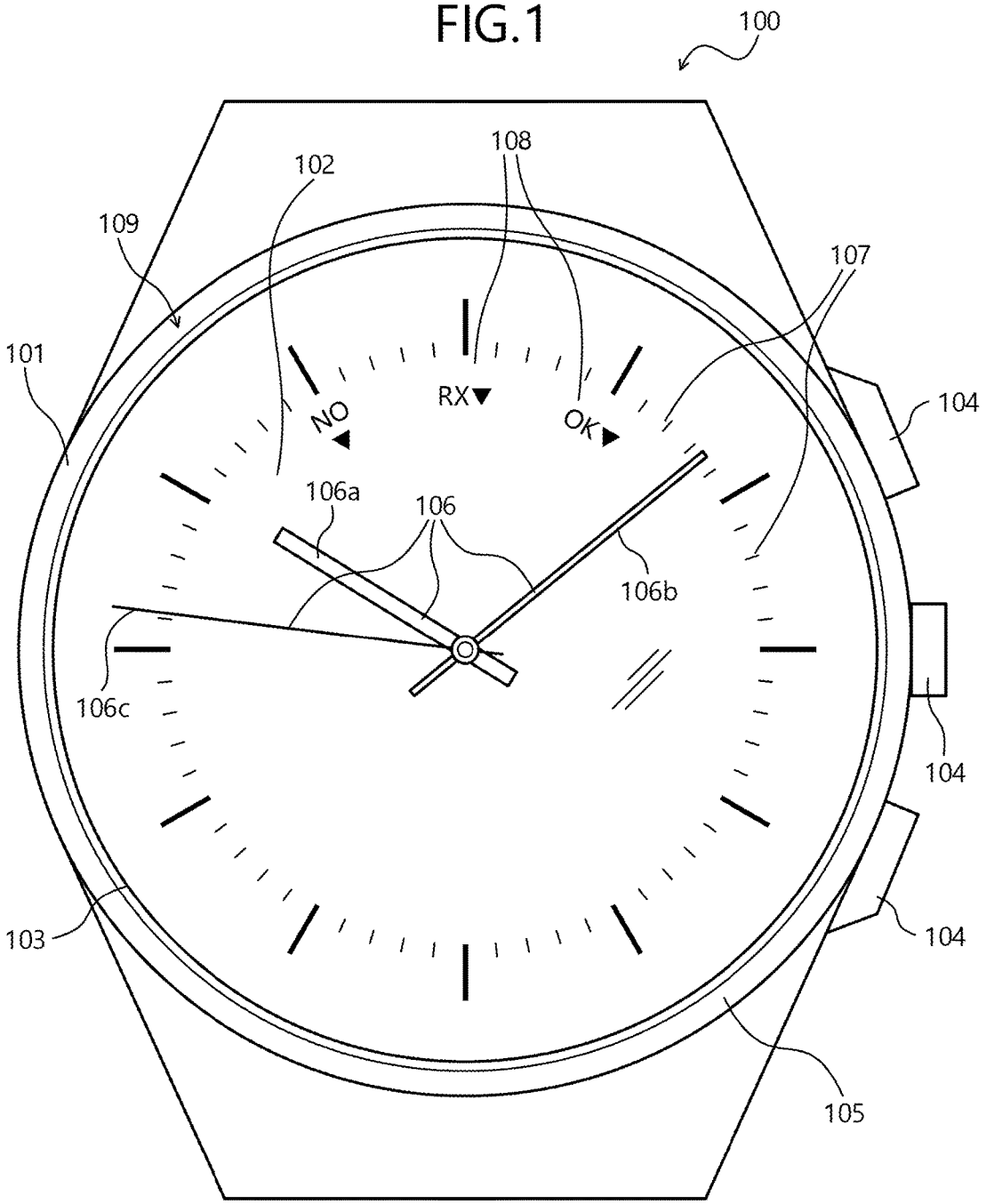
FIG. 1 is an explanatory diagram of an external appearance of a radio-controlled timepiece of a first embodiment according to the present invention.

A configuration will be described of a radio-controlled timepiece of the first embodiment that realizes a timepiece according to the present invention. FIG. 1 is an explanatory diagram of an external appearance of the radio-controlled timepiece of the first embodiment according to the present invention. In FIG. 1, a radio-controlled timepiece 100 of the first embodiment according to the present invention includes a case (an outer cover case) 101 forming an outer cover of the radio-controlled timepiece 100. The case 101 is formed using, for example, a metal material and has a substantially cylindrical shape whose ends are closed.

Such components are disposed on one end side (a front side) of the case 101 having the substantially cylindrical shape, as a crystal 102 closing the opening on the front side and a bezel 103 supporting the peripheral edge of the crystal 102. The crystal 102 is formed using, for example, a transparent glass material and has a substantially circular plate shape. The bezel 103 is formed using, for example, a metal material and has an annular shape whose inner diameter is substantially equal to the diameter of the crystal 102.

At the other end (a back side) of the case 101, a rear cover member closing the opening on the back side is disposed. The rear cover member may be formed using, for example, a metal material. Alternatively, the rear cover member may be formed using a polymer material that is called "plastic" or the like. The rear cover member may be attached to the case 101 by using any one of various types of known techniques such as a screw back scheme, a setting-in scheme, and a screwing-in cover scheme. The method of attaching the rear cover member to the case 101 may be realized easily using any one of known various types of techniques and will therefore not be described.

The shape of the case 101 is not limited to the above. The case 101 includes at least an opening on the front side along an axial direction. The radio-controlled timepiece 100 of the first embodiment according to the present invention may employ a configuration to close the back side of the case 101 using a so-called one-piece structure to integrally include the case 101 and the rear cover member.

The case 101 has operation units 104. The operation units 104 may be realized by, for example, a crown and operation buttons. When the operation unit 104 is manipulated by a user, the operation unit 104 outputs to a control circuit, a signal corresponding to the manipulation. The control circuit executes a process such as a process of receiving a satellite signal, corresponding to the manipulation of the operation unit 104.

A dial plate 105 is disposed on the inner side of the case 101. Indexes (indicators) 107 indicating the positions of time pointing hands 106, that is, the time, are disposed on the dial plate 105. The time pointing hands 106 may be realized by, for example, an hour hand 106*a*, a minute hand 106*b*, a second hand 106*c*, and the like. The time pointing hands 106 may each be formed using, for example, a metal material. The time pointing hands 106 are each not limited to one formed using a metal material and may each be formed using, for example, a polymer material that is called "plastic" or the like.

The indexes 107 are disposed along a perimeter centered about the axial center of the time pointing hands 106. The indexes 107 may be realized by, for example, characters, numbers, or symbols. The indexes 107 are not limited to characters, numbers, and symbols, and may be realized using, for example, protrusions disposed on the dial plate 105. In the radio-controlled timepiece 100 of the first embodiment according to the present invention, the indexes 107 may each be formed using, for example, a metal material. The indexes 107 may be those printed on the dial plate 105 or may be realized by disposing other members of a metal or the like.

In the radio-controlled timepiece 100 of the first embodiment according to the present invention, the indexes 107 may be disposed along a same periphery centered about the rotation center of the time pointing hands 106. In this case, for example, each of the indexes 107 may be disposed such that at least a portion of the index 107 is positioned on farther on an outer peripheral side than a range of the rotation of the time pointing hand 106, that is, a circle formed by the orbit of the tip of the time pointing hand 106 formed by the rotation of the time pointing hand 106.

The indexes 107 are not limited to those in the form in which all the indexes 107 are disposed along the same periphery centered about the rotation center of the time pointing hand 106. In the radio-controlled timepiece 100 of the first embodiment according to the present invention, the indexes 107 may take, for example, a form in which at least some of the indexes 107 are disposed within the range of the rotation of the time pointing hand 106, and some other indexes 107 are disposed farther on the outer peripheral side than the range of the rotation of the time pointing hand 106.

Markers 108 to indicate information concerning the control of reception of the satellite signal by an antenna are disposed on the dial plate 105. The markers 108 may be realized by, for example, character strings such as "RX" that indicates that the satellite signal is currently received, and "NO" and "OK" that respectively indicate failure and success of a reception process of the satellite signal by the antenna.

Figure 2:
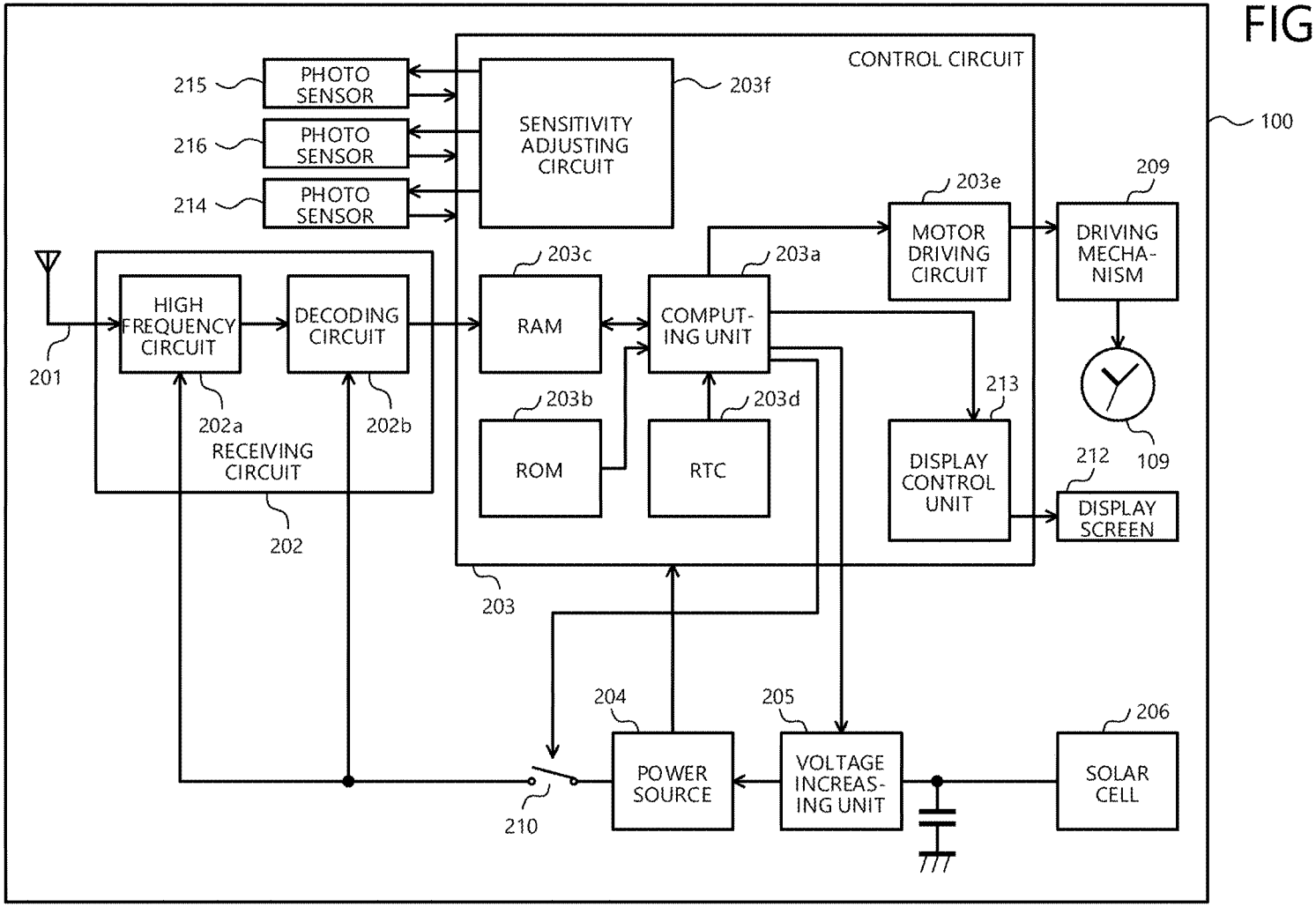
FIG. 2 is an explanatory diagram of a hardware configuration of the radio-controlled timepiece of the first embodiment according to the present invention.

A hardware configuration of the radio-controlled timepiece 100 of the first embodiment according to the present invention will be described. FIG. 2 is an explanatory diagram of a hardware configuration of the radio-controlled timepiece 100 of the first embodiment according to the present invention.

In FIG. 2, the radio-controlled timepiece 100 of the first embodiment according to the present invention includes an antenna 201, a receiving circuit 202, a control circuit 203, an electric power source 204, a voltage increasing unit 205, a solar cell 206, a driving mechanism 209, a time displaying unit 109, a photo sensor 214, a photo sensor 215, and a photo sensor 216. The antenna 201, the receiving circuit 202, the control circuit 203, the electric power source 204, the voltage increasing unit 205, the solar cell 206, the driving mechanism 209, the time displaying unit 109, the photo sensor 214, the photo sensor 215, and the photo sensor 216 are disposed in the space surrounded by the case 101, the rear cover member, and the dial plate 105.

The antenna 201 receives a satellite signal transmitted from a Global Positioning System (GPS) satellite. The antenna 201 may be realized by, for example, the patch antenna 201 that receives a radio wave at a frequency of about 1.6 GHz transmitted from a GPS satellite. Each of the GPS satellites travels on an orbit around the earth, has a high precision atomic clock loaded thereon, and periodically transmits a satellite signal that includes information concerning the time counted by the atomic clock. The antenna 201 receives satellite signals transmitted from plural GPS satellites.

The antenna 201 may receive the standard time calibration radio wave transmitted from a predetermined transmitter station. The standard time calibration radio wave is a radio wave broadcast by a government or an international organization as a national standard or an international standard of the standard time and the frequencies, is transmitted from a standard frequency and time service station such as, for example, JJY, and has a time code superimposed thereon.

The receiving circuit 202 decodes the satellite signal (or the standard time calibration radio wave) received by the antenna 201, and outputs a bit string (received data) that indicates the content of the satellite signal obtained as the result of the decoding. For example, the receiving circuit 202 includes a high frequency circuit (an RF circuit) 202*a* and a decoding circuit 202*b*. The high frequency circuit is an integrated circuit operating at a high frequency, and amplifies and demodulates an analog signal received by the antenna 201 to convert the analog signal into a baseband signal. The decoding circuit 202*b* is an integrated circuit executing a baseband process, decodes the baseband signal output by the high frequency circuit to produce a bit string that indicates the content of the data received from the GPS satellite, and outputs the bit string to the control circuit 203.

The control circuit 203 may be realized by a microcomputer that includes a computing unit 203*a*, a read-only memory (ROM) 203*b*, a random access memory (RAM) 203*c*, a real time clock (RTC) 203*d*, and a motor driving circuit 203*e*.

The computing unit 203*a* executes various types of information processing according to various types of control programs stored in the ROM 203*b*. The ROM 203*c* functions as a work memory of the computing unit 203*a* and data to be processed by the computing unit 203*a* is written into the ROM 203*c*. The RTC 203*d* outputs to the computing unit 203*a*, a clock signal to be used for counting the time inside the radio-controlled timepiece 100.

The computing unit 203*a* counts the internal time based on the clock signal output by the RTC 203*d*. The computing unit 203*a* corrects the counted internal time based on the satellite signal received by the receiving circuit 202 and determines the time to be displayed by the time pointing hands 106 on the time displaying unit 109 (time to be displayed). The computing unit 203*a* sets the reference position X+1 of each of the hand wheels to indicate the time pointing hands 106 (the hour hand 106*a*, the minute hand 106*b*, and the second hand 106*c*) into which the reference positions are to be set by a reference position setting mechanism, outputs a driving signal to the motor driving circuit 203*e* based on the set reference position X+1 of each of the hand wheels, and thereby corrects the time to be displayed.

The driving mechanism (movement) 209 may include a motor operating according to the driving signal output from the motor driving circuit 203*e*, and a wheel train. The motor may be realized by, for example, a stepping motor, and executes rotation operations of forward rotations (right-hand rotations) or reverse rotations (left-hand rotations) corresponding to the driving pulses output from the motor driving circuit 203*e*. The driving mechanism 209 rotates the time pointing hands 106 by transmitting the rotations of the motor (stepping motor) to the time pointing hands 106 through the wheel train.

The driving mechanism 209 may include the one motor or plural motors. In the radio-controlled timepiece 100 including plural motors, for example, the hour hand 106*a*, the minute hand 106*b*, the second hand 106*c*, and the like realizing the time pointing hands 106 can each be independently driven by an independent motor. In this case, the same number of sets of the motor and the wheel train as the number of the time pointing hands 106 are disposed. In the radio-controlled timepiece 100 including the plural motors, the number of the motors and the numbers of the time pointing hands 106 do not need to match with each other. For example, the minute hand 106*b* and the second hand 106*c* of the time pointing hands 106 may be adapted to be driven by a first motor, and the hour hand 106*a* of the time pointing hands 106 may be adapted to be driven by a second motor. In this case, the number of the motors and number of the wheel trains are each smaller than the number of the time pointing hands 106.

The radio-controlled timepiece 100 of the first embodiment includes a second single motor that drives the second hand 106*c* of the time pointing hands 106, a minute single motor that drives the minute hand 106*b* of the time pointing hands 106, and a hour single motor that drives the hour hand 106*a* of the time pointing hands 106. The radio-controlled timepiece 100 may include a date plate in addition to the hour hand 106*a*, the minute hand 106*b*, and the second hand 106*c* as the time pointing hands 106.

In the radio-controlled timepiece 100, when the driving signal corresponding to the time to be displayed determined by the computing unit 203*a* is output to the driving mechanism 209, the motors are driven, and the time pointing hands 106 are turned through the wheel train coupled with the motors. The time to be displayed produced by the control circuit 203 can thereby be displayed on the time displaying unit 109.

The electric power source 204 may be realized by, for example, a secondary battery such as a lithium-ion battery. The electric power source 204 accumulates (charges therein) the electric power generated by the solar cell 206 (a solar battery). The solar cell 206 is disposed on the back cover side of the dial plate 105, generates electric power using light such as sun light entering the dial plate 105 through the crystal 102, and outputs the generated electric power to the electric power source 204. The voltage increasing unit 205 is driven and controlled by the control circuit 203 and increases the voltage of the electric power generated by the solar cell 206 to output the electric power to the electric power source 204. The voltage increasing unit 205 may be formed by, for example, a DC/DC converter. The electric power source 204 is not limited to a secondary battery and may be realized using a primary battery.

A switch 210 is disposed in an electric power supply path from the electric power source 204 to the receiving circuit 202, and ON/OFF thereof is switched according to a control signal output from the control circuit 203. In the radio-controlled timepiece 100, the operation timing of the receiving circuit 202 may be controlled by switching ON/OFF the switch 210 by the control circuit 203. For example, the receiving circuit 202 operates only for the time period during which the electric power is supplied thereto from the electric power source 204 through the switch 210 to decode the satellite signal received by the antenna 201.

Figure 3:
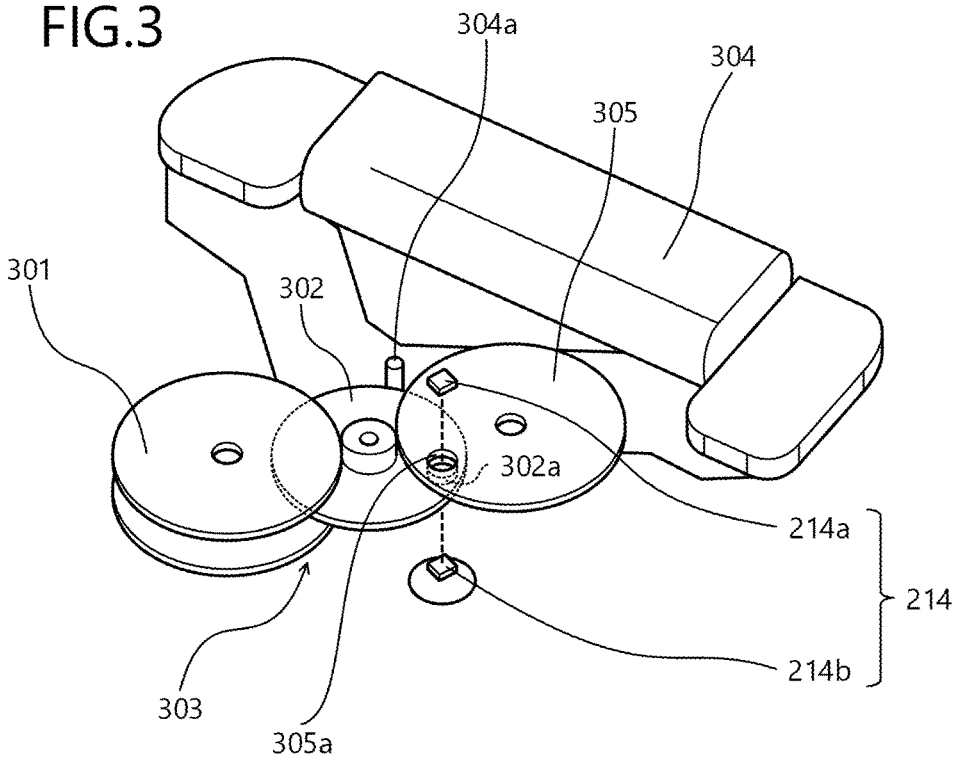
FIG. 3 is an explanatory diagram of a configuration of the reference position setting mechanism included in the radio-controlled timepiece of the first embodiment according to the present invention.
Figure 4:
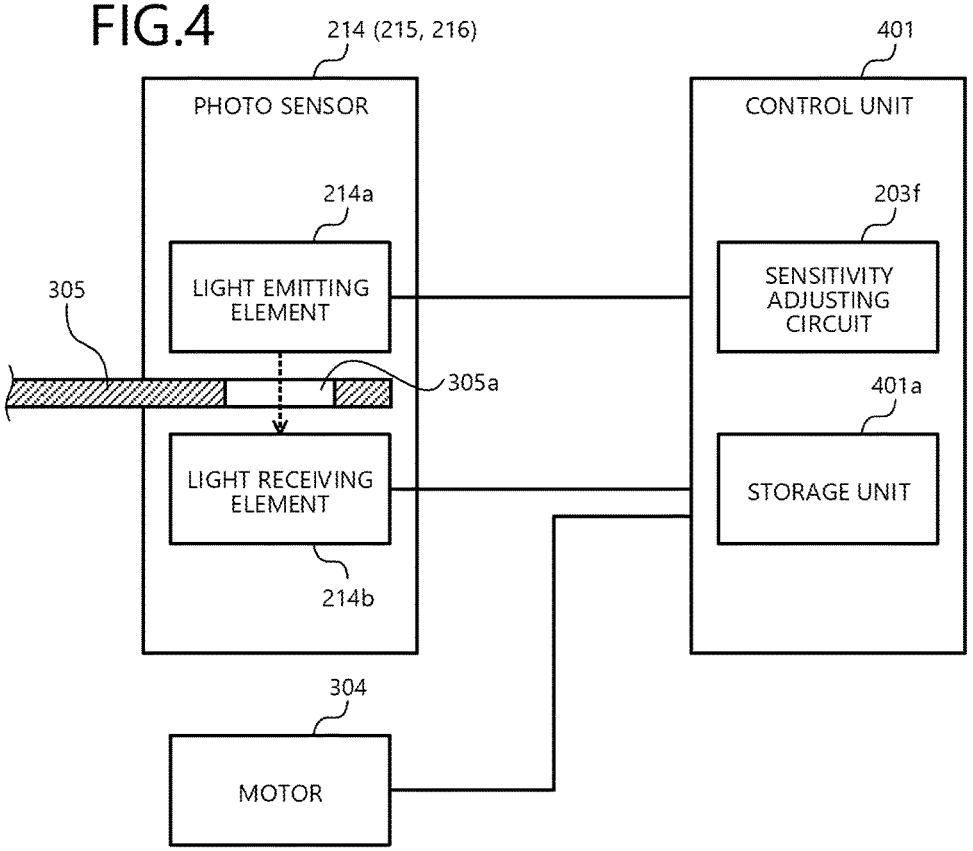
FIG. 4 is a block diagram of a functional configuration of the radio-controlled timepiece of the first embodiment according to the present invention.

The photo sensors 214 to 216 each include a light emitting element, and a light receiving element that receives the light emitted by the light emitting element (see FIG. 3 and FIG. 4). The photo sensors 214 to 216 each output to the control circuit 203 a detection signal corresponding to the amount of the received light at the light receiving element thereof. The photo sensors 214 to 216 are respectively disposed corresponding to the detection wheels rotatable around the axial center associated with the rotations of the hand wheels of the hour hand 106*a*, the minute hand 106*b*, and the second hand 106*c*. A first sensitivity and a second sensitivity are set in each of the photo sensors 214 to 216. The control circuit 203 further includes a sensitivity adjusting circuit 203*f*. The sensitivity adjusting circuit 203*f* adjusts the sensitivities of the photo sensors 214 to 216 respectively based on the detection signals output from the photo sensors 214 to 216.

The radio-controlled timepiece 100 may include an LED, an LED driving circuit, an alarm, an alarm driving circuit (that are not depicted), and the like. The LED driving circuit drives the LED to illuminate the display screen as a backlight, outputs a warning light, and the like. Instead of the LED, EL (Electroluminescence), a lamp, or the like may be used. The alarm driving circuit drives a piezoelectric element not depicted that is mounted on the alarm, and outputs an alarm (a buzzer). The alarm driving circuit may output the alarm varying the type of the sound, height thereof, the volume thereof, and the like depending on the type of the report.

The radio-controlled timepiece 100 may include a date indicator wheel not depicted. The date indicator wheel has a circular plate shape or an annular shape and has numbers representing the dates of "1" to "31" along a peripheral edge portion. The date indicator wheel is coupled with a date indicator driving wheel not depicted, and rotates associated with the rotation of the date indicator driving wheel. The date indicator driving wheel is coupled with the hand wheels through a date indicator driving intermediate wheel and the like, and rotates around the axial center associated with the rotations of the hand wheels. The date indicator driving wheel rotates by one rotation in 24 hours and the date indicator wheel rotates (turns) in a direction to advance the date by one day every time the date indicator driving wheel rotates by one rotation.

A configuration of a reference position setting mechanism included in the radio-controlled timepiece 100 of the first embodiment according to the present invention will be described. FIG. 3 is an explanatory diagram of a configuration of the reference position setting mechanism included in the radio-controlled timepiece 100 of the first embodiment according to the present invention.

FIG. 3 depicts the configuration of the reference portion setting mechanism concerning the hour hand 106*a*. Configurations of reference position setting mechanisms concerning the minute hand 106*b* and the second hand 106*c* may each be realized by the same configuration as the configuration of the reference position setting mechanism concerning the hour hand 106*a*. Three systems of the reference position setting mechanism depicted in FIG. 3 are disposed to detect the three independent time pointing hands 106 that are the hour hand 106*a*, the minute hand 106*b*, and the second hand 106*c*.

In FIG. 3, the radio-controlled timepiece 100 includes a hand wheel 301 that is rotatable around the axial center. The hand wheel 301 supports the time pointing hand 106 (at least one of the hour hand 106*a*, the minute hand 106*b*, and the second hand 106*c*). The hand wheel 301 is coupled with a motor 304 through a wheel train 303 that includes one or plural gears 302. For example, the wheel train 303 is in mesh with the hand wheel 301 and a rotor 304*a* included in the motor 304. When the hour hand 106*a*, the minute hand 106*b*, and the second hand 106*c* are each independently driven, the hand wheel 301, the wheel train 303, and the motor 304 are disposed corresponding to each of the hour hand 106*a*, the minute hand 106*b*, and the second hand 106*c* (in FIG. 3, only one system is depicted).

The hand wheel 301 is coupled with a detection wheel 305 that is rotatable around the axial center associated with the rotation of the hand wheel 301. The detection wheel 305 is coupled with the hand wheel 301, which is subject to detection. The detection wheel 305 may be coupled directly with the hand wheel 301 or may be coupled with the hand wheel 301 through an intermediate wheel (the gear 302) other than the hand wheel 301. A configuration may be employed according to which a detection hole is formed in each of two gears to be a speed reduction wheel train to reduce the speed of the rotation of the rotor 304*a* included in the motor 304 and the detection holes are detected. The detection wheel 305 does not need to be coupled and a configuration without the detection wheel 305 may be formed by employing the above configuration.

The detection wheel 305 may be disposed corresponding to each of the hand wheel supporting the hour hand 106*a*, the hand wheel supporting the minute hand 106*b*, and the hand wheel supporting the second hand 106*c*, and the detection wheel 305 may be coupled with each of the hand wheels. The detection wheel 305 is disposed such that the rotation axis of the hour hand 106*a* is in parallel to the rotation axis of the hand wheel 301. The detection wheel 305 has a detection hole 305*a* disposed therein that penetrates the detection wheel 305 in the axial direction thereof. The detection hole 305*a* moves around the axial center associated with the rotation of the detection wheel 305.

Of the gears 302 constituting the wheel train 303, the gear 302 partially overlapping the detection wheel 305 in the axial direction of the rotation is disposed with the detection hole 302*a* that penetrates the gear 302 in the axial direction of the gear 302. The detection hole 302*a* disposed in the gear 302 constituting the wheel train 303 rotates around the axial center associated with the rotation of the hand wheel 301, and overlaps the detection hole 305*a* disposed in the detection wheel 305 once during one rotation of the hand wheel 301 (see FIG. 5).

The photo sensor 214 includes a light emitting element 214*a* that emits light and a light receiving element 214*b*. The light emitting element 214*a* may be realized by, for example, a light emitting diode (LED). The light receiving element 214*b* varies output corresponding to the amount of received light and may be realized by, for example, a phototransistor.

The light emitting element 214*a* is disposed to emit light to the detection position on the orbit of the move of the detection hole 305*a* associated with the rotation of the detection wheel 305. For example, the light emitting element 214*a* is disposed to emit light to the position at which the detection hole 302*a* disposed in the gear 302 constituting the wheel train 303 and the detection hole 305*a* disposed in the detection wheel 305 overlap each other. In the first embodiment, the position at which the detection hole 302*a* and the detection hole 305*a* overlap each other will be referred to as "detection position".

The light receiving element 214*b* is disposed facing the light emitting element 214*a*, sandwiching the detection wheel 305 therebetween. The light emitted by the light emitting element 214*a* passes through the detection holes 302*a* and 305*a* and is received by the light receiving element 214*b* when the detection holes 302*a* and 305*a* moving associated with the rotation of the detection wheel 305 overlap each other at the light emitting position of the light emitting element 214*a*. The light receiving element 214*b* receives the light emitted by the light emitting element 214*a*, at the detection position.

The control circuit 203 drives and controls the motor 304. The control circuit 203 adjusts the sensitivity of the photo sensor by controlling the sensitivity adjusting circuit 203*f* and identifies the positions of the time pointing hands 106 (the hour hand 106*a*, the minute hand 106*b*, and the second hand 106*c*) supported by the hand wheels 301 based on the amount of light received by the light receiving element 214*b* in the photo sensor 214 (see FIG. 4).

A functional configuration will be described of the radio-controlled timepiece 100 of the first embodiment according to the present invention. FIG. 4 is a block diagram of a functional configuration of the radio-controlled timepiece 100 of the first embodiment according to the present invention. In FIG. 4, function of the radio-controlled timepiece 100 of the first embodiment according to the present invention may be realized by the motor 304, the detection wheel 305 having the detection hole 305*a* disposed therein, the photo sensor 214 (215 or 216) including the light emitting element 214*a* and the light receiving element 214*b*, and a control unit 401. Function of the radio-controlled timepiece 100 may further be realized by the date indicator driving wheel and the date indicator wheel not depicted.

For example, when the control unit 401 receives a predetermined input operation executed with respect to the operation unit 104, the control unit 401 executes a reference position setting operation. The reference position setting operation is realized by an operation executed during a time period from the time when the predetermined input operation is accepted until the time when the setting of the reference position of the time pointing hand 106 subject to setting comes to an end. When adjustment is necessary for each of the plural hands, the adjustment sessions may concurrently be executed or may sequentially be executed. No adjustment may be executed for the hand for which it is determined that the adjustment therefor is already finished and no adjustment is necessary.

Function of the control unit 401 may be realized by, for example, the control circuit 203. The reference position setting operation may be executed in a state where the driving mechanism (the movement) 209 is assembled before the completion of the assembly of the radio-controlled timepiece 100 regardless of the state where the assembly of the radio-controlled timepiece 100 is completed. For example, the reference position setting operation may be executed in a state where the time pointing hands 106 are not attached to the hand wheels 301.

For the reference position setting operation, the control unit 401 drives and controls the motor 304 based on the amount of light received by the light receiving element 214*b*. For example, for the reference position setting operation, the control unit 401 drives the motor 304 and determines a bright state or a dark state each time the motor 304 is driven by predetermined number of steps. For example, the control unit 401 determines the bright state or the dark state each time the motor 304 is driven by, for example, one step.

The control unit 401 identifies a switching position X at which the dark state is switched to the bright state when the dark state is consecutively determined for a first number of steps and the bright state is thereafter consecutively determined for a second number of steps based on the determination result as to the bright state or the dark state. For example, the control unit 401 identifies as the switching position X, the position at which the dark state is switched to the bright state when the dark state is consecutively determined twice as the first number of steps and the bright state is thereafter consecutively determined twice as the second number of steps. The first number of steps and the second number of steps are each not limited to twice and may each be set to be an arbitrary integer equal to or greater than one. The first number of steps and the second number of steps may be the same number or may be different from each other.

For example, for the identification of the switching position X, the control unit 401 drives the motor 304 by one step for one time and detects the position at which the dark state is consecutively determined for plural times and the bright state is thereafter consecutively determined for plural times based on the results of determination as to the bright state or the dark state. When the control unit 401 detects the position to determine the bright state, the control unit 401 determines the dark state or the bright state at the next position (the position reached by driving the motor 304 by one step from the position at which the bright state is determined) X+1 of the detected position at which the bright state is determined. When the bright state is determined at the next position X+1, the position at which the bright state is determined for the first time is identified as the switching position X.

For the identification of the switching position X, the control unit 401 determines the bright state or the dark state in the state where the detection sensitivity of the photo sensor 214 is set to be a first sensitivity. The first sensitivity may be set to be, for example, a sensitivity higher than the sensitivity used during normal movement of the hands. The detection sensitivity of the photo sensor 214 may be enhanced by, for example, increasing the output of the light emitting element 214*a*. For example, the sensitivity adjusting circuit 203*f* increases the amount of electric power supplied to the LED realizing the light emitting element 214*a*, whereby the output of the light emitting element 214*a* is increased and the detection sensitivity may thereby be enhanced.

The detection sensitivity of the photo sensor 214 (215 or 216) may be enhanced by, for example, enhancing the light reception sensitivity of the light receiving element 214*b*. For example, the sensitivity adjusting circuit 203*f* increases the amplification rate of the electric signal corresponding to the brightness or the darkness of the light received by the light receiving element 214*b* and the light reception sensitivity of the light receiving element 214*b* may thereby be enhanced. The detection sensitivity of the photo sensor 214 (215 or 216) may be adjusted by adjusting at least one of the light emission intensity of the light emitting element 214*a* and the light reception sensitivity of the light receiving element 214*b*. The detection sensitivity of the photo sensor 214 (215 or 216) may be adjusted by adjusting both the light emission intensity of the light emitting element 214*a* and the light reception sensitivity of the light receiving element 214*b*.

The control unit 401 thereafter determines the position one step after the identified switching position X as the reference position X+1 and stores therein information concerning the reference position X+1. The control unit 401 includes a storage unit 401*a* to store therein the information concerning the reference position X+1. The storage unit 401*a* may be realized by, for example, the ROM 203*b*. The information concerning the reference position X+1 may be realized by the information with which the position may be identified of the hand wheel 301 at the time point at which the bright state is determined for the second time in the case where the dark state is consecutively determined twice and the bright state is thereafter consecutively determined twice.

When the control unit 401 identifies the switching position X, the control unit 401 determines whether the dark state is established at a position X−1 one step before the switching position X and determines whether the bright state is established at the position (the reference position) X+1 one step after the switching position X, in the state where the control unit 401 sets the detection sensitivity of the photo sensor 214 (215 or 216) to be the second sensitivity. The second sensitivity may be set to be, for example, a sensitivity lower than the sensitivity used during normal movement of the hands.

As described above, the detection sensitivity of the photo sensor 214 (215 or 216) may be adjusted by adjusting at least one of the light emission intensity of the light emitting element 214*a* and the light reception sensitivity of the light receiving element 214*b*. For example, the sensitivity adjusting circuit 203*f* reduces the output of the light emitting element 214*a* or the sensitivity adjusting circuit 203*f* reduces the amplification rate of the electric signal corresponding to the brightness or the darkness of the light received by the light receiving element 214*b*, and the detection sensitivity of the photo sensor 214 (215 or 216) may thereby be reduced.

For example, the control unit 401 forwardly rotates the motor 304 at a speed higher than that used during normal movement of the hands, fast-forwards the hand wheel 301, and thereby positions the hand wheel 301 at the position X−1. Alternatively, for example, the control unit 401 may position the hand wheel 301 at the position X−1 by rotating the hand wheel 301 in the reverse direction against that used during normal movement of the hands by rotating backward the motor 304. When the control unit 401 rotates the hand wheel 301 in the reverse direction against that used during normal movement of the hands by backwardly rotating the motor 304, the control unit 401 backwardly rotates the motor 304 by an amount more than that necessary to reach the position X−1 (for example, the position of X−5) and thereafter forwardly rotates the motor 304 to reach the position X−1 taking into consideration the backlash.

For example, the control unit 401 determines whether the dark state is established in a state where the hand wheel 301 is positioned at the position X−1, thereafter forwardly rotates the motor 304 at a speed higher than that used during normal movement of the hands, fast-forwards the hand wheel 301, and thereby positions the hand wheel 301 at the reference position X+1. Alternatively, the control unit 401 may forwardly rotate the motor 304 at a speed equal to that used during normal movement of the hands and thereby may position the hand wheel 301 at the reference position X+1.

When the dark state is established at the position X−1 one step before the switching position X and the bright state is established at the position (the reference position) X+1 one step after the switching position X, the control unit 401 stores to the storage unit 401*a*, the information concerning the phases of the motor 304 at the position X−1 and the position (the reference position) X+1. The information concerning the phases may be realized by information indicating the orientation to output the pulse of the motor 304 (the orientation of the generated magnetic field) at the time points for the reference position X+1 and the position X−1 (see FIG. 6A and FIG. 6B). The phase of the motor 304 at the reference position X+1 and the phase of the motor 304 at the position X−1 are the same phase.

When the control unit 401 succeeds in storing the information concerning the reference position X+1, that is, when the control unit 401 succeeds in executing the reference position setting operation, the control unit 401 may change the date displayed by the date indicator wheel to a date that is advanced from the date of the time when the predetermined input operation is received, by driving and controlling the motor 304 to rotate the date indicator driving wheel. When the control unit 401 fails to store the information concerning the reference position X+1, that is, when the control unit 401 fails in executing the reference position setting operation, the control unit 401 may change the date displayed by the date indicator wheel to a date that is before the date of the time when the predetermined input operation is received by driving and controlling the motor 304 to rotate the date indicator driving wheel.

The manufacturer of the timepiece is thereby able to determine whether the setting of the reference position setting operation is successfully executed even when the reference position setting operation is executed in a state where the driving mechanism (the movement) 209 is assembled before the completion of the assembling of the radio-controlled timepiece 100, that is, for example, in a state where the time pointing hands 106 are not attached to the hand wheels 301.

Figure 5:
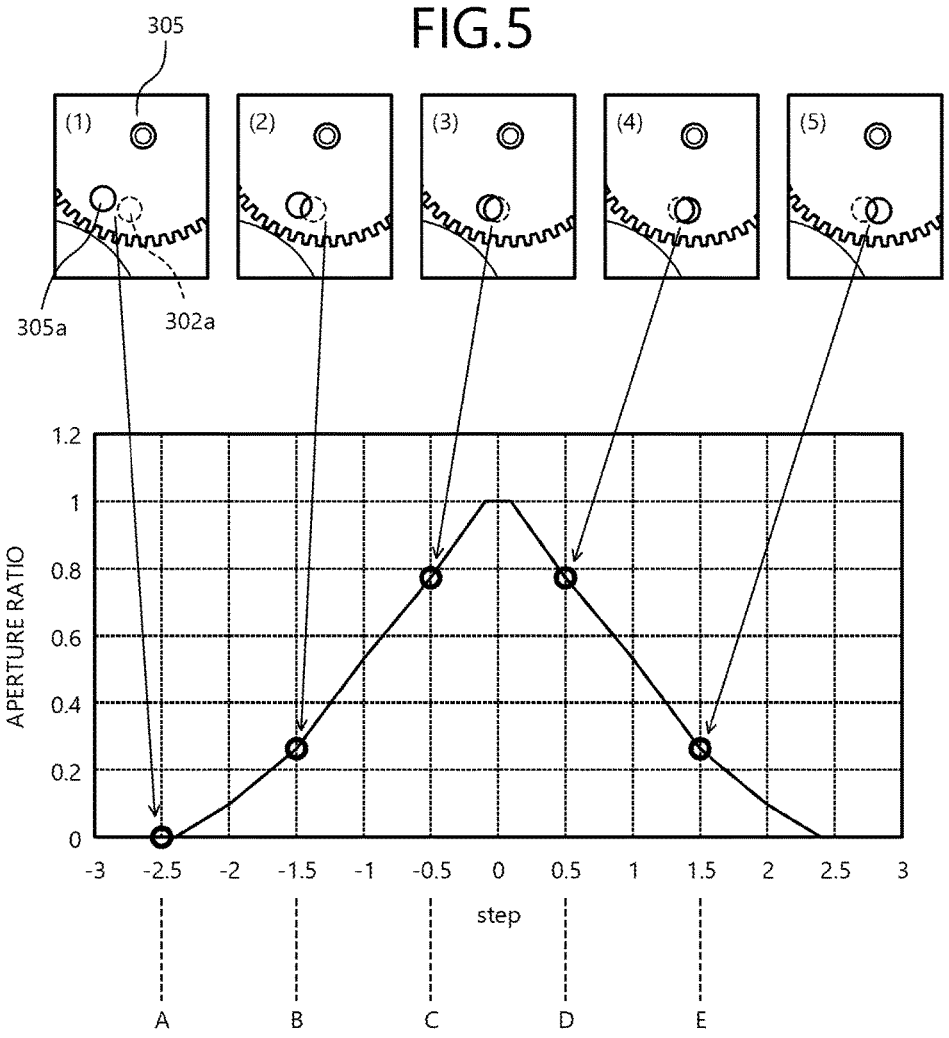
FIG. 5 is an explanatory diagram of a relation between aperture ratio of a detection hole disposed in a detection wheel and detection level of a photo sensor.

The relation will be described between the aperture ratio of the detection hole 305*a* disposed in the detection wheel 305 and the detection level of the photo sensor 214. FIG. 5 is an explanatory diagram of the relation between the aperture ratio of the detection hole 305*a* disposed in the detection wheel 305 and the detection level of the photo sensor 214. In FIG. 5, when the detection hole 305*a* disposed in the detection wheel 305 and the detection hole 302*a* disposed in the gear 302 constituting the wheel train 303 do not overlap each other (see FIG. 1) in FIG. 5), the aperture ratio of the detection hole 305*a* disposed in the detection wheel 305 is 0 (zero) (see A in FIG. 5).

When the detection wheel 305 and the gear 302 constituting the wheel train 303 rotate associated with the rotation of the hand wheel 301 caused by driving the motor 304, the overlapping area of the detection hole 305*a* and the detection hole 302*a* gradually increases from the state of no overlapping (see FIG. 2) in FIG. 5). When the detection hole 305*a* and the detection hole 302*a* start to overlap each other, the light emitted by the light emitting element 214*a* passes through the overlapping portion of the detection hole 305*a* and the detection hole 302*a* and is received by the light receiving element 214*b*. The detection level in the control unit varies corresponding to the amount of received light.

When the overlapping area of the detection hole 305*a* and the detection hole 302*a* gradually increases, the aperture ratio of the detection hole 305*a* disposed in the detection wheel 305 also gradually increases and the detection level of the photo sensor 214 increases corresponding to the magnitude of the aperture ratio (see B, C, and D in FIG. 5). For the detection wheel 305 and the gear 302 each having the detection hole disposed therein, after the overlapping area of the detection hole 305*a* and the detection hole 302*a* becomes maximal (see (3) and (4) in FIG. 5), the overlapping area gradually decreases (see (5) in FIG. 5) and the detection wheel 305 and the gear 302 are displaced relative to each other to again establish the state of no overlapping. Associated with this, the aperture ratio of the detection hole 305*a* disposed in the detection wheel 305 gradually decreases and the detection level of the photo sensor 214 decreases corresponding to the magnitude of the aperture ratio (see E in FIG. 5).

Figure 6A:
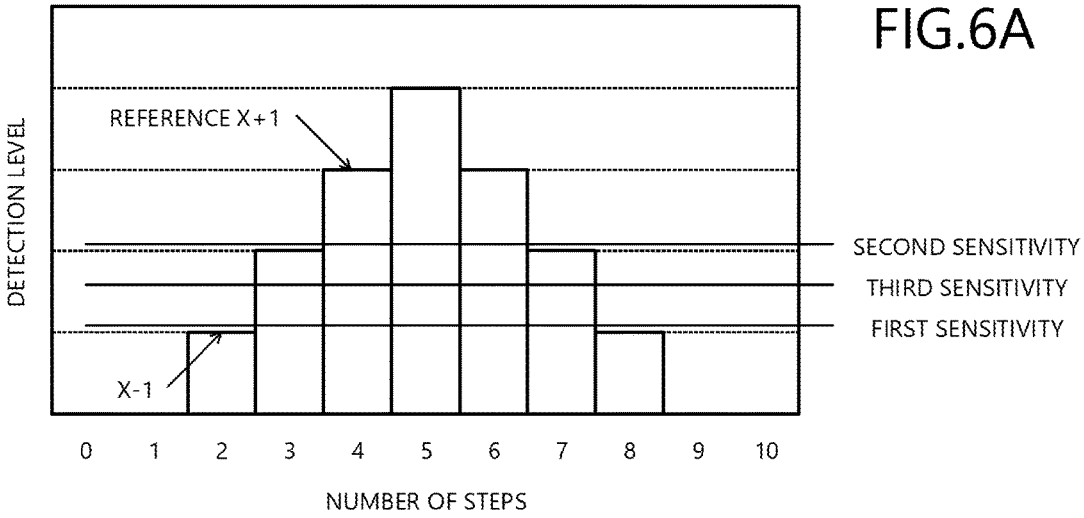
FIG. 6A is an explanatory diagram (part 1) of a relation between phase of a motor and, detection sensitivity and the detection level of the photo sensor.
Figure 6B:
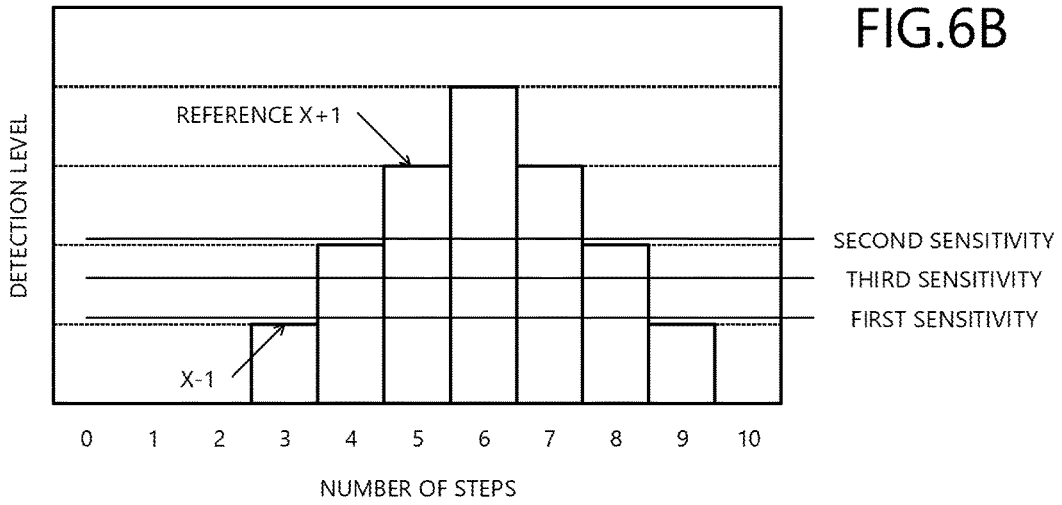
FIG. 6B is an explanatory diagram (part 2) of the relation between the phase of the motor and, the detection sensitivity and the detection level of the photo sensor.

A relation will be described between the detection sensitivity and the detection level of the photo sensor 214 and the phase of the motor 304. FIG. 6A and FIG. 6B are explanatory diagrams of the relation between the phase of the motor 304 and, the detection sensitivity and the detection level of the photo sensor 214 (215 or 216). FIG. 6A depicts the relation between the detection sensitivity and the detection level of the photo sensor 214 (215 or 216) and the phase of the motor 304 obtained when the number of steps of the motor 304 is an even number in a case where the reference position X+1 is detected. FIG. 6B depicts the relation between the detection sensitivity and the detection level of the photo sensor 214 (215 or 216) and the phase of the motor 304 obtained when the number of steps of the motor 304 is an odd number in a case where the reference position X+1 is detected.

As depicted in FIG. 6A and FIG. 6B, regardless of whether the number of steps of the motor 304 is an even number or an odd number at the position X−1, the first sensitivity and the second sensitivity are both set to be higher than the detection level and are set to determine the dark state. Regardless of whether the number of steps of the motor 304 is an even number or an odd number at the position X+1, the first sensitivity and the second sensitivity are both set to be lower than the detection level and are set to determine the bright state.

The detection level of the photo sensor 214 used during normal movement of the hands is set to be a third sensitivity that is between the first sensitivity and the second sensitivity set as above. For example, the sensitivity adjusting circuit 203*f* in the control unit 401 adjusts at least one of the light emission intensity of the light emitting element 214*a* and the light reception sensitivity of the light receiving element 214*b*, and thereby sets the detection sensitivity of the photo sensor 214 (215 or 216) by which the dark state may be determined at the position X−1 one step before the switching position X and the bright state may be determined at the position (the reference position) X+1 one step after the switching position X, to be between the first sensitivity and the second sensitivity.

Regardless of whether the number of steps of the motor 304 is an even number or an odd number at the position X−1 and the reference position X+1, the photo sensor 214 may thereby determine the dark state at the position X−1 and may thereby determine the bright state at the reference position X+1 during normal movement of the hands. The position of the time pointing hand 106 indicated by the hand wheel 301 may be detected reliably during normal movement of the hands. Three systems of the reference position setting mechanism according to the present invention are disposed to detect each of the three independent time pointing hands 106 of the hour hand 106*a*, the minute hand 106*b*, and the second hand 106*c*.

A process procedure will be described for the reference position setting operation executed by the radio-controlled timepiece 100 of the first embodiment according to the present invention. FIG. 7 is a flowchart of the process procedure for a reference position setting operation executed by the radio-controlled timepiece 100 of the first embodiment according to the present invention. The process depicted in FIG. 7 is executed when the predetermined input operation executed for the operation unit 104 is received.

The process procedure for the reference position setting operation for the hand wheel 301 corresponding to the hour hand 106*a* corresponding to the photo sensor 214 will be described with reference to FIG. 7 while the reference position may be set by executing the same process as that for the hour hand 106*a* also for each of the minute hand 106*b* corresponding to the photo sensor 215 and the second hand 106*c* corresponding to the photo sensor 216.

In the flowchart of FIG. 7, the detection sensitivity of the photo sensor 214 is set to be the first sensitivity (step S701) and the motor 304 is caused to advance the hand by one step (step S702). The motor 304 is driven by one step at step S702 and the hand wheel 301 is thereby rotated (turned) by one step.

In the state where the detection sensitivity of the photo sensor 214 is set to be the first sensitivity, it is determined whether the dark state is detected based on an output value of the photo sensor (the light receiving element 214*b*) at the position reached by rotating (turning) the hand wheel 301 by one step (step S703). If it is determined at step S703 that the dark state is not detected (step S703: NO), it is determined whether the time pointing hand 106 for which the reference position is to be set rotates by one rotation (step S704).

If it is determined at step S704 that the time pointing hand 106 for which the reference position is to be set does not rotate by one rotation (step S704: NO), the procedure returns to step S702 and the motor 304 is driven by one step to rotate (turn) the hand wheel 301 by one step. In the case of "step S704: NO", when the time pointing hand 106 for which the reference position is to be set rotates by one rotation as a result of again executing the process steps from step S702 to step S704 (step S704: YES), the procedure advances to step S720. It may be determined at step S704 whether the time pointing hand 106 for which the reference position is to be set rotates by two or more rotations.

On the other hand, if it is determined at step S703 that the dark state is detected (step S703: YES), it is determined whether the time pointing hand 106 for which the reference position is to be set rotates by one rotation (step S705). It may be determined at step S705 whether the time pointing hand 106 for which the reference position is to be set rotates by two or more rotations.

If it is determined at step S705 that the time pointing hand 106 for which the reference position is to be set rotates by one rotation (step S705: YES), the procedure advances to step S720.

On the other hand, if it is determined at step S705 that the time pointing hand 106 for which the reference position is to be set does not rotate by one rotation (step S705: NO), the motor 304 is driven by one step (step S706). The hand wheel 301 is rotated (turned) by one step by driving the motor 304 by one step at step S706. It is determined whether the bright state is detected based on the output value of the photo sensor 214 (the light receiving element 214*b*) at the position reached by rotating (turning) the hand wheel 301 by one step (step S707).

If it is determined at step S707 that the bright state is not detected (step S707: NO), the procedure moves to step S705 to determine whether the time pointing hand 106 for which the reference position is to be set rotates by one rotation. On the other hand, when it is determined at step S707 that the bright state is detected (step S707: YES), the position at which the bright state is detected is determined as the switching position X and the information concerning the switching position X is stored to the ROM 203*b* or the like (step S708).

The motor 304 is driven by one step (step S709). The hand wheel 301 is rotated (turned) by one step by driving the motor 304 by one step at step S709. It is determined whether the bright state is detected based on the output value of the photo sensor 214 (the light receiving element 214*b*) at the position reached by rotating (turning) the hand wheel 301 by one step (step S710).

If it is determined at step S710 that the bright state is not detected (step S710: NO), the procedure moves to step S705. In the case of "step S710: NO", it is assumed that the bright state is not detected due to any abnormality and the process steps from step S705 to step S710 are therefore again executed. On the other hand, if it is determined at step S710 that the bright state is detected (step S710: YES), the position at which the bright state is detected is determined as the reference position X+1 and the information concerning the reference position X+1 is stored in the ROM 203*b* or the like (step S711).

The detection sensitivity of the photo sensor 214 is set to be the second sensitivity (step S712) and the motor 304 is driven until the hand wheel 301 is positioned at the position X−1 (step S713). At step S713, for example, as above, the motor 304 is rotated forward at a speed higher than that used during normal movement of the hands to fast-forward the hand wheel 301 and the hand wheel 301 is thereby positioned at the position X−1. Alternatively, at step S713, for example, the hand wheel 301 may be positioned at the position X−1 by rotating backward the motor 304 by three or more steps and thereafter rotating forward the motor 304. The hand wheel 301 may be positioned at the position X−1 detecting that the dark state is established every time the motor 304 is rotated forward.

It is determined whether the dark state is detected based on the output value of the photo sensor 214 (the light receiving element 214*b*) in the state where the hand wheel 301 is positioned at the position X−1 (step S714). If it is determined at step S714 that the dark state is not detected (step S714: NO), the procedure advances to step S720.

On the other hand, if it is determined at step S714 that the dark state is detected (step S714: YES), the motor 304 is driven until the hand wheel 301 is positioned at the reference position X+1 (step S715). At step S715, for example, as above, the motor 304 is rotated forward by two steps at a speed higher than that used during normal movement of the hands to fast-forward the hand wheel 301 and the hand wheel 301 is thereby positioned at the reference position X+1. Alternatively, at step S715, for example, the hand wheel 301 may be positioned at the reference position X+1 by rotating forward the motor 304 by two steps at the speed equal to that used during normal movement of the hands.

It is determined whether the bright state is detected based on the output value of the photo sensor 214 (the light receiving element 214*b*) in the state where the hand wheel 301 is positioned at the reference position X+1 (step S716). If it is determined at step S716 that the bright state is not detected (step S716: NO), the procedure advances to step S720. On the other hand, if it is determined at step S716 that the bright state is detected at the reference position X+1 (step S716: YES), the information concerning the time point when the bright state is detected, that is, the phase of the motor 304 in the state where the hand wheel 301 is positioned at the reference position X+1 is stored in the ROM 203*b* or the like (step S717).

If it is determined at step S716 that the bright state is not detected, the second sensitivity set at S712 may be weak. In this case, a sensitivity higher than the set second sensitivity may be set and the procedure may advance to S713.

The detection sensitivity of the photo sensor 214 used during normal movement of the hands is set (step S718). At step S718, the detection sensitivity of the photo sensor 214 used during normal movement of the hands is set to be the third sensitivity that is in a range higher than the second sensitivity of the photo sensor 214 and lower than the first sensitivity of the photo sensor 214. An "OK process" is thereafter executed (step S719) and the series of process steps comes to an end. At step S720, an "NG process" is executed (step S720) and the series of process steps comes to an end.

At step S719, the "OK process" is executed by, for example, rotating (turning) the date indicator wheel by driving the motor 304 such that the date displayed by the date indicator wheel is changed to a date that is advanced from the date of the time when the reference position setting operation is started. At step S720, the "NG process" is executed by, for example, rotating (turning) the date indicator wheel by driving the motor 304 such that the date displayed by the date indicator wheel is changed to a date that is before the date of the time when the reference position setting operation is started. For example, in the case where the date at the time of the start of the reference position setting operation is "31st", the date indicator wheel is positioned at a position to display "1st" when the setting of the reference position is successfully executed, and the date indicator wheel is positioned at a position to display "30th" when the setting of the reference position has failed. By executing this, any reference position setting of the date indicator wheel is unnecessary when the setting of the reference position is successfully executed.

Alternatively, in a case where the time pointing hands 106 (the hour hand 106*a*, the minute hand 106*b*, and the second hand 106*c*) are attached to the hand wheel 301 for which the reference position is to be set, when the reference positions thereof are not 00:00:00 based on the hands and the attachment positions thereof, the hands may be corrected by rotating the crown and the correction amount thereof may be stored in the ROM 203*b* or the like.

At step S719, the "OK" process may be executed by, for example, positioning the hand wheel 301 for which the reference position is to be set, at a predetermined position determined in advance as the position to indicate the success of the setting of the reference position, by driving the motor 304. The predetermined position is, for example, 00:00:00 and, when the correction amount is set in advance, the time pointing hand 106 may be moved to the predetermined position determined in advance by driving the motor 304 by the amount corresponding to the correction amount from the reference position X+1. From the time when the "OK" process comes to an end as above, by setting 00:00:00 of the day, any time correction is thereafter unnecessary and the timepiece whose adjustment is successfully executed can be used readily as in its normal condition.

When the detection sensitivity of the photo sensor 214 used during normal movement of the hands is set (step S718), the information concerning the sensitivity of the photo sensor may be stored in the ROM 203*b* or the like. Because the sensitivity may differ among the plural hands, the detection sensitivity may be set for each of the hands.

In the radio-controlled timepiece 100 according to the present invention, at the adjustment step during the manufacture thereof or the like, the position X−1, the reference position X+1, and the motor steering (the phase) are detected. As above, the position X−1 represents the position one step before the switching position X, that is, for example, the position immediately before the position at which the dark state is switched to the bright state in the case where the bright state is consecutively detected for two steps after the dark state is detected for one step. The reference position X+1 represents the position one step after the switching position X, that is, for example, the position at which the bright state is detected at the second step in the case where the bright state is consecutively detected for two steps after the dark state is detected for one step.

The motor steering is coil terminals OUT1 and OUT2 of the timepiece two-pole stepping motor (the motor 304) and, at the adjustment step, it is determined whether detection of the bright or the dark state is executed after the motor driving pulse is output from the coil terminal OUT1 or the detection of the bright or the dark state is executed after the motor driving pulse is output from the coil terminal OUT2. The motor driving pulse is output alternately from the coil terminal OUT1 and the coil terminal OUT2, and the phases that are output at the position X−1 and the reference position X+1 are therefore the same.

In the normal detection operation, the photo sensor 214 is operated at the phase determined at the adjustment step (at the time when the motor driving pulse is output from the coil terminal OUT1 or is output from the coil terminal OUT2). The detection is thereby executed at every two steps. Success or failure is determined for the detection of the reference position by checking the detection of the dark state at the position X−1 and the detection of the bright state at the reference position X+1.

In the radio-controlled timepiece 100, the bright state cannot always be detected at the switching position X due to the dispersion of the photo sensor 214 and the driving of the wheel train during the driving of the hand. The detection of the dark state or the bright state is executed at the timings of the position X−1 and the reference position X+1. Assuming that the driving of the motor 304 has failed, the time pointing hand 106 cannot be driven in the next driving session due to a phase shift occurring due to the previous failure, and a shift of two steps is occurs in the time pointing hand 106 when the driving is restarted. The position X−1 and the reference position X+1 each do not become the position of the switching position X. When the bright or the dark state expected at the reference position X+1 is not detected, the shifted time pointing hand 106 may be corrected by seeking the position at which the dark state is detected at the position X−1 and the bright state is detected at the reference position X+1 by again driving the motor 304 by two steps.

Configuration will be described of a radio-controlled timepiece of a second embodiment that realizes the timepiece according to the present invention. In the second embodiment, portions identical to those of the first embodiment will be given the same reference numerals used in the first embodiment and will not again be described.

In the first embodiment, the switching position X and the reference position X+1 are identified with the first sensitivity, and it is confirmed that the dark state is detected at the position X−1 and the bright state is detected at the reference position X+1 using the second sensitivity. In contrast, according to the radio-controlled timepiece realizing the timepiece of the second embodiment according to the present invention, as Modification 1 of the first embodiment, the position at which the dark state is switched to the bright state with the second sensitivity is identified as the reference position X+1, the position one step before the reference position X+1 is set to be the switching position X, the position two steps before the reference position X+1 is set to be the position X−1, and it is confirmed that the dark state is detected at the position X−1 with the first sensitivity.

Figure 8A:
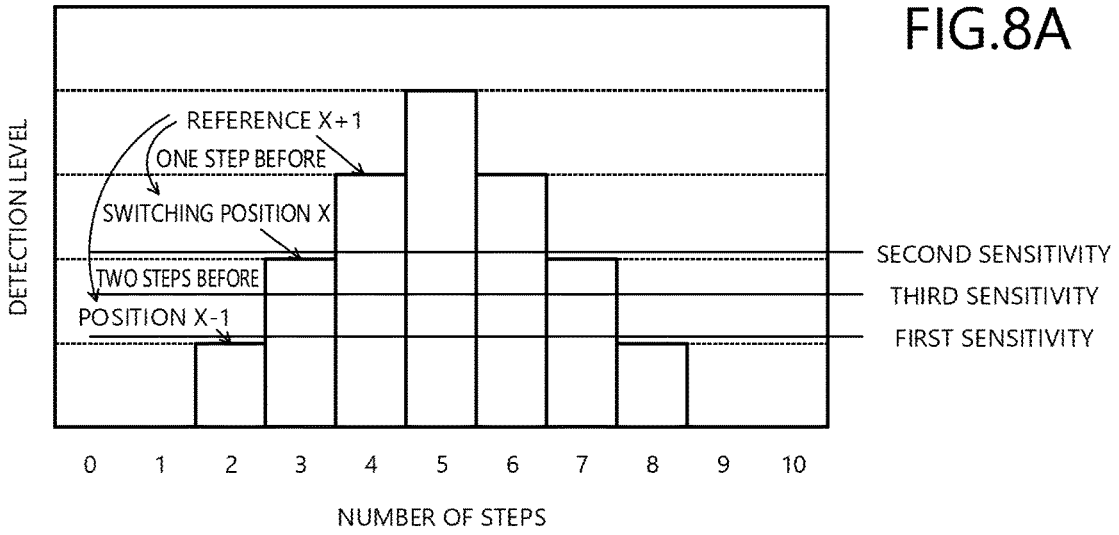
FIG. 8A is an explanatory diagram (part 1) of a relation between the phase of the motor and, the detection sensitivity and the detection level, at the photo sensor included in the radio-controlled timepiece of a second embodiment according to the present invention.
Figure 8B:
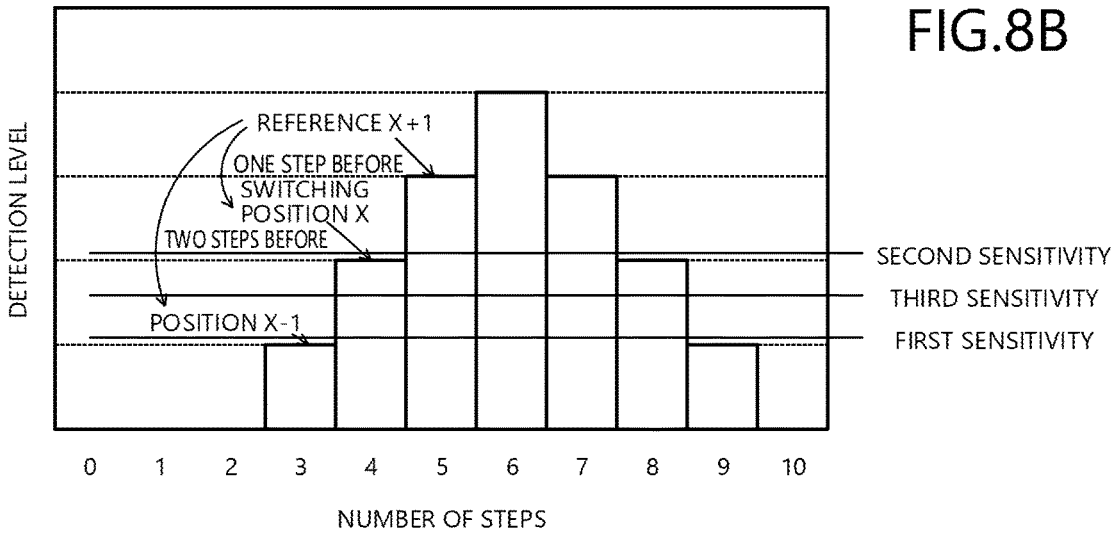
FIG. 8B is an explanatory diagram (part 2) of the relation between the phase of the motor and, the detection sensitivity and the detection level, at the photo sensor included in the radio-controlled timepiece of a second embodiment according to the present invention.

FIG. 8A and FIG. 8B are each an explanatory diagram of the relation between the phase of the motor and, the detection sensitivity and the detection level, at the photo sensor 214 (215 or 216) included in the radio-controlled timepiece 100 of the second embodiment according to the present invention. FIG. 8A depicts the relation between the detection sensitivity and the detection level, and the phase of the motor 304 for the photo sensor 214 (215 or 216) obtained when the number of steps of the motor 304 is an even number when the reference position X+1 is detected. FIG. 8B depicts the relation between the detection sensitivity and the detection level, and the phase of the motor 304 for the photo sensor 214 (215 or 216) obtained when the number of steps of the motor 304 is an odd number when the reference position X+1 is detected.

As depicted in FIG. 8A and FIG. 8B, the control unit 401 included in the radio-controlled timepiece 100 of the second embodiment identifies the position at which the dark state is switched to the bright state with the second sensitivity as the reference position X+1 regardless of whether the number of steps of the motor 304 at the reference position X+1 is an even number or an odd number. The control unit 401 of the second embodiment sets the position one step before the identified reference position X+1 to be the switching position X and the position two steps before the reference position X+1 to be the position X−1, and checks that the dark state is determined at the position X−1 with the first sensitivity.

The detection level of the photo sensor 214 during normal movement of the hands is set to be the third sensitivity that is between the first sensitivity and the second sensitivity set as above. For example, the sensitivity adjusting circuit 203*f* in the control unit 401 adjusts at least one of the light emission intensity of the light emitting element 214*a* and the light reception sensitivity of the light receiving element 214*b*, and thereby sets the detection sensitivity of the photo sensor 214 (215 or 216) with which the bright state may be determined at the reference position X+1 and the dark state may be determined at the position X−1, to be between the first sensitivity and the second sensitivity.

Regardless of whether the number of steps of the motor 304 is an even number or an odd number at the position X−1 and the reference position X+1, the photo sensor 214 can thereby determine the dark state at the position X−1 and can thereby determine the bright state at the reference position X+1 during normal movement of the hands. The position of the time pointing hand 106 indicated by the hand wheel 301 may be detected reliably during normal movement of the hands. Three systems of the reference position setting mechanism according to the present invention are disposed to detect each of the three independent time pointing hands 106 of the hour hand 106*a*, the minute hand 106*b*, and the second hand 106*c*.

Figure 9:
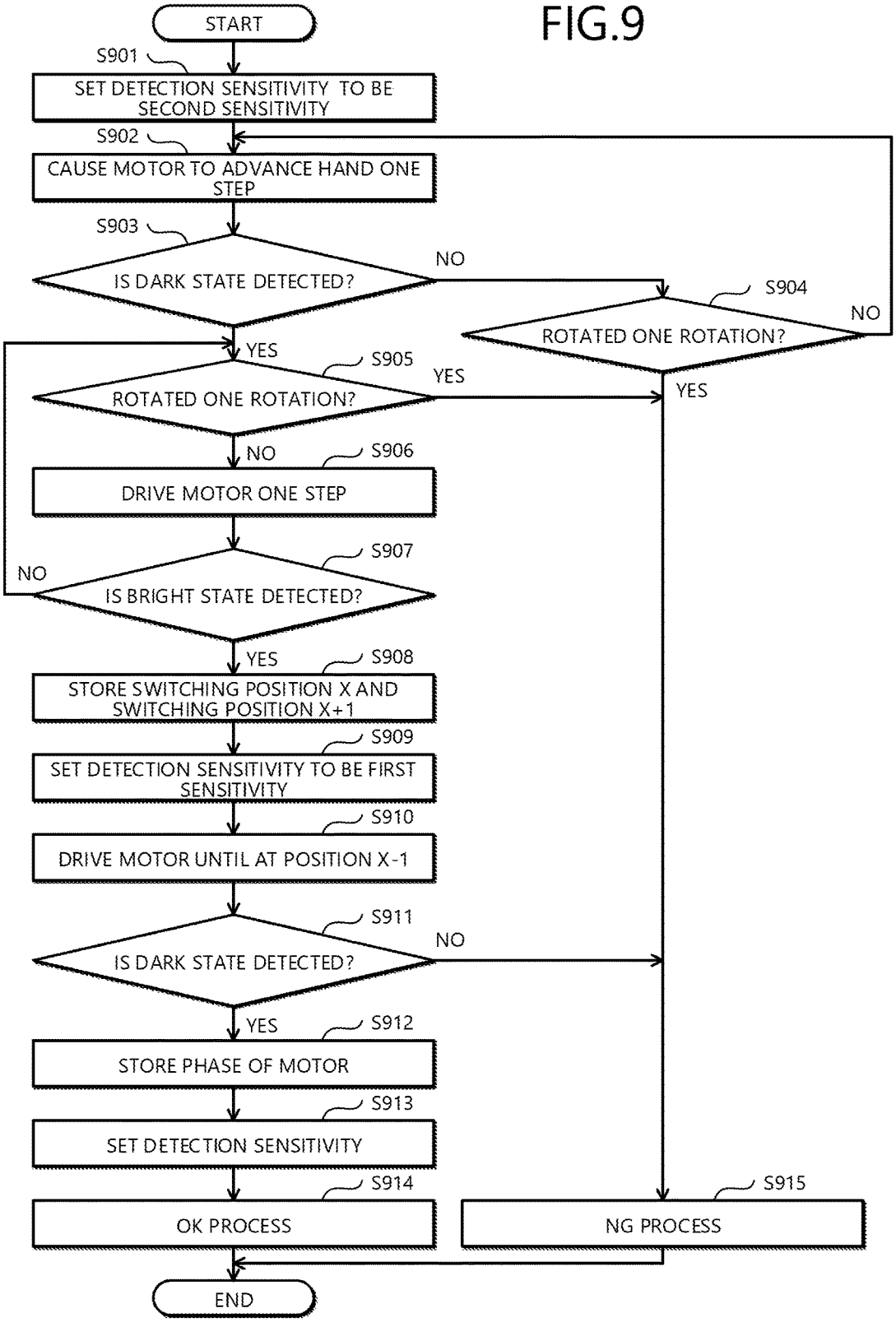
FIG. 9 is a flowchart of a process procedure for a reference position setting operation executed by the radio-controlled timepiece of the second embodiment according to the present invention.

A process procedure will be described for the reference position setting operation executed by the radio-controlled timepiece 100 of the second embodiment according to the present invention. FIG. 9 is a flowchart of the process procedure for a reference position setting operation executed by the radio-controlled timepiece 100 of the second embodiment according to the present invention. The process depicted in FIG. 9 is executed when the predetermined input operation executed for the operation unit 104 is received, similar to the process depicted in the flowchart of FIG. 7.

Similar to the first embodiment, in FIG. 9, the process procedure for the reference position setting operation for the hand wheel 301 corresponding to the hour hand 106*a* corresponding to the photo sensor 214 will be described with reference to FIG. 9 while the reference position may be set by executing the same process as that for the hour hand 106*a* also for each of the minute hand 106*b* corresponding to the photo sensor 215 and the second hand 106*c* corresponding to the photo sensor 216.

In the flowchart of FIG. 9, the detection sensitivity of the photo sensor 214 is set to be the second sensitivity (step S901) and the motor 304 is caused to advance the hand by one step (step S902). The motor 304 is driven by one step at step S902 and the hand wheel 301 is thereby rotated (turned) by one step.

In the state where the detection sensitivity of the photo sensor 214 is set to be the second sensitivity, it is determined whether the dark state is detected based on an output value of the photo sensor (the light receiving element 214*b*) at the position reached by rotating (turning) the hand wheel 301 by one step (step S903). If it is determined at step S903 that the dark state is not detected (step S903: NO), it is determined whether the time pointing hand 106 for which the reference position is to be set rotates by one rotation (step S904).

If it is determined at step S904 that the time pointing hand 106 for which the reference position is to be set does not rotate by one rotation (step S904: NO), the procedure returns to step S902 and the motor 304 is driven by one step to rotate (turn) the hand wheel 301 by one step. In the case of "step S904: NO", when the time pointing hand 106 for which the reference position is to be set rotates by one rotation as a result of again executing the process steps from step S902 to step S904 (step S904: YES), the procedure advances to step S920. It may be determined at step S904 whether the time pointing hand 106 for which the reference position is to be set rotates by two or more rotations.

On the other hand, if it is determined at step S903 that the dark state is detected (step S903: YES), it is determined whether the time pointing hand 106 for which the reference position is to be set rotates by one rotation (step S905). It may be determined at step S905 whether the time pointing hand 106 for which the reference position is to be set rotates by two or more rotations. If it is determined at step S905 that the time pointing hand 106 for which the reference position is to be set rotates by one rotation (step S905: YES), the procedure advances to step S915.

On the other hand, if it is determined at step S905 that the time pointing hand 106 for which the reference position is to be set does not rotate by one rotation (step S905: NO), the motor 304 is driven by one step (step S906). The hand wheel 301 is rotated (turned) by one step by driving the motor 304 by one step at step S906. It is determined whether the bright state is detected based on the output value of the photo sensor 214 (the light receiving element 214*b*) at the position reached by rotating (turning) the hand wheel 301 by one step (step S907).

If it is determined at step S907 that the bright state is not detected (step S907: NO), the procedure moves to step S905 to determine whether the time pointing hand 106 for which the reference position is to be set rotates by one rotation. On the other hand, if it is determined at step S907 that the bright state is detected (step S907: YES), the position at which the bright state is detected at "step S907: YES" after the dark state is detected at "step S903: YES is determined as the reference position X+1, and the information concerning the reference position X+1 is stored to the ROM 203*b* or the like, and the position one step before the reference position X+1 is determined as the switching position X and the information concerning the switching position X is stored to the ROM 203*b* or the like (step S908).

The detection sensitivity of the photo sensor 214 is set to be the first sensitivity (step S909) and the motor 304 is driven until the hand wheel 301 is positioned at the position X−1 (step S910). In other words, at step S910, the motor 304 is driven until the hand wheel is positioned at a position two steps before the reference position X+1.

At step S910, for example, as above, the motor 304 is rotated forward at a speed higher than that used during normal movement of the hands to fast-forward the hand wheel 301 and the hand wheel 301 is thereby positioned at the position X−1. Alternatively, at step S910, for example, the hand wheel 301 may be positioned at the position X−1 by rotating backward the motor 304 by three or more steps and thereafter rotating forward the motor 304. In this case, the hand wheel 301 may be positioned at the position X−1 detecting that the dark state is established every time the motor 304 is rotated forward.

It is determined whether the dark state is detected based on the output value of the photo sensor 214 (the light receiving element 214*b*) in the state where the hand wheel 301 is positioned at the position X−1 (step S911). If it is determined at step S911 that the dark state is not detected (step S911: NO), the procedure advances to step S915.

On the other hand, if it is determined at step S911 that the dark state is detected (step S911: YES), the information concerning the time point at which the bright state is detected at "step S907: YES", that is, the phase of the motor 304 in the state where the hand wheel 301 is positioned at the reference position X+1 is stored in the ROM 203*b* or the like (step S912). At step S912, the information concerning the time point at which the dark state is detected at "step S911: YES", that is, the phase of the motor 304 in the state where the hand wheel 301 is positioned at the position X−1 may be stored in the ROM 203*b* or the like.

The detection sensitivity of the photo sensor 214 during normal movement of the hands is set (step S913). At step S913, similar to the first embodiment, the detection sensitivity of the photo sensor 214 during normal movement of the hands is set to be the third sensitivity of the range higher than the second sensitivity of the photo sensor 214 and lower than the first sensitivity of the photo sensor 214. Similar to the first embodiment, the "OK" process is thereafter executed (step S914) and the series of process steps comes to an end. At step S915, similar to the first embodiment, the "NG" process is executed (step S915) and the series of process steps comes to an end.

As described above, according to the radio-controlled timepiece of the second embodiment, the position of the time pointing hand 106 indicated by the hand wheel 301 may be detected reliably during normal movement of the hands by executing the detection of the dark state and the bright state based on the second sensitivity and thereafter executing the determination of the dark state and the bright state based on the first sensitivity. According to the radio-controlled timepiece of the second embodiment, reduction of the load on the computing unit 203*a* concerning the processing of the reference position setting operation may be facilitated compared to the first embodiment because the reference position X+1 can be determined readily based on the detection result of the dark state and the bright state based on the second sensitivity.

Configuration will be described of a radio-controlled timepiece of a third embodiment that realizes the timepiece according to the present invention. In the third embodiment, portions identical to those of the first and second embodiments will be given the same reference numerals used in the first and second embodiments and will not again be described.

In the first embodiment, the switching position X and the reference position X+1 are identified with the first sensitivity, and it is confirmed that the dark state is detected at the position X−1 and the bright state is detected at the reference position X+1 using the second sensitivity. In contrast, according to the radio-controlled timepiece realizing the timepiece of the third embodiment according to the present invention, as Modification 2 of the first embodiment, the reference position Y−1 and the switching position Y at which the bright state is switched to the dark state are identified with the first sensitivity, the reference position Y−1 is confirmed to be the bright state and at the position Y+1, the dark state is confirmed.

Figure 10A:
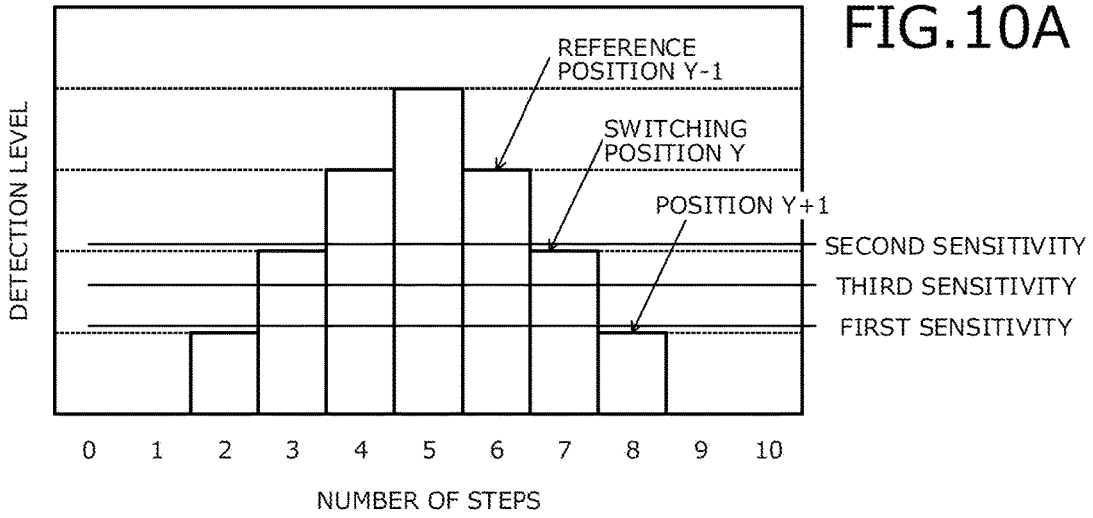
FIG. 10A is an explanatory diagram (part 1) of the relation between the phase of the motor and, the detection sensitivity and the detection level, in the photo sensor included in the radio-controlled timepiece of a third embodiment according to the present invention.
Figure 10B:
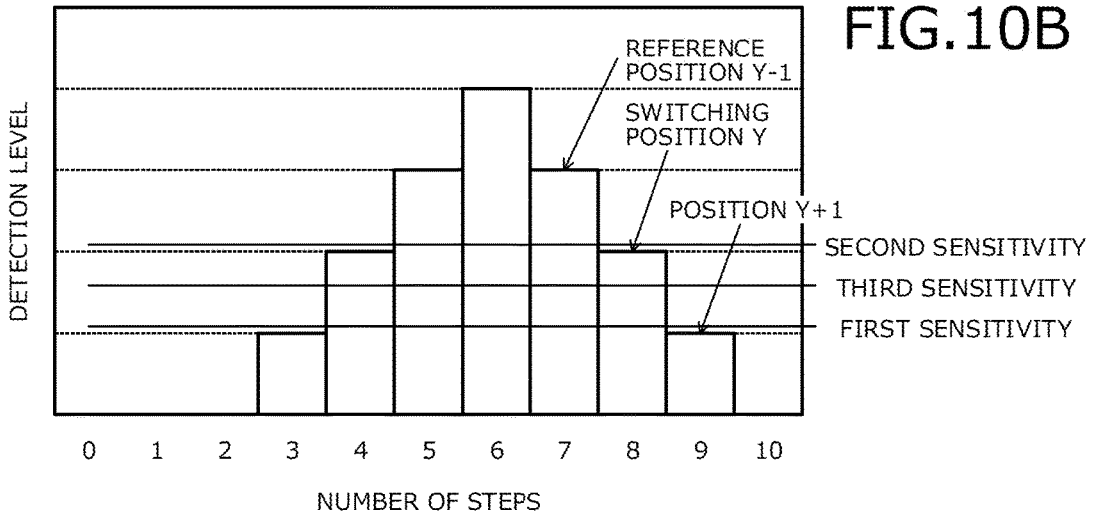
FIG. 10B is an explanatory diagram (part 2) of the relation between the phase of the motor and, the detection sensitivity and the detection level, in the photo sensor included in the radio-controlled timepiece of the third embodiment according to the present invention.

FIG. 10A and FIG. 10B are each an explanatory diagram of the relation between the phase of the motor and, the detection sensitivity and the detection level, at the photo sensor 214 (215 or 216) included in the radio-controlled timepiece 100 of the third embodiment according to the present invention. FIG. 10A depicts the relation between the detection sensitivity and the detection level, and the phase of the motor 304 for the photo sensor 214 (215 or 216) obtained when the number of steps of the motor 304 is an even number when the reference position Y−1 is detected. FIG. 10B depicts the relation between the detection sensitivity and the detection level, and the phase of the motor 304 for the photo sensor 214 (215 or 216) obtained when the number of steps of the motor 304 is an odd number when the reference position Y−1 is detected.

As depicted in FIG. 10A and FIG. 10B, regardless of whether the number of steps of the motor 304 is an even number or an odd number at the reference position Y−1, the first sensitivity and the second sensitivity are both set to be lower than the detection level and are set to determine the bright state. Regardless of whether the number of steps of the motor 304 is an even number or an odd number at the position Y+1, the first sensitivity and the second sensitivity are both set to be higher than the detection level and are set to determine the dark state.

The detection level of the photo sensor 214 during normal movement of the hands is set to be the third sensitivity that is between the set first sensitivity and the set second sensitivity similar to the first and the second embodiments. Regardless of whether the number of steps of the motor 304 is an even number or an odd number at the reference position Y−1 and the position Y+1, the photo sensor 214 may thereby determine the bright state at the reference position Y−1 and may thereby determine the dark state at the position Y+1 during normal movement of the hands. The position of the time pointing hand 106 indicated by the hand wheel 301 may thereby be reliably detected during normal movement of the hands.

The radio-controlled timepiece of the third embodiment realizing the timepiece according to the invention executes the following procedure of (1) to (5). The details of the procedure of (1) to (5) will be described with reference to FIG. 11A and FIG. 11B.

(1) The position is detected at which the bright state is switched to the dark state with the first sensitivity (the position of the number of steps "8" in FIG. 6A).

(2) It is confirmed that the bright state is established at the position one step before the position at which the bright state is switched to the dark state with the first sensitivity (the position of the number of steps "7" in FIG. 6A). When the bright state is established at the position one step before the position at which the bright state is switched to the dark state with the first sensitivity, this position is set to be the position Y.

(3) The sensitivity is switched to the second sensitivity and it is confirmed that the bright state is established at the position Y−1 one step before the position Y (the position of the number of steps "6" in FIG. 6A).

(4) It is further confirmed that the dark state is established at the position Y+1 one step after the position Y (the position of the number of steps "8" in FIG. 6A).

(5) When all of (1) to (4) are satisfied, the position Y−1 (the position of the number of steps "6" in FIG. 6A) is set to be the reference position. In this case, the position Y realizes the switching position.

A functional configuration of the radio-controlled timepiece 100 of the third embodiment according to the present invention will be described. A functional configuration of the radio-controlled timepiece 100 of the third embodiment may be depicted by a block diagram the same as the block diagram depicted in FIG. 4 of the first embodiment and will not be depicted. The radio-controlled timepiece 100 of the third embodiment is different from the radio-controlled timepiece 100 of the first embodiment in the function realized by the control unit 401.

The control unit 401 in the radio-controlled timepiece 100 of the third embodiment identifies the position at which the bright state is switched to the dark state in the case where the bright state is consecutively determined for the first number of steps and the dark state is thereafter consecutively determined for the second number of steps based on the determination result as to whether the bright state or the dark state is established. For example, the control unit 401 identifies the position at which the bright state is switched to the dark state in the case where the bright state is consecutively determined twice as the first number of steps and the dark state is thereafter consecutively determined twice as the second number of steps.

The control unit 401 determines whether the bright state or the dark state is established at the position one step before the identified position. In this case, for example, the control unit 401 rotates forward the motor 304 at a speed higher than that during normal movement of the hands, fast-forwards the hand wheel 301, and thereby positions the hand wheel 301 at a position one step before the identified position.

Alternatively, in this case, for example, the control unit 401 may position the hand wheel 301 at the position one step before the identified position by rotating backward the motor 304 and thereby rotating backward the hand wheel 301 in the direction opposite to that taken during normal movement of the hands. When the control unit 401 rotates backward the motor 304 and thereby rotates the hand wheel 301 in the direction opposite to that taken during normal movement of the hands, the control unit 401 rotates backward the motor 304 by an amount more than that to reach the position one step before the identified position (for example, the position five steps before the identified position) and thereafter rotates forward the motor 304 to the position one step before the identified position taking into consideration the backlash.

As a result of this determination, when the bright state is established at the position one step before the identified position, the control unit 401 identifies the position one step before the identified position as the switching position Y (see FIG. 10A and FIG. 10B). For identifying the switching position Y, the control unit 401 determines whether the bright state or the dark state is established in the state where the detection sensitivity of the photo sensor 214 is set to be the first sensitivity.

The control unit 401 determines whether the bright state is established at the position Y−1 that is one step before the identified switching position Y in the state where the detection sensitivity of the photo sensor 214 (215 or 216) is set to be the second sensitivity. The control unit 401 determines whether the dark state is established at the position Y+1 that is one step after the switching position Y in the state where the detection sensitivity of the photo sensor 214 (215 or 216) is set to be the second sensitivity.

As the result of this determination, when the bright state is established at the position Y−1 that is one step before the identified switching position Y and the dark state is established at the position Y+1 that is one step after the switching position Y, the control unit 401 identifies the position Y−1 at which the bright state is established as the reference position Y−1 (see FIG. 10A and FIG. 10B) and stores the information concerning the reference position Y−1 to the storage unit 401*a*. The control unit 401 stores to the storage unit 401*a* the information concerning the phase of the motor 304 at the reference position Y−1. The control unit 401 may further store to the storage unit 401*a* the information concerning the phase of the motor 304 at the position Y+1.

The information concerning the reference position Y−1 may be realized by information enabling identification of the position of the hand wheel 301 at the time point at which the bright state is determined for the first time in a case where the bright state is consecutively determined twice and the dark state is thereafter consecutively determined twice. The information concerning the phase may be realized by the information indicating the orientation to output the pulse of the motor 304 (the orientation of the generated magnetic field) at the time points for the reference position Y−1 and the position Y+1 (see FIG. 10A and FIG. 10B). The phase of the motor 304 at the reference position Y−1 and the phase of the motor 304 at the position Y+1 are the same phase.

When the control unit 401 identifies the switching position Y and thereafter positions the hand wheel 301 at the reference position Y−1, for example, the control unit 401 rotates forward the motor 304 at a speed higher than that used during normal movement of the hands, fast-forwards the hand wheel 301, and thereby positions the hand wheel 301 at the reference position Y−1.

Alternatively, at this time, for example, the control unit 401 may rotate backward the motor 304, may rotate the hand wheel 301 in the direction opposite to that taken during normal movement of the hands, and thereby may position the hand wheel 301 at the reference position Y−1. When the control unit 401 rotates backward the motor 304 and rotates the hand wheel 301 in the direction opposite to that taken during normal movement of the hands, the control unit 401 rotates backward the motor 304 by an amount greater than that to reach the position Y−1 that is one step before the switching position Y (for example, Y−5 steps) and thereafter rotates forward the motor 304 to the reference position Y−1 taking into consideration the backlash.

When the control unit 401 succeeds in the storing of the information concerning the reference position Y−1, that is, when the reference position setting operation is successfully executed, the control unit 401 may change the date displayed by the date indicator wheel to a date that is advanced from the date of the time point at which the predetermined input operation is received by driving and controlling the motor 304 to rotate the date indicator driving wheel. When the control unit 401 fails in the storing of the information concerning the reference position Y−1, that is, when the reference position setting operation has failed, the control unit 401 may change the date displayed by the date indicator wheel to a date that is before the date of the time point at which the predetermined input operation is received by driving and controlling the motor 304 to rotate the date indicator driving wheel.

The manufacturer of the timepiece may thereby determine whether the setting of the reference position setting operation is successfully executed even when the reference position setting operation is executed in the state where the driving mechanism (the movement) 209 is assembled before the completion of the assembling of the radio-controlled timepiece 100, that is, for example, in the state where the time pointing hands 106 are not attached to the hand wheels 301.

Figure 11A:
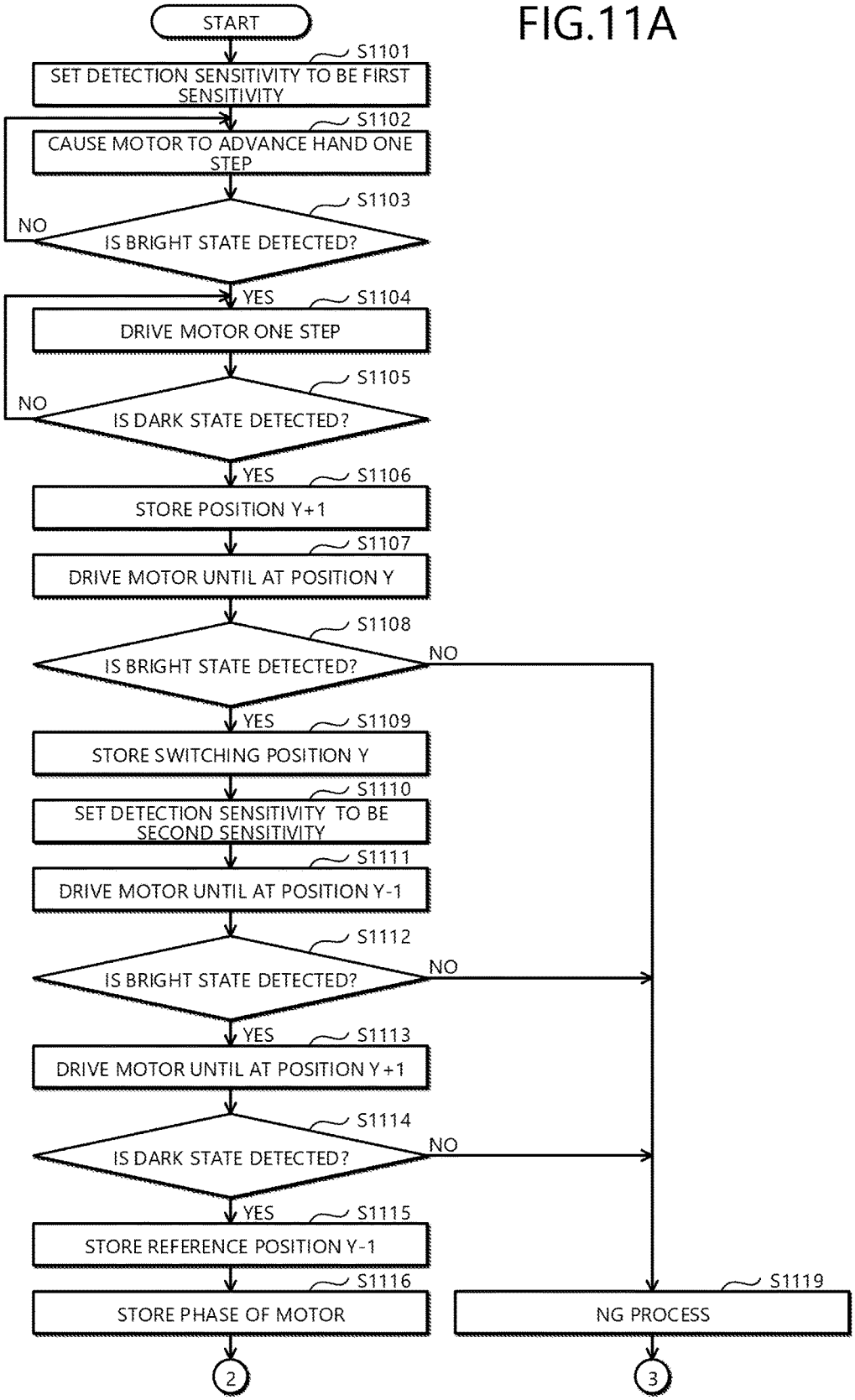
FIG. 11A is a flowchart (part 1) of a process procedure for a reference position setting operation executed by the radio-controlled timepiece 100 of the third embodiment according to the present invention.

A process procedure will be described for the reference position setting operation executed by the radio-controlled timepiece 100 of the third embodiment according to the present invention. FIG. 11A and FIG. 11B are flowcharts of the process procedure for a reference position setting operation executed by the radio-controlled timepiece 100 of the third embodiment according to the present invention. The process depicted in FIG. 11A and FIG. 11B is executed when the predetermined input operation executed for the operation unit 104 is received, similar to the process depicted in the flowcharts of FIG. 7 and FIG. 9.

Similar to the first embodiment, in FIG. 11A and FIG. 11B, the process procedure for the reference position setting operation for the hand wheel 301 corresponding to the hour hand 106*a* corresponding to the photo sensor 214 will be described with reference to FIG. 11A and FIG. 11B while the reference position may be set by executing the same process as that for the hour hand 106*a* also for each of the minute hand 106*b* corresponding to the photo sensor 215 and the second hand 106*c* corresponding to the photo sensor 216.

In the flowchart of FIG. 11A and FIG. 11B, the detection sensitivity of the photo sensor 214 is set to be the first sensitivity (step S1101) and the motor 304 is caused to advance the hand by one step (step S1102). The motor 304 is driven by one step at step S1102 and the hand wheel 301 is thereby rotated (turned) by one step.

In the state where the detection sensitivity of the photo sensor 214 is set to be the first sensitivity, it is determined whether the bright state is detected based on an output value of the photo sensor (the light receiving element 214*b*) at the position reached by rotating (turning) the hand wheel 301 by one step (step S1103). If it is determined at step S1103 that the bright state is not detected (step S1103: NO), the procedure moves to step S1102 to cause the motor 304 to advance the hand by one step.

On the other hand, if it is determined at step S1103 that the bright state is detected (step S1103: YES), the motor 304 is driven by one step (step S1104). The hand wheel 301 is rotated (turned) by one step by the driving of the motor 304 by one step at step S1104. It is determined whether the dark state is detected based on the output value of the photo sensor 214 (the light receiving element 214*b*) at the position reached by rotating (turning) the hand wheel 301 by one step (step S1105). If it is determined at step S1105 that the dark state is not detected (step S1105: NO), the procedure moves to step S1104 to further drive the motor 304 by one step.

If it is determined at step S1105 that the dark state is detected (step S1105: YES), the position at which the dark state is detected is set to be the position Y+1 and the information concerning the position Y+1 is stored to the ROM 203*b* or the like (step S1106). The motor 304 is driven until the hand wheel 301 is positioned at the position Y (step S1107). At step S1107, for example, as above, the control unit 401 rotates forward the motor 304 at a speed higher than that used during normal movement of the hands, fast-forwards the hand wheel 301, and thereby positions the hand wheel 301 at the position Y. Alternatively, at step S1107, for example, the control unit 401 may position the hand wheel 301 at the position Y by rotating backward the motor 304 by three or more steps and thereafter rotating forward the motor 304.

It is determined whether the bright state is detected based on the output value of the photo sensor 214 (the light receiving element 214*b*) in the state where the hand wheel 301 is positioned at the position Y (step S1108). If it is determined at step S1108 that the bright state is not detected (step S1108: NO), the procedure advances to step S1119. On the other hand, if it is determined at step S1108 that the bright state is detected (step S1108: YES), the position at which the bright state is detected is set to be the switching position Y and the information concerning the switching position Y is stored to the ROM 203*b* or the like (step S1109).

The detection sensitivity of the photo sensor 214 is set to be the second sensitivity (step S1110) and the motor 304 is driven until the hand wheel 301 is positioned at the position Y−1 that is one step before the switching position Y (step S1111). At step S1111, for example, as above, the motor 304 is rotated forward at a speed higher than that used during normal movement of the hands to fast-forward the hand wheel 301 and the hand wheel 301 is thereby positioned at the position Y−1. Alternatively, at step S1111, for example, the hand wheel 301 may be positioned at the position Y−1 by rotating backward the motor 304 by three or more steps and the motor 304 is thereafter rotated forward.

It is determined whether the bright state is detected based on the output value of the photo sensor 214 (the light receiving element 214*b*) in the state where the hand wheel 301 is positioned at the position Y−1 (step S1112). If it is determined at step S1112 that the bright state is not detected (step S1112: NO), the procedure advances to step S1119.

On the other hand, if it is determined at step S1112 that the bright state is detected (step S11112: YES), the motor 304 is driven until the hand wheel 301 is positioned at the position Y+1 (step S1113). At step S1113, for example, as above, the motor 304 is rotated forward by two steps at a speed higher than that used during normal movement of the hands to fast-forward the hand wheel 301 and the hand wheel 301 is thereby positioned at the position Y+1. Alternatively, at step S1113, for example, the hand wheel 301 may be positioned at the position Y+1 by rotating forward the motor 304 by two steps at the speed equal to that used during normal movement of the hands.

It is determined whether the dark state is detected based on the output value of the photo sensor 214 (the light receiving element 214*b*) in the state where the hand wheel 301 is positioned at the position Y+1 (step S1114). If it is determined at step S1114 that the dark state is not detected (step S1114: NO), the procedure advances to step S1119.

On the other hand, if it is determined at step S1114 that the dark state is detected at the position Y+1 (step S1114: YES), the position at which the bright state is detected at "step S1112: YES" is set to be the reference position Y−1 and the information concerning the reference position Y−1 is stored in the ROM 203*b* or the like (step S1115). The information concerning the time point at which the bright state is detected at "step S1112: YES", that is, the phase of the motor 304 in the state where the hand wheel 301 is positioned at the reference position Y−1, is stored in the ROM 203 or the like (step S1116).

The detection sensitivity of the photo sensor 214 used during normal movement of the hands is set (step S1117). At step S1117, the detection sensitivity of the photo sensor 214 used during normal movement of the hands is set to be the third sensitivity that is in a range higher than the second sensitivity of the photo sensor 214 and lower than the first sensitivity of the photo sensor 214. The "OK process" similar to that above is thereafter executed (step S1118) and the series of process steps comes to an end. At step S1119, the "NG process" similar to the above is executed (step S1119) and the series of process steps comes to an end.

As described, according to the radio-controlled timepiece of the third embodiment, the position of the time pointing hand 106 instructed by the hand wheel 301 may be detected reliably during normal movement of the hands by detecting the position at which the bright state is switched to the dark state.

Configuration will be described of a radio-controlled timepiece of a fourth embodiment that realizes the timepiece according to the present invention. In the fourth embodiment, portions identical to those of the first to third embodiments will be given the same reference numerals used in the first to third embodiments and will not again be described.

In the first to third embodiments, examples have been described where the first sensitivity, the second sensitivity, and the third sensitivity take fixed values. The performance is dispersed in practice of each of the light emitting element (LED) and the light receiving element (the photo transistor) of the photo sensor used in the setting of the reference position in each of the radio-controlled timepieces, and no intended precision may therefore be matched with when the fixed values are set to be the first sensitivity, the second sensitivity, and the third sensitivity.

Consequently, in the fourth embodiment, a "fourth sensitivity" is set that is the lowest critical sensitivity capable of the detection in each of the radio-controlled timepieces, and the first sensitivity, the second sensitivity, and the third sensitivity may be set relatively based on the fourth sensitivity. The differences in the performance of the photo sensor may thereby be coped with and the reference position can precisely be set.

FIG. 12 is an explanatory diagram of the concept of the setting of the sensitivity. As depicted in FIG. 12, the fourth sensitivity is set at a detection level that is higher by one level than the detection level at which each of the photo sensors corresponding to the hand wheels cannot detect the bright state. The first sensitivity, the second sensitivity, and the third sensitivity are each set to be the detection level at which the sensitivity is higher than the fourth sensitivity. The setting is executed such that the second sensitivity matches with the detection level for the sensitivity higher than the fourth sensitivity, the third sensitivity matches with the detection level for the sensitivity higher than the second sensitivity, and the first sensitivity matches with the detection level for the sensitivity higher than the third sensitivity.

The radio-controlled timepiece 100 of the fourth embodiment according to the present invention can have a hand detection adjustment mode set therein to adjust the input current to guarantee the LED luminosity in a specific range with which the reference position of the hand wheel 301 to be detected may be detected, aiming at reducing differences in the detection precision originated from differences in the output (the luminosity of the LED) with respect to the input current of the light emitting element (LED) 214*a* in the photo sensor 214. The hand detection adjustment mode may be set at, for example, an assembly step of the driving mechanism 209 or an after-sales service step.

In the hand detection adjustment mode, the detection sensitivity is adjusted for each of the photo sensors 215 and 216 concerning for the detection of the hand wheel 301 corresponding to the second hand 106*c* and the hand wheel 301 corresponding to the minute hand 106*b*, and the detection sensitivity is adjusted for the photo sensor 214 concerning the detection of the hand wheel 301 corresponding to the hour hand 106*a*.

For the hand wheels 301 corresponding to the second hand 106*c* and the minute hand 106*b*, the detection phase is determined using a method identical to the method described in each of the first to the third embodiments, and the detection sensitivity is adjusted for each of the photo sensors 215 and 216 of the second hand 106*c* and the minute hand 106*b*. For example, the radio-controlled timepiece 100 of the fourth embodiment executes the following procedure of (1) to (5) for the detection sensitivity adjustment of the photo sensors 215 and 216 of the second hand 106*c* and the minute hand 105*b*.

(1) The detection positions of the hand wheels 301 are detected by moving the second hand 106*c* and the minute hand 106*b* that are the hands to be detected (or rotating the hand wheels 301 that correspond to the second hand 106*c* and the minute hand 106*b*) by driving the motor 104. The detection positions are set to be the positions of the hand wheels 301 at which the photo sensors 215 and 216 corresponding to the hand wheels 301 corresponding to the second hand 106*c* and the minute hand 106*b* can each detect the bright state.

(2) The detection levels (the LED luminosity of the photo sensors) of the photo sensors 215 and 216 are reduced causing the hands to be reciprocated in the vicinity of the detection positions, and the detection levels are sought at which the photo sensors 215 and 216 cannot detect any bright state. For example, the detection level may be reduced stepwise. The detection level "the fourth sensitivity" is set that is higher by one level than the detection level at which the photo sensors 215 and 216 corresponding to the hand wheels 301 cannot detect any bright state.

(3) Based on the result of (2), a high detection level "the first sensitivity" is set to be the detection level of each of the photo sensors 215 and 216 by adjusting the LED luminosity and the detection resistance of each of the photo sensors 215 and 216. The first sensitivity may be set to be at the LED luminosity (the maximal luminosity) to the extent that the photo sensors 215 and 216 do not errantly detect the detection positions of the hand wheel 301 corresponding to the second hand 106*c* and the hand wheel 301 corresponding to the minute hand 106*b*.

(4) It is confirmed that the any position other than the reference position is not detected with the first sensitivity and, concurrently, the positions to establish "the dark state" to "the dark state" to "the bright state" to "the bright state" are detected and, the position at which the "bright state" is detected for the second time based on the detection result is set to be the reference position of the hand wheels 301 corresponding to the second hand 106*c* and the minute hand 106*b* (see the upper row in FIG. 13).

(5) The detection level "the second sensitivity" is set for which the sensitivity is lower than the first sensitivity, and it is confirmed that the reference positions of the hand wheels 301 corresponding to the second hand 106*c* and the minute hand 106*b* may be detected with the second sensitivity (see the lower row in FIG. 13). The second sensitivity may be set to be the luminosity (the minimal luminosity) that is higher than the "fourth sensitivity" with which the LED luminosity of each of the photo sensors 215 and 216 of the second hand 106*c* and the minute hand 106*b* may detect the detection positions of the hand wheels corresponding to the second hand 106*c* and the minute hand 106*b*.

FIG. 13 is an explanatory diagram of the concept of the execution content of the procedure at (4) and (5) of the procedure for the detection sensitivity adjustment of the photo sensors of the second hand 106*c* and the minute hand 106*b*. As depicted in FIG. 13, in the procedure of (4), in the state where the first sensitivity is set, it is detected whether the dark state or the bright state is established at each of the positions of all the steps of one to four, and the positions are detected at which "the dark state" to "the dark state" to "the bright state" to "the bright state" are established. The position of the four steps at which "the bright state" is detected for the second time is set to be the reference position.

As depicted in FIG. 13, in the procedure of (5), in the state where the second sensitivity is set, it is detected whether the dark state or the bright state is established at each of the positions of the two steps and the four steps. It is checked that the dark state is detected at the position of the two steps and the bright state is detected at the position of the four steps. In the procedure of (5), in the state where the second sensitivity is set, the detection may be executed as to whether the bright state or the dark state is established at the positions of all the steps of one to four.

The hand wheel corresponding to the hour hand 106*a* is driven associated with the minute hand 106*b* and is therefore configured to have a rotation number that is lower than that of the hand wheel 301 of the minute hand 106*b*, and the number of steps to detect the bright state is therefore greater than the number of steps for the photo sensor 215 of the minute hand 106*b* to detect the detection position.

In the radio-controlled timepiece 100 of the fourth embodiment, therefore, the reference position of the hand wheel corresponding to the hour hand 106*a* is identified using a method different from the method of identifying the reference positions of the hand wheels corresponding to the second hand 106*c* and the minute hand 106*b* and, based on the identified reference position, the reference position setting operation concerning the hour hand 106*a* and the detection sensitivity adjustment in the hand detection adjustment mode are executed. When the number of rotations of the hour hand 106*a* is equal to that of the minute hand 106*b*, the reference position of the hour hand 106*a* is identified using the method of identifying the reference positions of the hand wheels corresponding to the second hand 106*c* and the minute hand 106*b* and the detection sensitivity adjustment can thereby be executed.

Figure 14:
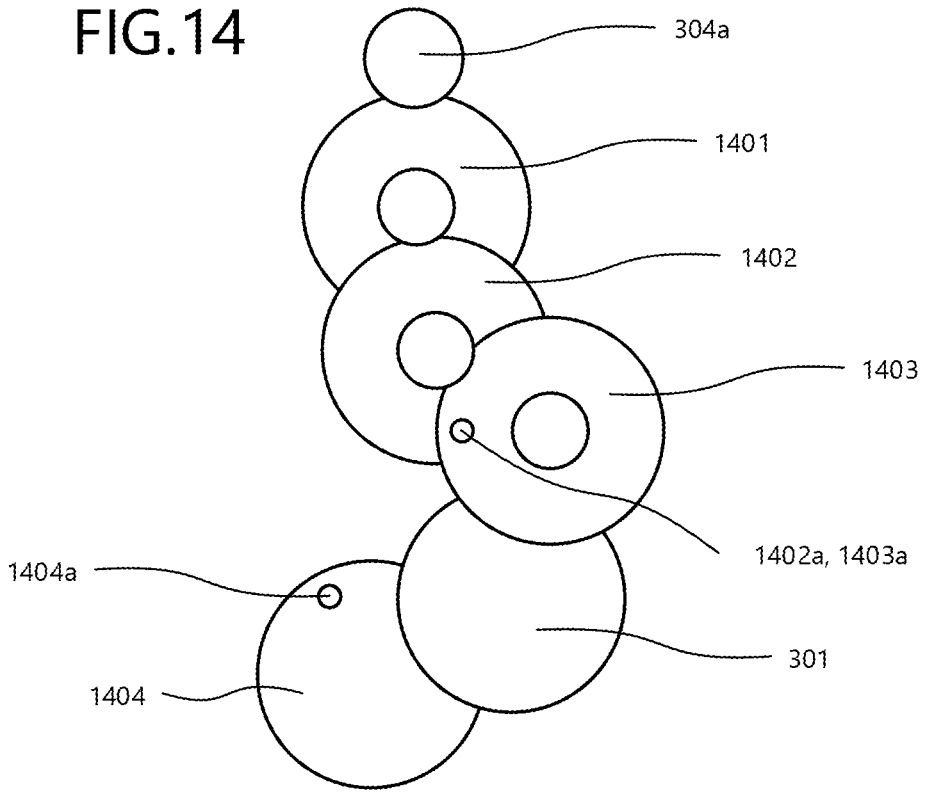
FIG. 14 is an explanatory diagram of a configuration of a reference position setting mechanism included in the radio-controlled timepiece 100 of a fourth embodiment according to the present invention.

FIG. 14 is an explanatory diagram of the configuration of the reference position setting mechanism included in the radio-controlled timepiece 100 of the fourth embodiment according to the present invention. In FIG. 14, the rotor 304*a* is coupled with a minute wheel 1404 through an intermediate wheel 1401, an intermediate wheel 1402, an intermediate wheel 1403, and the hand wheel supporting the minute hand 106*b* (a minute hand wheel) 301.

The intermediate wheel 1402 and the intermediate gear 1403 respectively have detection holes 1402*a* and 1403*a* disposed therein. The detection hole 1402*a* disposed in the intermediate wheel 1402 and the detection hole 1403*a* disposed in the intermediate wheel 1403 are disposed to respectively penetrate the intermediate wheel 1402 and the intermediate wheel 1403 each in the axial direction thereof.

The detection hole 1402*a* disposed in the intermediate wheel 1402 and the detection hole 1403*a* disposed in the intermediate wheel 1403 are disposed such that the orbits of the detection holes 1402*a* and 1403*a* formed by the rotations of the intermediate wheel 1402 and the intermediate wheel 1403 intersect each other at the position at which the intermediate wheel 1402 and the intermediate wheel 1403 overlap each other. The number of rotations of each of the intermediate wheel 1402 and the intermediate wheel 1403 is set such that the detection holes 1402*a* and 1403*a* overlap each other once, each time the motor 304 is driven by 360 steps.

The photo sensor 215 detects whether the bright state or the dark state is established at the position at which the orbits of the detection holes 1402*a* and 1403*a* intersect each other. In the embodiment, the detection wheels according to the present invention may be realized by the intermediate wheel 1402 and the intermediate wheel 1403. The radio-controlled timepiece 100 of the fourth embodiment detects the position of the hand wheel 301 at the position at which the detection holes 1402*a* and 1403*a* overlap each other, as the reference position of the hand wheel 301. The reference position of the hand wheel 301 may be detected once each time the motor 304 is driven by 360 steps.

The hand wheel 301 has a cannon pinion not depicted that rotates around the same axis as that of the hand wheel 301. The cannon pinion is coupled with the minute wheel 1404 and the minute wheel 1404 is coupled with the hand wheel (not depicted) of the hour hand 106*a*. The rotational force of the rotor 304*a* of the motor (a minute-hour coupled motor) 304 may thereby be transmitted to the hand wheel of the hour hand 106*a* through the hand wheel 301 of the minute hand 106*b*, and the minute hand 106*b* and the hour hand 106*a* may be rotated by the one motor (the minute-hour coupled motor) 304.

The minute wheel 1404 is coupled with the hour hand 106*a* and rotates the hand wheel of the hour hand 106*a* at the number of rotations lower than the number of rotations of the hand wheel 301 of the minute hand 106*b*. The minute wheel 1404 regulates such that the hour wheel rotates by one rotation during 12 rotations of the hand wheel 301 of the minute hand 106*b*. In the fourth embodiment, the other hand wheel of the embodiment according to the present invention may be realized by the hand wheel of the hour hand 106*a*. In the fourth embodiment, the other detection wheel of the embodiment according to the present invention may be realized by the minute wheel 1404.

The minute wheel 1404 includes a detection hole 1404*a* that penetrates the minute wheel 1404 in the axial direction of the minute wheel 1404. The minute wheel 1404 is disposed such that the orbit of the detection hole 1404*a* disposed in the minute wheel 1404 is positioned at a position different from the position at which the detection holes 1402*a* and 1403*a* disposed in the intermediate wheel 1402 and the intermediate wheel 1403 intersect each other. In the fourth embodiment, the other detection hole may be realized by the detection hole 1404*a*.

The photo sensor 214 includes a light emitting element that emits light to a detection position (the position at which the photo sensor 216 detects the bright state) on the orbit of the move of the detection hole 1404*a* associated with the rotation of the minute wheel 1404, and a light receiving element that receives the light emitted by the light emitting element, and detects the rotation of the minute wheel 1404. In the fourth embodiment, the other photo sensor of the embodiment according to the present invention may be realized by the photo sensor 214.

In the embodiment, the minute wheel 1404 rotates by one rotation the hand wheel of the hour hand 106*a* every time the minute wheel 1404 rotates by seven rotations. In the fourth embodiment, the number of rotations of the minute wheel 1404 is such that the photo sensor of the minute wheel 1404 receives once the light passing through the detection hole 1404*a* (detects the bright state), each time the motor 304 is driven by 617 steps (strictly, 4,320/7 steps).

In the configuration depicted in FIG. 14, the detection hole 1404*a* disposed in the minute wheel 1404 does not execute any detection at the position that intersects the hand wheel 301 and executes alone the detection. The detection hole 1403*a* disposed in the intermediate wheel 1403 and the detection hole 1402*a* disposed in the intermediate wheel 1402 overlap each other every one hour. When the detection of the detection hole 1404*a* is executed at the timing at which the detection holes 1403*a* and 1402*a* overlap each other, the detection hole 1404*a* may be detected only once in 12 hours. The position of the hour hand 106*a* can thereby be identified.

The detection hole 1404*a* does not need to fully overlap the detection holes 1402*a* and 1403*a* at the timing at which the detection holes 1403*a* and 1402*a* overlap each other. For example, a condition that "the detection hole 1404*a* is detected predetermined number of steps (for example, 50 steps) after the overlapping of the detection holes 1403*a* and 1402*a* with each other" may be set and the detection may be executed complying with this condition.

In the fourth embodiment, the hand wheel according to the present invention may be realized by the hand wheel 301 of the minute hand 106*b* (the second hand 106*c*), the detection wheels according to the present invention may be realized by the two minute intermediate wheels 1402 and 1403, and the photo sensors according to the present invention may be realized by the photo sensors 215 and 216. In the fourth embodiment, the other hand wheel according to the present invention may be realized by the hour wheel, the other detection wheel according to the present invention may be realized by the minute wheel 1404, the other detection hole according to the present invention may be realized by the detection hole 1404*a*, and the other photo sensor according to the present invention may be realized by the photo sensor 214.

The number of rotations of the minute wheel 1404 is lower than the number of rotations of the hand wheel 301 of the minute hand 106*b* (the second hand 106*c*) and the photo sensor 214 therefore detects the bright state during the driving of the motor 304 by plural steps. In the radio-controlled timepiece 100 of the fourth embodiment, the photo sensor 214 is driven at every one step from the reference position of the minute hand 106*b*, the position corresponding to the number of steps that is ½ of the number of steps from the start of the detection of the bright state of "the dark state" to "the bright state" to "the dark state" to the position one step before the detection of the next dark state is set to be the reference position of the minute wheel 1404, and the position of the minute wheel 1404 is controlled based on the reference position. In the radio-controlled timepiece 100 of the fourth embodiment, the hand wheel 301 of the minute hand 106*b* (the second hand 106*c*) and the minute wheel 1404 are adjusted such that the reference position of the minute wheel 1404 is detected a predetermined number of steps after the detection of the reference position of the hand wheel 301 of the minute hand 106*b* (the second hand 106*c*) once during one rotation of the hour wheel. In this case, the reference position of the minute wheel 1404 may be a position other than the position corresponding to the number of steps that is ½ of the number of steps to the position one step before the first detection of the dark state only when the reference position is the position at which the photo sensor 214 can detect the bright state.

The detection sensitivity adjustment concerning the detection of the minute wheel 1404 will be described. The adjustment of the detection sensitivity concerning the detection of the minute wheel 1404 is realized by executing the following procedure of (1) to (6).

(1) The motor 304 is driven to rotate the minute wheel 1404 and the detection position of the minute wheel 1404 is detected. When the detection position of the minute wheel 1404 cannot be detected in the case where the motor 304 is driven by the number of steps (for example, 617 steps) necessary for the minute wheel 1404 to rotate by one rotation, the motor 304 is rotated backward by (the number of steps from the current position of the minute wheel 1404 to the reference position of the minute hand 106*b*)+(the number of steps by the amount corresponding to the backlash), the detection sensitivity is increased at the position reached by the backward rotation, and the detection position of the minute wheel 1404 is again detected.

(2) The number of steps are counted from the position at which the detection position of the minute wheel 1404 starts to be detectable to the position at which the detection comes to an end, and the intermediate position of the number of the counted steps is set to be the reference position of the minute wheel 1404. The position corresponding to the number of steps that is ½ of the number of steps from the reference position of the minute hand 106*b* at which the photo sensor 214 starts to detect the bright state to the position one step before the position at which the photo sensor 214 detects the dark state for the first time is set to be the reference position of the minute wheel 1404. When the photo sensor 214 already detects the bright state at the minute hand reference position, "the dark state" to "the bright state" to "the dark state" about 617 steps thereafter are detected and the reference position of the minute wheel 1404 is set.

Figure 15:
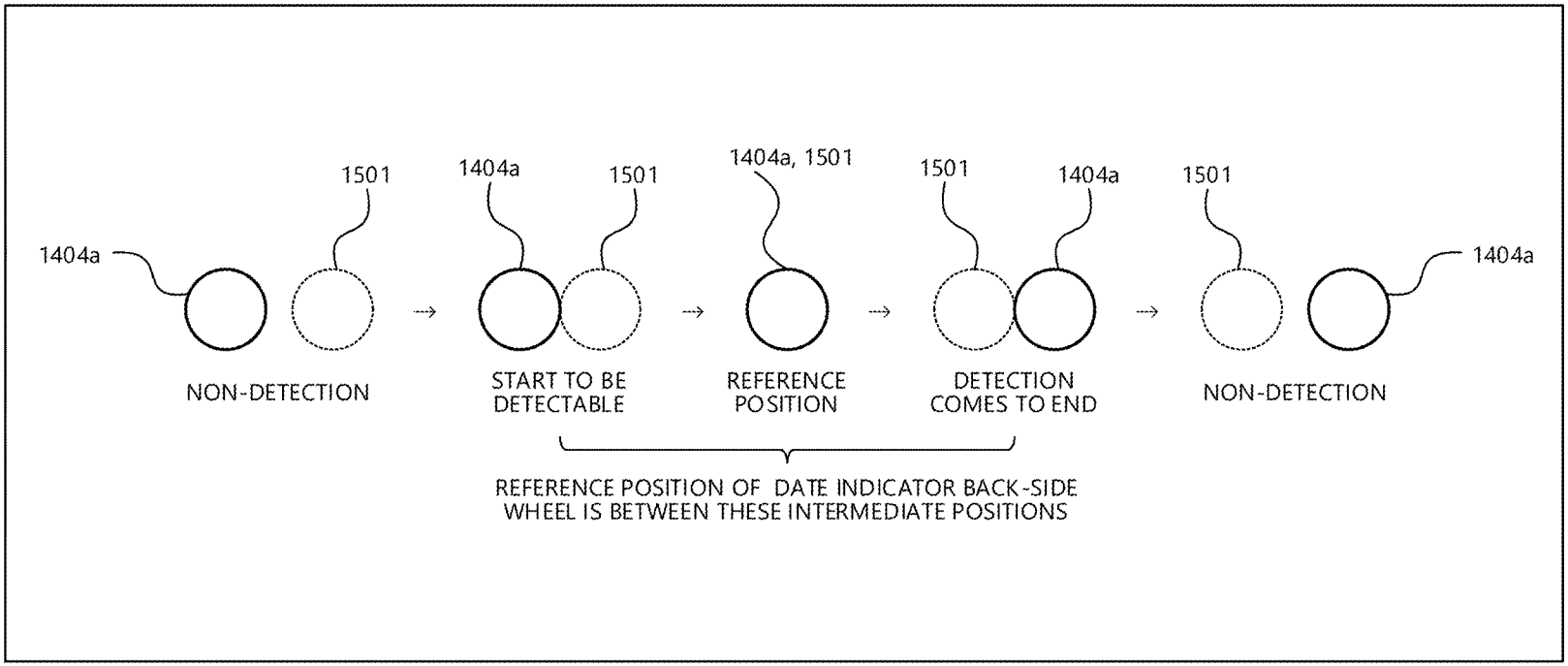
FIG. 15 is an explanatory diagram of a change in positional relation between a detection hole of a minute wheel and a detection position by the photo sensor.

FIG. 15 is an explanatory diagram of a change in the positional relation between the detection hole 1404*a* of the minute wheel 1404 and the detection position by the photo sensor 214. The photo sensor 214 applies light to the minute wheel 1404 through a hole disposed in a ground plate or the like not depicted. In FIG. 15, a reference numeral "1501" denotes a hole through which the light emitted by the photo sensor 214 is applied to the minute wheel 1404.

In FIG. 15, during "non-detection", the detection hole 1404*a* does not overlap the position of the hole 1501 that is the detection position of the photo sensor 214. During "detection started", the detection hole 1404*a* approaches the hole 1501 associated with the rotation of the minute wheel 1404, and the peripheral edge of the side approaching the hole 1501 of the detection hole 1404*a* is brought into contact with the peripheral edge of the hole 1501.

During "reference position" during which the minute wheel 1404 is positioned at the reference position, the detection hole 1404*a* and the hole 1501 fully overlap each other. The degree of the overlapping of the detection hole 1404*a* and the hole 1501 gradually decreases associated with the rotation of the minute wheel 1404 and, during "detection coming to an end", the peripheral edge on the side leaving the hole 1501 of the detection hole 1404*a* is brought into contact with the peripheral edge of the hole 1501. The detection hole 1404*a* thereafter moves again to the position at which the detection hole 1404*a* does not overlap the position of the hole 1501.

In the procedure of (2) of the detection sensitivity adjustment concerning the detection of the minute wheel 1404, the number of steps are counted from the position of "detection able to be started" to the position of "detection coming to an end" in FIG. 15. The position corresponding to the number of steps that is ½ of the number of counted steps is set to be the reference position of the minute wheel 1404.

(3) At the reference position of the minute wheel 1404, the detection level of the photo sensor 214 is reduced and the "fourth sensitivity" is set that is a detection level higher by one level than the detection level with which the bright state of the detection hole 1404*a* of the minute wheel 1404 cannot be detected.

(4) A high sensitivity level "first sensitivity", a low sensitivity level "second sensitivity", and the detection level of the photo sensor 214 during normal movement of the hands "third sensitivity" are set by adjusting the LED luminosity and the detection resistance of the photo sensor 214 based on the result of (3). In this case, the first sensitivity is set to be the LED luminosity (the maximal luminosity) of the extent that the photo sensor 214 does not errantly detect the detection position of the minute wheel 1404, the second sensitivity is set to be the LED luminosity (the lowest luminosity) that is higher than the "fourth sensitivity" with which the photo sensor 214 may detect the detection position of the minute wheel 1404, and the third sensitivity is set to be the sensitivity that is between the first sensitivity and the second sensitivity set as above.

(5) It is confirmed that no detection occurs with the first sensitivity at the positions of 360/7 steps, (360/7)×2 steps, . . . , and (360/7)×11 steps from the reference position of the minute wheel 1404.

(6) The third sensitivity for normal movement of the hands is set, and the motor 304 is rotated backward by a predetermined number of steps (for example, 40 steps) and is rotated forward from the position reached by the backward rotation.

The number of steps is counted from the reference position of the hand wheel 301 of the minute hand 106*b* (the second hand 106*c*) to the position at which the detection hole 1404*a* may be detected with the third sensitivity, the number of counted steps is represented by $X_2$ steps, the number of steps is counted that is necessary from the start of the detection of the detection hole 1404 with the third sensitivity to the non-detection thereof, the value that is ½ of the number of counted steps is represented by $X_3$ steps, and the information concerning $X_2+X_3$ is stored in the ROM 203*b* or the like. The position $X_2+X_3$ steps after the reference position of the hand wheel 301 of the minute hand 106*b* (the second hand 106*c*) is the reference position of the minute wheel 1404. The ROM 203*b* may be realized by, for example, a metal-oxide-nitride-oxide-silicon (MONOS).

At (6), the number of steps to rotate backward the motor 304 after setting the third sensitivity is the number of steps necessary for returning the minute wheel 1404 positioned at the reference position from the reference position to the position at which the minute wheel 1404 may be detected (the position for starting the detection of the minute wheel 1404), and may be set to be, for example, the number of steps obtained by adding the number of steps for taking into consideration the backlash to the number of steps necessary for returning the minute wheel 1404 positioned at the reference position to the position for starting the detection.

The radio-controlled timepiece 100 of the fourth embodiment stores therein the phase of the motor 304 necessary from the detection that the detection holes 1402*a* and 1403*a* overlap each other once every 12 hours to the detection of the detection hole 1404*a* of the minute wheel 1404 the predetermined number of steps thereafter. The phase of the motor 304 is stored in, for example, the ROM 203*b*. The radio-controlled timepiece 100 detects that the detection holes 1402*a* and 1403*a* overlap each other once every 12 hours based on the stored phase of the motor 304 and the predetermined number of steps thereafter, executes the hand position detection for the motor 304 based on the result of the detection of the presence or the absence of the detection hole 1404*a* of the minute wheel 1404.

When the detection of the hand position is normally executed, the number of steps by which the motor 304 is driven from the detection of the overlapping of the detection holes 1402*a* and 1403*a* to the detection of the detection hole 1404*a* of the minute wheel 1404 may be set to be $(X_2+X_3)$. "$X_2$" is the number of steps by which the motor 304 is driven from the detection of the reference position of the hand wheel 301 of the minute hand to the start of the detection of the light of the light emitting element by the photo sensor 214 of the minute wheel 1404. "$X_3$" is the number of steps by which the motor 304 is driven from the start of the detection of the detection hole 1404*a* by the photo sensor 214 of the minute wheel 1404 to the detection of the reference position of the minute wheel 1404. The numbers of steps $X_2$ and $X_3$ are determined based on the phases of the motor 304 stored in the ROM 203*b*.

On the other hand, when the detection of the hand position has failed, the radio-controlled timepiece 100 repeats the detection of the hand position until the repeated detection of the hand positions of the minute hand and the hour hand is successfully executed. The detection of the hand positions of the minute hand and the second hand executed again when the detection has failed is different corresponding to the number of steps by which the motor 304 is driven from the detection of the reference position of the hand wheel 301 of the minute hand (the position at which the detection holes 1402*a* and 1403*a* overlap each other) to the positioning of the minute wheel 1404 at the reference position (the position at which the detection hole 1404*a* is detected), and the number of steps necessary for the hand wheel 301 of the minute hand to rotate by one rotation.

For example, the detection differs in $(X_2+X_3)$ that is the number of steps by which the motor 304 is driven from the detection of the reference position of the hand wheel 301 of the minute hand to the positioning of the minute wheel 1404 at the reference position, between the case of $(X_2+X_3)<360$ and the case of $(X_2+X_3)\geq 360$. "360" represents the number of steps for the detection holes 1402*a* and 1403*a* to overlap once.

Figure 16A:
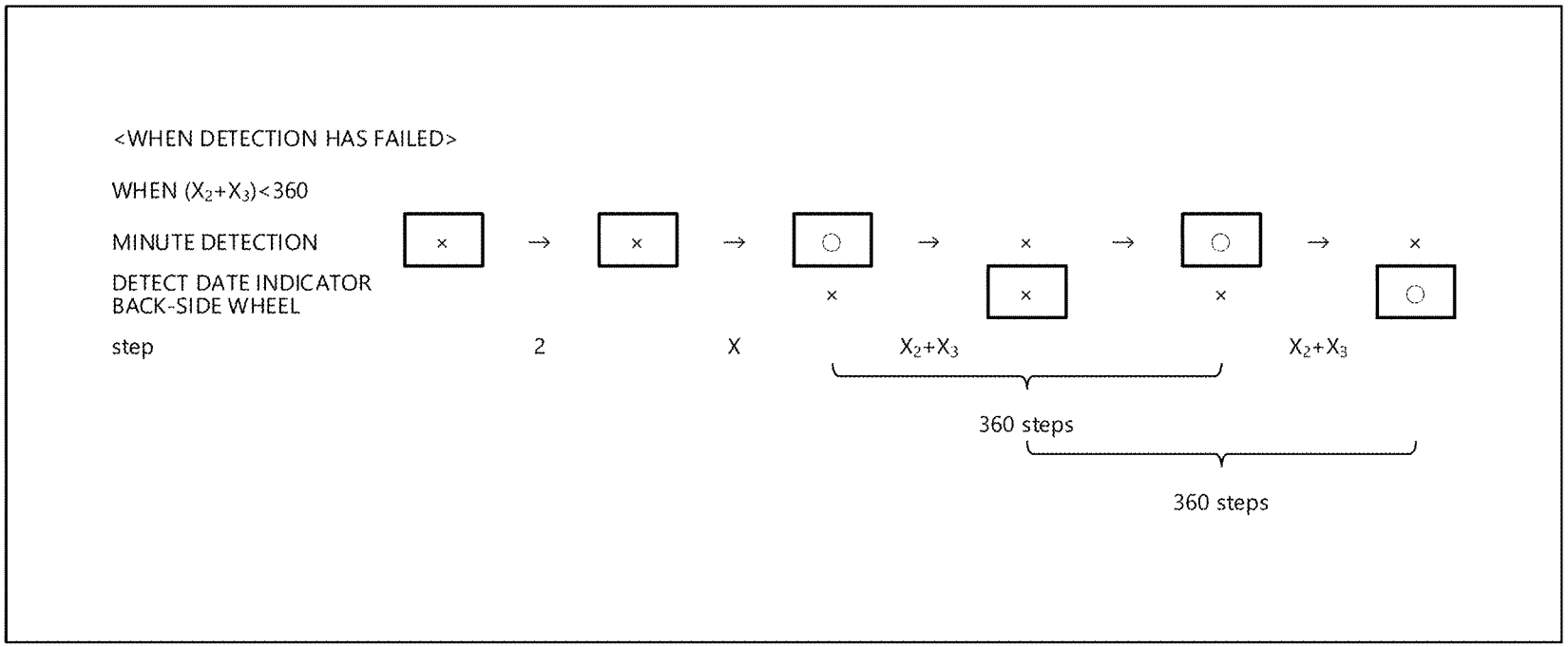
FIG. 16A is an explanatory diagram of a principle for a hand position detection for the minute hand and the second hand executed again when detection has failed in a case where $(X_2+X_3)<360$.

FIG. 16A is an explanatory diagram of the principle for the hand position detection for the minute hand and the second hand executed again when the detection has failed in the case where $(X_2+X_3)<360$. In FIG. 16A, the symbol "x" indicates that the detection hole (the overlapping of the detection holes 1402*a* and 1403*a* with each other, or the detection hole 1404*a*) to be detected is not detected, the symbol "○" indicates that the detection hole is detected. In FIG. 16A, the square frame surrounding each of the symbols "x" and "o" indicates the timing to cause the light emitting element of each of the photo sensors 214 and 215 to emit light that corresponds to the hand wheels to be detected (the hand wheel 301 of the minute hand 106*b* and the minute wheel 1404).

In FIG. 16A, when the timing for the photo sensor 215 of the hand wheel 301 of the minute hand to detect that the detection holes 1402*a* and 1403*a* overlap is shifted by X steps relative to the reference position of the hand wheel 301 of the minute hand, the photo sensor 214 of the minute wheel 1404 does not detect the detection hole 1404*a* for $(X_2+X_3)$ steps after the photo sensor 215 of the hand wheel 301 of the minute hand detects that the detection holes 1402*a* and 1403*a* overlap each other. The detection has therefore failed.

When the detection has failed in the case where $(X_2+X_3)<360$, the motor 304 is driven by 360 steps from the position at which the photo sensor 215 of the hand wheel 301 of the minute hand detects that the detection holes 1402*a* and 1403*a* overlap, it is determined whether the photo sensor 214 of the minute wheel 1404 detects the detection hole 1404*a* at the position reached by driving the motor 304 by $(X_2+X_3)$ steps from the position at which the photo sensor 215 of the hand wheel 301 of the minute hand again detects that the detection holes 1402*a* and 1403*a* overlap, and the hand position detection of the minute hand and the hour hand is thereby executed again. The hand position detection of the minute hand and the hour hand executed again is repeated until this detection is successfully executed.

In the case where $(X_2+X_3)<360$, when the timing at which the photo sensor 215 of the hand wheel 301 of the minute hand detects that the detection holes 1402*a* and 1403*a* overlap is delayed by several steps (for example, X steps) relative to the reference position of the hand wheel 301 of the minute hand set in advance, the reference position of the hand wheel 301 of the minute hand may be detected at a position several steps after the reference position of the hand wheel 301 of the minute hand set in advance, and the reference position of the minute wheel 1404 may be detected in the next first detection of the minute wheel 1404.

In the case where $(X_2+X_3)<360$, when the timing at which the photo sensor 215 of the hand wheel 301 of the minute hand detects that the detection holes 1402*a* and 1403*a* overlap is advanced by several steps relative to the reference position of the hand wheel 301 of the minute hand, the reference position of the hand wheel 301 of the minute hand may be detected after passing by the reference position of the minute wheel 1404, and the reference position of the minute wheel 1404 may be detected in the later twelfth detection of the minute wheel 1404.

Figure 16B:
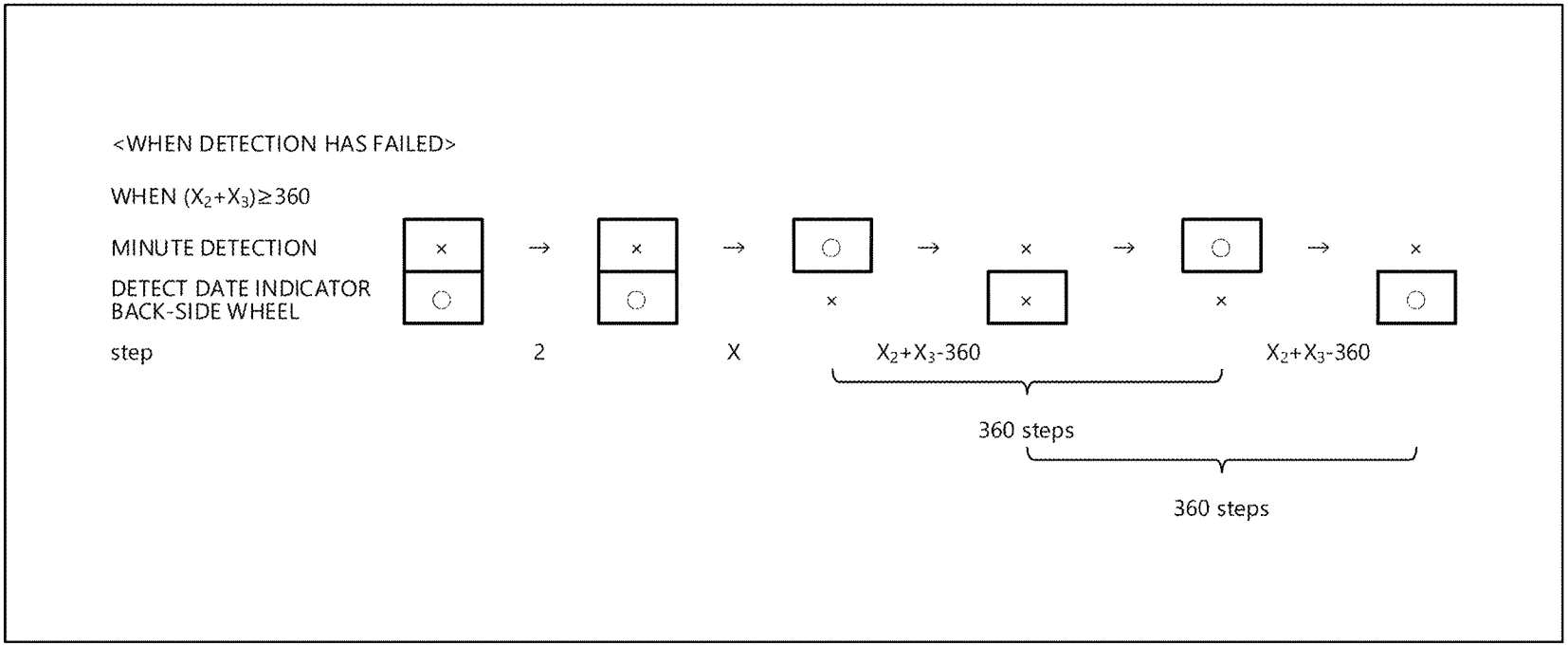
FIG. 16B is an explanatory diagram of a principle for the hand position detection of the minute hand and an hour hand executed again when the detection has failed in a case where $(X_2+X_3)\geq 360$.

FIG. 16B is an explanatory diagram of a principle for the hand position detection of the minute hand and the hour hand executed again when the detection has failed in the case where $(X_2+X_3)\geq 360$. In FIG. 16B, the symbol "x" indicates that the detection hole (the overlapping of the detection holes 1402*a* and 1403*a* with each other, or the detection hole 1404*a*) to be detected is not detected, the symbol "o" indicates that the detection hole is detected. In FIG. 16B, the square frame surrounding each of the symbols "○" and "o" indicates the timing to cause the light emitting element of each of the photo sensors 214 and 215 to emit light that corresponds to the hand wheels to be detected (the hand wheel 301 of the minute hand 106*b* and the minute wheel 1404).

As depicted in FIG. 16B, in the case where $(X_2+X_3)\geq 360$, when the timing at which the photo sensor 215 of the hand wheel 301 of the minute hand 106*b* detects that the detection holes 1402*a* and 1403*a* overlap each other is shifted by X steps relative to the reference position of the hand wheel 301 of the minute hand 106*b*, the photo sensor 214 of the minute wheel 1404 does not detect the detection hole 1404*a* for $(X_2+X_3)$ steps after the photo sensor 215 of the hand wheel 301 of the minute hand 106*b* detects that the detection holes 1402*a* and 1403*a* overlap each other. The detection is therefore failed.

In the case where $(X_2+X_3)\geq 360$, the radio-controlled timepiece 100 determines whether the photo sensor 214 of the minute wheel 1404 detects the detection hole 1404*a* at the position reached by driving the motor 304 by the number of steps $((X_2+X_3)-360)$ corresponding to the difference between $(X_2+X_3)$ steps and 360 steps from the position at which the photo sensor 215 of the hand wheel 301 of the minute hand 106*b* detects that the detection holes 1402*a* and 1403*a* overlap each other.

When the detection has failed in the case where $(X_2+X_3)\geq 360$, the motor 304 is driven by 360 steps after the photo sensor 215 of the hand wheel 301 of the minute hand 106*b* detects that the detection holes 1402*a* and 1403*a* overlap each other. The hand position detection of the minute hand and the hour hand is again executed by determining whether the photo sensor 214 of the minute wheel 1404 detects the detection hole 1404*a* at the position reached by driving the motor 304 by $((X_2+X_3)-360$ steps from the position at which the photo sensor 215 of the hand wheel 301 of the minute hand 106*b* again detects that the detection holes 1402*a* and 1403*a* overlap each other. Even in the case where $(X_2+X_3)\geq 360$, the hand position detection of the minute hand and the hour hand executed again is repeated until this detection is successfully executed.

In the case where $(X_2+X_3)\geq 360$, when the timing at which the photo sensor 215 of the hand wheel 301 of the minute hand 106*b* detects that the detection holes 1402*a* and 1403*a* overlap each other is delayed by several steps (for example, X steps) relative to the reference position of the hand wheel 301 of the minute hand 106*b* set in advance, the reference position of the hand wheel 301 of the minute hand may be detected at a position several steps after the reference position of the hand wheel 301 of the minute hand 106*b* set in advance, the detection of the detection hole 1404*a* of the minute wheel 1404 has failed in the next first detection of the minute wheel 1404, and the detection hole 1404*a* of the minute wheel 1404 may be detected in the second detection of the minute wheel 1404.

In the case where $(X_2+X_3)\geq 360$, when the timing at which the photo sensor 215 of the hand wheel 301 of the minute hand 106*b* detects that the detection holes 1402*a* and 1403*a* overlap each other is advanced by several steps relative to the reference position of the hand wheel 301 of the minute hand 106*b* set in advance, the overlapping of the detection holes 1402*a* and 1403*a* with each other of the hand wheel 301 of the minute hand 106*b* may be detected at a position several steps after the reference position of the hand wheel 301 of the minute hand 106*b* set in advance, and the detection hole 1404*a* of the minute wheel 1404 may be detected in the next first detection of the minute wheel 1404.

When $(X_2+X_3)<360$ and the timing at which the photo sensor 215 of the hand wheel 301 of the minute hand 106*b* detects that the detection holes 1402*a* and 1403*a* overlap each other is delayed relative to the reference position of the hand wheel 301 of the minute hand 106*b* set in advance, the time period to the time when the detection hole 1404*a* of the minute wheel 1404 may be detected in the hand position detection of the minute hand and the hour hand executed again is substantially equal to that of the case where the detection of the detection hole 1404*a* of the minute wheel 1404 is executed at a position $(X_2+X_3)$ steps after the reference position of the hand wheel 301 of the minute hand 106*b*.

On the other hand, in the case where $(X_2+X_3)\geq 360$ and the timing at which the photo sensor 215 of the hand wheel 301 of the minute hand 106*b* detects that the detection holes 1402*a* and 1403*a* overlap each other is advanced relative to the reference position of the hand wheel 301 of the minute hand 106*b* set in advance, when the detection of the detection hole 1404*a* of the minute wheel 1404 is executed $(X_2+X_3)$ steps after the position at which the photo sensor 215 of the hand wheel 301 of the minute hand 106*b* detects that the detection holes 1402*a* and 1403*a* overlap each other, the reference position of the minute wheel 1404 is executed in the twelfth detection of the minute wheel 1404, and a long time is necessary for the hand position detection of the minute hand and the hour hand executed again.

A process procedure will be described for the hand position detection of the minute hand and the hour hand executed by the radio-controlled timepiece 100 of the fourth embodiment according to the present invention. FIG. 17 is a flowchart of the process procedure for the hand position detection of the minute hand and the hour hand executed by the radio-controlled timepiece 100 of the fourth embodiment according to the present invention. The process described in the flowchart of FIG. 17 is executed when the predetermined input operation to the operation unit 104 is accepted.

In the flowchart of FIG. 17, it is determined whether the hand wheel (a minute hand wheel) 301 of the minute hand 106*b* is detected (step S1701). At step S1701, whether the hand wheel 301 of the minute hand 106*b* is detected is determined by determining whether the photo sensor 215 of the hand wheel 301 of the minute hand 106*b* detects the detection hole 1404*a*. If it is determined at step S1701 that the hand wheel 301 of the minute hand 106*b* is not detected (step S1701: NO), that is, if the photo sensor 215 of the hand wheel 301 of the minute hand 106*b* detects the dark state, the motor 304 is driven by one step (step S1702) and the procedure returns to step S1701. The hand wheel 301 of the minute hand 106*b* is rotated (turned) by one step by the driving of the motor 304 by one step at step S1702.

If it is determined at step S1701 that the hand wheel 301 of the minute hand 106*b* is detected (step S1701: YES), the position of the detection is set to be the reference position of the hand wheel 301 of the minute hand 106*b* and the information concerning the reference position of the hand wheel 301 of the minute hand 106*b* is stored to the ROM 203*b* or the like (step S1703). The motor 304 is driven by $(X_2+X_3)$ steps (step S1704).

It is determined whether the minute wheel 1404 is detected at the position reached by driving the motor 304 by $(X_2+X_3)$ steps from the reference position of the hand wheel 301 of the minute hand 106*b* (step S1705). At step S1705, whether the minute wheel 1404 is detected is determined by determining whether the photo sensor 214 of the minute wheel 1404 detects the detection hole 1404*a*.

If it is determined at step S1705 that the minute wheel 1404 is detected at the position reached by driving the motor 304 by $(X_2+X_3)$ steps from the reference position of the hand wheel 301 of the minute hand 106*b* (step S1705: YES), the information concerning the detected minute wheel 1404 is stored to the ROM 203*b* or the like (step S1706). The information concerning the phases of the motor 304 at the reference position of the hand wheel 301 of the minute hand 106*b* and the position at which the minute wheel 1404 is detected is stored in the ROM 203*b* or the like (step S1707). The "OK process" is thereafter executed (step S1708) and the series of process steps comes to an end.

On the other hand, if it is determined at step S1705 that the minute wheel 1404 is not detected at the position reached by driving the motor 304 by $(X_2+X_3)$ steps from the reference position of the hand wheel 301 of the minute hand 106*b* (step S1705: NO), it is determined whether the detection of the minute wheel 1404 is the twelfth detection from the start of the process of the hand position detection of the minute hand and the hour hand (step S1709). The detection of the minute wheel 1404 is executed once every time the hand wheel 301 of the minute hand 106*b* rotates by one rotation and it is therefore assumed that the detection hole 1404*a* is not detected due to some abnormality when the minute wheel 1404 cannot be detected until the minute hand 106*b* rotates by 12 rotations.

If it is determined at step S1709 that the detection of the minute wheel 1404 at step S1705 is the twelfth detection from the start of the process of the hand position detection of the minute hand and the hour hand (step S1709: YES), that is, when the minute wheel 1404 cannot be detected until the minute hand 106*b* rotates by 12 rotations, the procedure advances to step S1713 to execute the "NG" process (step S1713). On the other hand, if it is determined at step S1709 that the detection of the minute wheel 1404 at step S1705 is not the twelfth detection from the start of the process of the hand position detection of the minute hand and the hour hand (step S1709: NO), it is determined whether $(X_2+X_3)$ is $(X_2+X_3)<360$, that is the number of steps by which the motor 304 is driven from the detection of the reference position of the hand wheel 301 of the minute hand 106*b* to the positioning of the minute wheel 1404 at the reference position (step S1710).

If it is determined at step S1710 that $(X_2+X_3)$ is $(X_2+X_3)<360$ (step S1710: YES), the motor 304 is driven by $(360-(X_2+X_3))$ steps (step S1711) and the procedure moves to step S1710. When the minute wheel 1404 is not detected at the position reached by driving the motor 304 by $(X_2+X_3)$ steps from the reference position of the hand wheel 301 of the minute hand 106*b*, the detection of the hand wheel 301 of the minute hand 106*b* is again executed at the position reached by driving the motor 304 by 360 steps after the detection of the reference position of the hand wheel 301 of the minute hand 106*b* and, at step S1711, therefore, the motor 304 is driven by $(360-(X_2+X_3))$ steps obtained by subtracting the $(X_2+X_3)$ steps already driven at step S1704 from 360 steps necessary for one rotation of the hand wheel 301 of the minute hand 106*b*.

If it is determined at step S1710 that $(X_2+X_3)$ is not $(X_2+X_3)<360$ (step S1710: NO), that is, when $(X_2+X_3)$ is $(X_2+X_3)\geq 360$, the motor 304 is driven by $(360-(X_2+X_3-360))$ steps (step S1712) and the procedure moves to step S1701. When the minute wheel 1404 is not detected at the position reached by driving the motor 304 by $(X_2+X_3)$ steps from the reference position of the hand wheel 301 of the minute hand 106*b*, the detection of the hand wheel 301 of the minute hand 106*b* is again executed at the position reached by driving the motor 304 by 360 steps after the detection of the reference position of the hand wheel 301 of the minute hand 106*b*. When $(X_2+X_3)$ is $(X_2+X_3)\geq 360$, therefore, at step S1712, the motor 304 is driven by $(360-(X_2+X_3-360))$ steps obtained by subtracting 360 steps necessary for one rotation of the hand wheel 301 of the minute hand from $(X_2+X_3)$ steps already driven at step S1704.

Configuration will be described of a radio-controlled timepiece of a fifth embodiment that realizes the timepiece according to the present invention. In the fifth embodiment, portions identical to those of the first to fourth embodiments will be given the same reference numerals used in the first to fourth embodiments and will not again be described.

The radio-controlled timepiece 100 of each of the embodiments realizing the timepiece according to the present invention executes detection of the reference position of the hand 106 (normal hand detection) during normal movement of the hands. The normal hand detection in each of the first to the fourth embodiments is executed in the vicinity of the reference position of the time pointing hand 106 to be detected. For example, the normal hand detection is executed by determining whether the dark state or the bright state is established using the third sensitivity level at each of the reference position and the position predetermined number of steps (for example, two steps) before the reference position.

In the fifth embodiment, normal hand detection will be described. The normal hand detection is executed in the vicinity of the reference position of the time pointing hand 106 to be detected. For example, the normal hand detection is executed by determining whether the bright state or the dark state is established using plural sensitivity levels at three or more LED detection positions that are the reference position, the position the predetermined number of steps (for example, two steps) before the reference position, and the position predetermined number of steps (for example, two steps) after the reference position.

Figure 18:
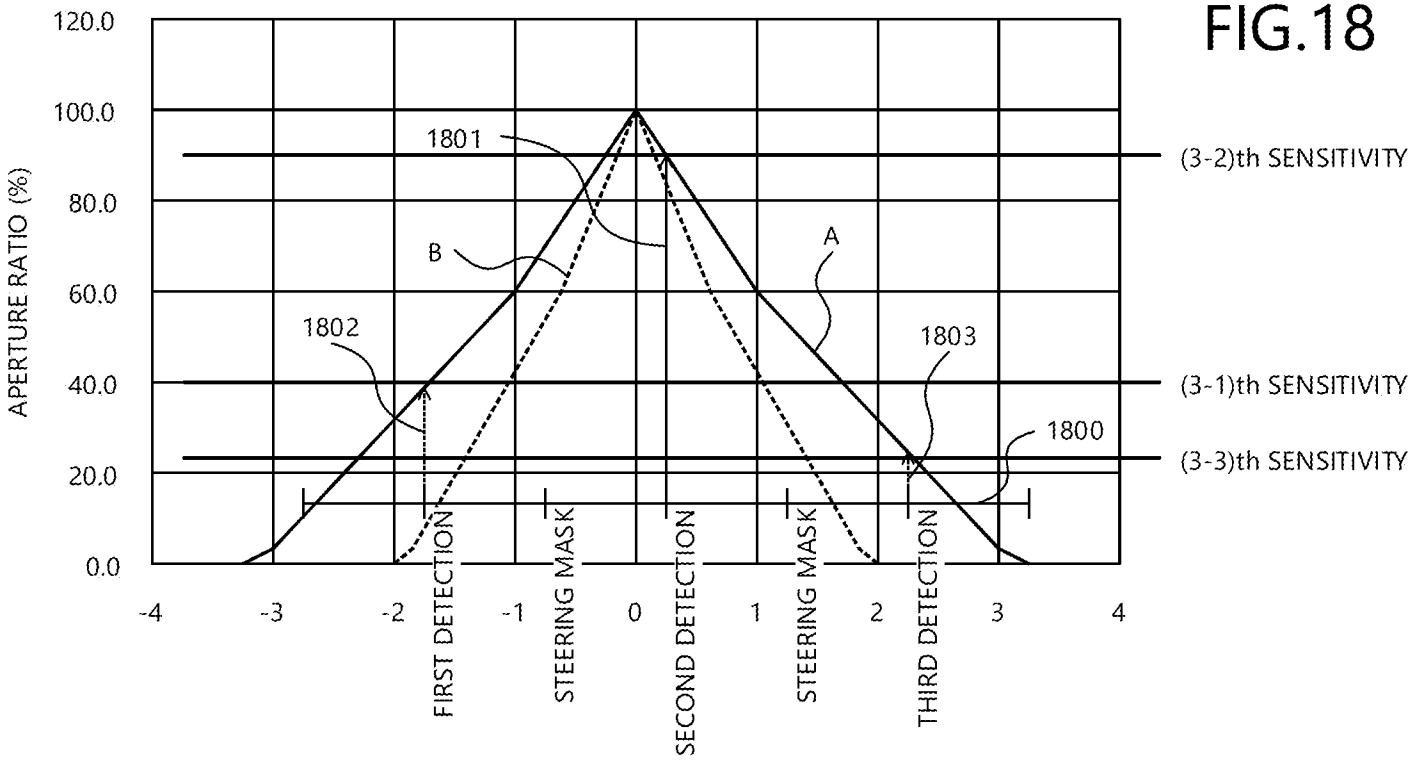
FIG. 18 is an explanatory diagram of a relation between the aperture ratio of the detection hole disposed in the detection wheel and the detection level of the photo sensor.

The relation between the aperture ratio of the detection hole 305*a* disposed in the detection wheel 305 and the detection level of the photo sensor 214 will be described. FIG. 18 is an explanatory diagram of the relation between the aperture ratio of the detection hole 305*a* disposed in the detection wheel 305 and the detection level of the photo sensor 214. The slope is mild relative to the aperture ratio described in the first embodiment (FIG. 5) and the number of steps to open is increased.

When the variation of the detection value for each step (aperture variation) is reduced as above, the bright state is also detected at positions (see reference numerals "1802" and "1803") other than the reference position (see a reference numeral "1801") during the normal hand detection depending on the setting of the detection level (the third sensitivity). Because of this, it is difficult to identify the reference position with high precision when the variation of the detection value (the aperture variation) for each step is reduced.

In the normal hand detection of the fifth embodiment, the determination as to whether the bright state or the dark state is established at each detection level is executed reducing stepwise the detection sensitivity of the photo sensor 216. For example, in the first detection, the detection level one level before the non-detection level at which the bright state is not detected at the reference position X−1 is set to be a "(3−1)th sensitivity". In the second detection, the detection level one level before the non-detection level at which the bright state is not detected at the reference position X+1 is set to be a "(3−2)th sensitivity". In the third detection thereafter, the detection level one level before the non-detection level at which the bright state is not detected at the reference position X+3 is set to be a "(3−3)th sensitivity". When such relations are established as "the (3−2)th sensitivity"<"the (3−1)th sensitivity" and "the (3−2)th sensitivity"<"the (3−3)th sensitivity", it is determined that the reference position X+1 can be detected correctly.

Figure 19:
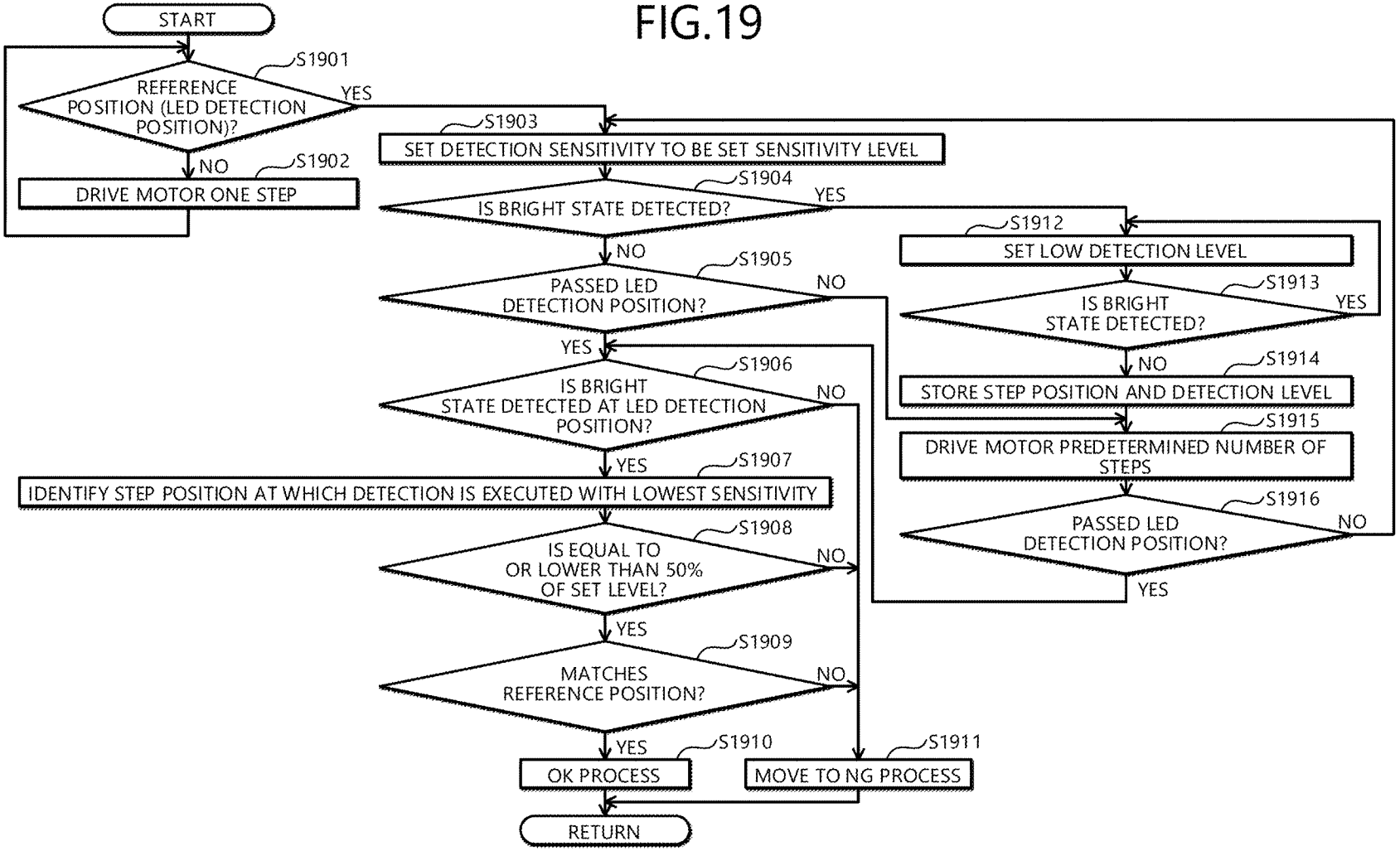
FIG. 19 is a flowchart of a process procedure for normal hand detection executed by the radio-controlled timepiece of a fifth embodiment according to the present invention.

FIG. 19 is a flowchart of the process procedure for the normal hand detection executed by the radio-controlled timepiece 100 of the fifth embodiment according to the present invention. The flowchart of FIG. 19 depicts the process procedure for the normal hand detection for the second hand 106*c*. In the flowchart of FIG. 19, it is determined whether the position of the second hand 106*c* (the detection wheel 305) is the reference position (step S1901).

It is determined at step S1901 which LED detection position of the three points of the reference position X+1, the position the predetermined number of steps (for example, two steps) before the reference position (the reference position X−1), and the position the predetermined number of steps (for example, two steps) after the reference position (the reference position X+3) the position of the detection wheel 305 is. At step S1901, it is determined whether the position of the detection wheel 305 is the LED detection position using, for example, the information concerning the reference position and the motor steering (the phase) that are set at the assembly step of the driving mechanism (the movement) 209.

If it is determined at step S1901 that the position of the detection wheel 305 is not the LED detection position (step S1901: NO), the motor 304 is driven by one step at each one time (step S1902) and the procedure moves to step S1901. If it is determined at step S1901 that the position of the detection wheel 305 is the LED detection position (step S1901: YES), the detection sensitivity of the photo sensor 216 of the second hand 106*c* is set to be the high sensitivity level (step S1903). At step S1903, an arbitrary detection sensitivity set in advance may be set and, for example, the detection sensitivity denoted by a reference numeral "1800" in FIG. 18 may be set.

It is determined whether the photo sensor 216 detects the bright state at the LED detection position using the set sensitivity level set at step S1903 (step S1904).

If it is determined at step S1904 that the photo sensor 216 of the second hand 106*c* detects the bright state (step S1904: YES), the detection sensitivity lower than the set sensitivity level set immediately previously at step S1903 is newly set to be the set sensitivity level (step S1912). It is determined whether the photo sensor 214 corresponding to the time pointing hand 106 to be detected detects the bright state at the LED detection position using the set sensitivity level set at step S1912 (step S1913). If it is determined at step S1913 that the photo sensor 214 detects the bright state (step S1913: YES), the procedure moves to step S1912 and the detection sensitivity lower than the set sensitivity level immediately previously set is newly set to be the set sensitivity level.

If it is determined at step S1913 that the photo sensor 214 does not detect the bright state (step S1913: NO), the information concerning the step position of the LED detection position and the detection level (the set sensitivity level with which the bright state is not detected) is stored (step S1914). The motor 304 is driven by predetermined number of steps (step S1915) and it is determined whether the LED detection position is passed by (step S1916). At step S1915, the motor 304 is driven by, for example, two steps until the photo sensor 214 is positioned at the next LED detection position.

If it is determined at step S1916 that the LED detection position is passed by (step S1916: YES), the procedure moves to step S1906 to determine whether the bright state is detected at the LED detection position by the time when the LED detection position is passed by (step S1906). On the other hand, if it is determined at step S1916 that the LED detection position is not passed by (step S1916: NO), the detection sensitivity of the photo sensor 216 of the second hand 106*c* is set to be the high sensitivity level (step S1903).

If it is determined at step S1904 that the photo sensor 216 of the second hand 106*c* does not detect the bright state (step S1904: NO), it is determined whether the second hand 106*c* passes by the LED detection position (step S1905). If it is determined at step S1905 that the second hand 106*c* does not pass by the LED detection position (step S1905: NO), the procedure advances to step S1915.

If it is determined at step S1905 that the second hand 106*c* passes by the LED detection position (step S1905: YES), it is determined whether the bright state is detected at the LED detection position by the time when the LED detection position is passed by (step S1906). If it is determined at step S1906 that the bright state is not detected at the LED detection position (step S1906: NO), the procedure advances to step S1911.

If it is determined at step S1906 that the bright state is detected at the LED detection position (step S1906: YES), the step position is identified at which the detection is executed with the lowest sensitivity of the detection sensitivities each detecting the bright state by the time the LED detection position is passed by (step S1907). It is determined whether the detection sensitivity determined as the lowest sensitivity identified at step S1907 is equal to or lower than 50% of the set sensitivity level set in advance (step S1908). It is determined at step S1908 whether, for example, the detection sensitivity is equal to or lower than 50% of the set sensitivity level first set at step S1903 in the series of process procedures of the normal hand detection.

In the radio-controlled timepiece 100 of the fifth embodiment, in the hand detection adjustment mode executed prior to the normal hand detection, the detection sensitivity is measured in the vicinity of the position at which the aperture of the detection hole becomes largest, is set to be the fourth sensitivity, and is written to the ROM 203*b*. When the detection sensitivity of the photo sensor 214 is constant despite the variation thereof with time and the like, the fourth sensitivity and the detection sensitivity at the reference position X+1 are equal to each other.

In practice, taking into consideration the variation of the detection sensitivity at the reference position X+1 relative to the fourth sensitivity originated from the variation with time, a range is set in the determination made at step S1908 and it is determined at step S1903 whether the detection sensitivity is equal to or lower than 50% of the set sensitivity level first set at step S1903. In this manner, any errant detection by the photo sensor 214 originated from the unnecessary ingress of light and the like may be prevented by setting a range in the determination made at step S1908. Any errant detection by the photo sensor 214 may be prevented by executing the comparison with the fourth embodiment obtained in the hand detection adjustment mode.

If it is determined at step S1908 that the detection sensitivity is not equal to or lower than 50% of the set sensitivity level (step S1908: NO), the procedure advances to step S1911. If it is determined at step S1908 that the detection sensitivity is equal to or lower than 50% of the set sensitivity level (step S1908: YES), it is determined whether the step position detected with the lowest sensitivity identified at step S1907 matches with the reference position X+1 (step S1909).

If it is determined at step S1909 that the step position detected with the lowest sensitivity identified at step S1907 matches with the reference position X+1 (step S1909: YES), the OK process is executed (step S1910) and the procedure moves to step S1901. At step S1910, as the OK process, for example, the position at which the hand wheel 301 may be detected even with the lowest detection sensitivity is set to be the reference position X+1 and the information concerning the reference position is stored in the ROM 203*b* or the like.

At step S1910, as the OK process, for example, a process of returning to the mode to execute normal movement of the hands may be executed, or information concerning the date or the date and the time to execute the process of the normal hand detection and information concerning the process result such as the success of the normal hand detection may be stored in the ROM 203*b* or the like.

On the other hand, if it is determined at step S1909 that the step position detected with the lowest sensitivity identified at step S1907 does not match with the reference position (step S1909: NO), the procedure moves to the NG process (step S1911) and the series of process steps comes to an end. At step S1911, as the NG process, for example, information concerning the date or the date and the time to execute the process of the normal hand detection, and information concerning the process result such as the failure of the normal hand detection or the like may be stored to the ROM 203*b* or the like.

As described, the radio-controlled timepiece 100 of the fifth embodiment executes the process of the normal hand detection during normal movement of the hands, reduces the detection sensitivity of the photo sensor 216 until the photo sensor 216 cannot detect, and determines the position at which the detection wheel 305 may be detected with the lowest detection sensitivity as the reference position of the second hand 106*c*.

The step position for the easiest detection is thereby sought and the reference position may be set even when the variation of the aperture is small for each one step. With the method using the detection sensitivity of the photo sensor 216 simply set at only a fixed level, the correlation needs to strictly be set among the three that are the detection level that needs to be detected, the detection level that must not be detected, and the fixed detection level. The adjustment therefore becomes complicated and the load on the worker is high during the manufacture.

In contrast, only the position for the easiest detection only has to be obtained by executing the normal hand detection according to the method of the fifth embodiment. Reduction of the load on the worker can thereby be facilitated during the manufacture.

With the method using the detection sensitivity of the photo sensor 216 simply set at only a fixed level, there is concern that errant detection may occur when the detection sensitivity of the photo sensor 216 is reduced originated from the variation thereof with time. In contrast, by executing the normal hand detection according to the fifth embodiment, the position for the easiest detection merely has to be sought even when the detection sensitivity of the photo sensor 216 is degraded, and the reference position can therefore be precisely identified even when the detection sensitivity of the photo sensor 216 is degraded. The radio-controlled timepiece 100 displaying the correct time may be provided.

In the fifth embodiment, a method has been described according to which the detection sensitivity of the photo sensor 216 is reduced stepwise until the photo sensor 216 cannot detect the second hand 106*c* and the position at which the second hand 106*c* may be detected even with the lowest detection sensitivity is determined as the reference position of the second hand 106*c*, while the number of reduction sessions of the detection sensitivity (the number of steps) may be defined. The method may be executed when the minute hand 106*b* or the minute wheel 1404 is detected in addition to the second hand 106*c*.

For example, two types of detection sensitivities are caused to be able to be set that are a detection level LV_MA and a detection level LV_MB lower than LV_MA, it is checked that the reference position X+1 is for the easiest detection, the reference position X+1 is thereby confirmed, and the normal hand detection may thereby be realized. In this case, the reference position setting, the steering adjustment, and the luminosity adjustment of the light emitting element (LED) of the photo sensor 214 are executed at each of both of the detection levels LV_MA and LV_MB.

Figure 20:
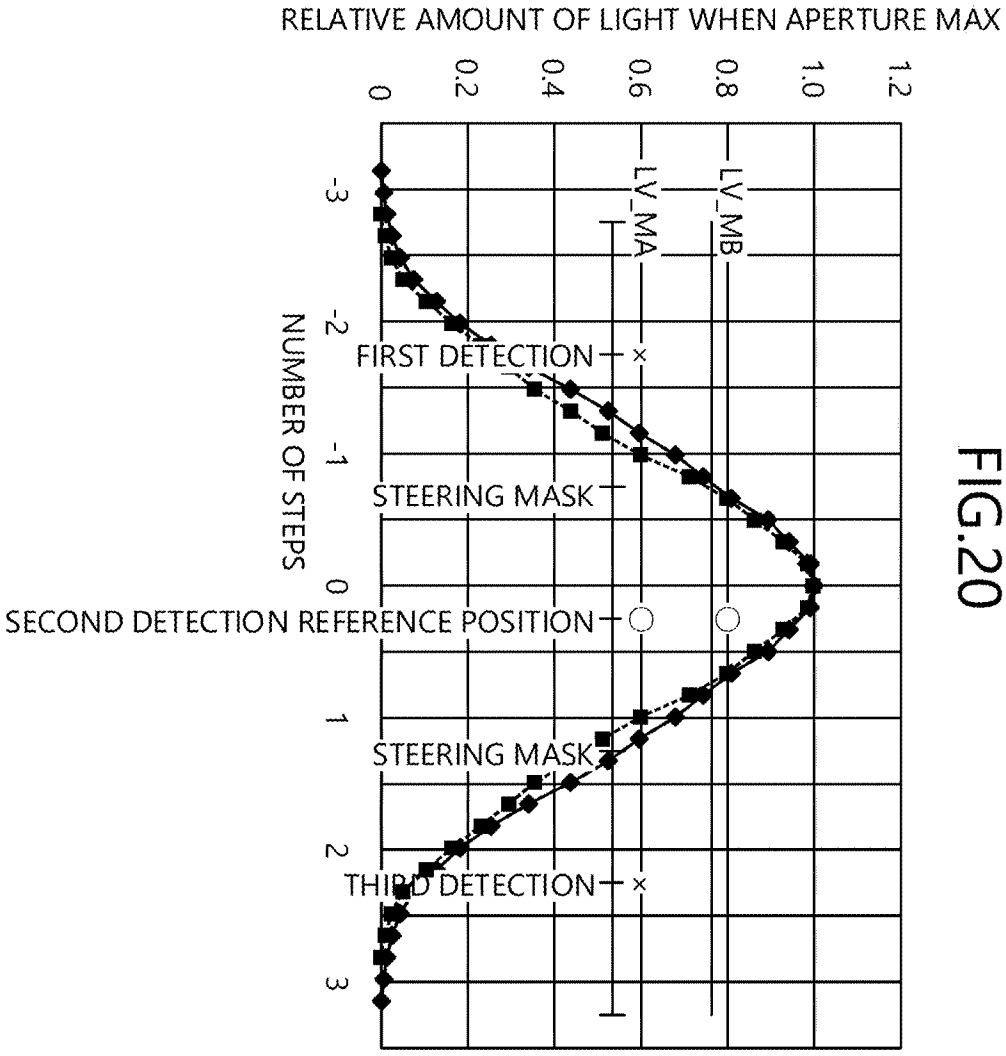
FIG. 20 is an explanatory diagram of the relation between the aperture ratio of a detection hole of a minute wheel and the detection level of the photo sensor.

FIG. 20 is an explanatory diagram of the relation between the aperture ratio of the detection hole 1404*a* of the minute wheel 1404 and the detection level of the photo sensor 214. As depicted in FIG. 20, when the detection level of the photo sensor 214 is set to be the detection levels LV_MA and LV_MB and it may be confirmed that the second hand detection position (the reference position X+1) is for the easiest detection at each of the detection levels, the normal hand detection may be realized by this confirmation result.

For example, at the first hand detection position X−1, the photo sensor 214 does not detect the bright state when any of the detection level LV_MA and the detection level LV_MB is set (non-detection). At the third hand detection position X+3, the photo sensor 214 also does not detect the bright state even when any of the detection level LV_MA and the detection level LV_MM is set (non-detection). On the other hand, at the second hand detection position X+1, the photo sensor 214 detects the bright state even when any of the detection level LV_MA and the detection level LV_MB is set (detection).

As described, the normal hand detection may be realized by checking that the photo sensor 214 detects whether the bright state is established only at the second hand detection position X+1 of the hand detection positions X−1, X+1, and X+3 set at the three points and that the photo sensor 214 detects the bright state when any of the detection level LV_MA and the detection level LV_MB is set.

In the radio-controlled timepiece 100 of each of the first to the fifth embodiments according to the present invention, adjustment may be executed such that the detection of the hand position is executed at the position not overlapping with the position for the process for the minute wheel. For example, adjustment is executed to avoid setting the reference position to be in the vicinity of the position for zero o'clock such that the detection of the hand position is executed at the position not overlapping with the position for the process of rotating (turning) the date indicator wheel in the direction to advance the date by one day every time the date indicator wheel rotates by one rotation in 24 hours. For example, the adjustment may be executed not to set the reference position for five minutes before and after zero o'clock as the reference (from 12:55 to 0:05).

As described, the radio-controlled timepiece 100 of each of the embodiments according to the present invention includes the hand wheel 301 that is rotatable around the axial center, the motor 304 that is coupled with the hand wheel 301 to rotate the hand wheel 301, the detection wheel 305 that is rotatable around the axial center associated with the rotation of the hand wheel 301, the detection hole 305*a* that penetrates the detection wheel 305 in the axial direction, the photo sensor 214 (215 or 216) including the light emitting element 214*a* that emits light to the detection position on the orbit of the move of the detection hole 305*a* associated with the rotation of the detection wheel 305, and the light receiving element 214*b* that is disposed facing the light emitting element 214*a* sandwiching the detection wheel 305 therebetween, and the control unit 401 that drives and controls the motor 304 based on the amount of received light of the light receiving element 214*b*.

The radio-controlled timepiece 100 of each of the embodiments according to the present invention is characterized in that the control unit 401 determines whether the bright state or the dark state is established every time the motor 304 is driven by the predetermined number of steps (for example, one step) based on the amount of received light of the light receiving element 214*b*, identifies the switching position X at which the dark state is switched to the bright state when the dark state is consecutively determined for the first number of steps (for example, two steps) and the bright state is thereafter consecutively determined for the second number of steps (for example, two steps), and stores to the storage unit 401*a*, the information concerning the reference position X+1 one step after the identified switching position X.

Alternatively, the radio-controlled timepiece 100 of each of the embodiments according to the present invention is characterized in that the control unit 401 determines whether the bright state or the dark state is established every time the motor 304 is driven by the predetermined number of steps (for example, one step) based on the amount of received light of the light receiving element 214*b*, identifies the switching position X at which the bright state is switched to the dark state when the bright state is consecutively determined for the first number of steps (for example, two steps) and the dark state is thereafter consecutively determined for the second number of steps (for example, two steps), and stores to the storage unit 401*a*, the information concerning the reference position X−1 one step before the identified switching position X.

According to the radio-controlled timepiece 100 of each of the embodiments of the present invention, the reference positions X+1 and X−1 are set after assembling the driving mechanism (the movement) 209, and the positions of the time pointing hands 106 may be controlled based on the set reference positions X+1 and X−1. The driving mechanism (the movement) 209 may thereby be assembled without any restriction imposed on the incorporation of the parts constituting the driving mechanism (the movement) 209 such as the positional relation of the hand wheel 301 and the gears 302 constituting the wheel train 303, the disposition orientation of the motor 304 (the motor coil), and the initial phase of the pulse signal output from the electronic circuit unit to the motor 304 (the motor coil).

Reduction of the load on the worker may thereby be facilitated during the manufacture of the radio-controlled timepiece 100.

According to the radio-controlled timepiece 100 of each of the embodiments of the present invention, the switching position X is identified based on the determination result as to whether the dark state or the bright state is established, the position one step after or one step before the identified switching position X is set to be the reference position X+1 or X−1, and the reference position X+1 or X−1 may be set with high precision, without imposing the extremely strict condition that "the detection hole 305*a* is opened by an amount corresponding to one step during one rotation of the hand wheel 301 to be detected". The radio-controlled timepiece 100 displaying the correct time may thereby be provided.

To set the strict condition as above, a detection hole has to be disposed in each of the plural gears each having a speed reduction ratio for the rotor 304*a* different from each other and these plural gears have to overlap each other in the rotation axial direction. When the reference position is set as above, the thickness in the rotation axial direction becomes large and facilitation of reduction of the thickness of the radio-controlled timepiece 100 becomes difficult.

In contrast, according to the radio-controlled timepiece 100 of each of the embodiments of the present invention, the switching position X may be identified precisely and the reference positions X+1 and X−1 may be set precisely by using only the detection wheel 305 or the one gear 302 having the detection hole 302*a* disposed therein in addition to the detection wheel 305. Reduction of the thickness of the radio-controlled timepiece 100 may be facilitated and the number of manufacture steps may be reduced by reducing the number of parts concerning the setting of the reference positions X+1 and X−1. Reduction of the load on the worker may thereby be facilitated during the manufacture of the radio-controlled timepiece 100.

The radio-controlled timepiece 100 of each of the embodiments according to the present invention is characterized in that, in the reference position setting operation, the control unit 401 determines whether the bright state or the dark state is established in the state where the detection sensitivity of the photo sensor 214 (215 or 216) is set at each of different two or more sensitivities.

According to the radio-controlled timepiece 100 of each of the embodiments of the present invention, the determination as to whether the bright state or the dark state is established may be executed reliably by determining whether the bright state or the dark state is established in the state where the different two or more sensitivities are set. The switching position from the dark state to the bright state can thereby be highly precisely identified.

The reference position X+1 may be set with high precision even when the setting condition for the reference position X+1 is strict such as the small opening diameter of the detection hole 305*a*. In the radio-controlled timepiece 100, the reference position can also be set by, for example, confirming that the dark state is detected with the second sensitivity at the position two steps before the position as the reference at which the bright state is detected with the first sensitivity, not limiting to the method described with reference to FIG. 7.

In the radio-controlled timepiece 100 of each of the embodiments of the present invention, the control unit 401 identifies the switching position X and the reference positions X+1 and X−1 in the state where the detection sensitivity of the photo sensor 214 (215 or 216) is set to be the first sensitivity that is higher than the sensitivity used during normal movement of the hands.

The radio-controlled timepiece 100 is characterized in that the control unit 401 determines whether the dark state is established at the position one step before the switching position X and determines whether the bright state is established at the reference position X+1 in the state where the detection sensitivity of the photo sensor 214 (215 or 216) is set to be the sensitivity equal to the sensitivity used during normal movement of the hands or the second sensitivity lower than the sensitivity used during normal movement of the hands and, when the dark state is established at the position one step before the switching position X and the bright state is established at the reference position X+1, stores the information concerning the phase of the motor 304 at the reference position X+1 to the storage unit 401*a* (such as the ROM 203*b*).

The radio-controlled timepiece 100 is characterized in that the position at which the bright state is switched to the dark state may be set to be the switching position X and, in this case, the control unit 401 determines whether the bright state is established at the reference position X−1 one step before the switching position X and determines whether the dark state is established at the position X+1 in the state where the detection sensitivity of the photo sensor 214 (215 or 216) is set to be the second sensitivity and, if the bright state is established at the position X−1 one step before the switching position and the dark state is established at the position X+1, stores the information concerning the phase of the motor 304 at the reference position X−1 to the storage unit 401*a* (such as the ROM 203*b*).

According to the radio-controlled timepiece 100 of each of the embodiments of the present invention, any errant detection of the switching position X may be prevented by identifying the switching position X in the state where the detection sensitivity of the photo sensor 214 (215 or 216) is set to be the first sensitivity. Thus, the reference positions X+1 and X−1 may be set with high precision. The radio-controlled timepiece 100 displaying the correct time may be provided.

The radio-controlled timepiece 100 of each of the embodiments according to the present invention is characterized in that, for the reference position setting operation, the control unit 401 adjusts at least one of the light emission intensity of the light emitting element 214*a* and the light receiving sensitivity of the light receiving element 214*b* to set the detection sensitivity of the photo sensor 214 (215 or 216).

According to the radio-controlled timepiece 100 of each of the embodiments of the present invention, the switching position X from the dark state to the bright state may be identified with high precision for each timepiece without being influenced by the dispersion of the detection sensitivity of the photo sensor 214 (215 or 216) of each radio-controlled timepiece 100, and the like. Thus, the reference positions X+1 and X−1 may be set with high precision and the radio-controlled timepiece 100 displaying the correct time may be provided.

The radio-controlled timepiece 100 of each of the embodiments according to the present invention is characterized in that the control unit 401 identifies the switching position X and the reference position X+1 (or the reference position X−1) by rotating forward the motor 304 in the state where the first sensitivity is set and thereafter, positions the detection wheel 305 at the position one or more step(s) before the position to detect the detection wheel 305 by rotating backward the motor 304 and then, executes the determination using the second sensitivity.

According to the radio-controlled timepiece 100 of each of the embodiments of the present invention, any degradation of the precision of the reference position setting operation and the like originating from the backlash of the wheel train (including the detection wheel 305), which is necessary in a timepiece, which is a machine, may be prevented and the reference positions X+1 and X−1 may be set with high precision when the motor 304 is rotated backward and the radio-controlled timepiece 100 displaying the correct time may be provided.

The radio-controlled timepiece 100 of each of the embodiments according to the present invention includes a time counting function (a time counting unit) and is characterized in that, when the control unit 401 identifies the phase of the reference position X+1, the control unit 401 executes the time counting, executing the detection of the bright or the dark state at the timing of the identified phase using the third sensitivity that is lower than the first sensitivity and that is equal to or higher than the second sensitivity, during normal movement of the hands, and detecting at least the dark state at the position X−1 one step before the switching position X and the bright state at the position X+1 one step after the switching position X.

Alternatively, when the control unit 401 identifies the phase of the reference position X−1, the control unit 401 may count the time executing the detection of the bright or the dark state at the timing of the identified phase using the third sensitivity and detecting at least the bright state at the position X−1 one step before the switching position X and the dark state at the position X+1 one step after the switching position X.

According to the radio-controlled timepiece 100 of each of the embodiments of the present invention, the position of the hand wheel 301 that supports the time pointing hand 106 (the hour hand 106*a*, the minute hand 106*b*, or the second hand 106*c*) may be controlled based on the reference position X+1 set with high precision. The radio-controlled timepiece 100 displaying the correct time can thereby be provided. When the reference position of each of the hour hand 106*a*, the minute hand 106*b*, and the second hand 106*c* is set, differing sensitivities may be used for each of the hour hand 106*a*, the minute hand 106*b*, and the second hand 106*c*, or the same sensitivity may be used for each. When the reference positions of the hour hand 106*a*, the minute hand 106*b*, and the second hand 106*c* are set, the phase information for each thereof mostly differ from each other.

The radio-controlled timepiece 100 of each of the embodiments according to the present invention is characterized in that the control unit 401 varies stepwise the detection sensitivity of the photo sensor 214 (215 or 216) at two or more differing sensitivities, determines whether the bright state or the dark state is established in the state where each of the sensitivities is set and thereby, identifies the non-detection level at which the photo sensor 214 (215 or 216) does not detect the bright state, identifies the detection sensitivity with which the bright state is not detected at the position other than the reference position as the first sensitivity, and identifies the switching position X and the reference positions X+1 and X−1 in a state where the first sensitivity is set. The identification of the switching position X and the reference positions X+1 and X−1 using the above method may be realized by the normal hand detection executed during normal movement of the hands as described in the fifth embodiment.

According to the radio-controlled timepiece 100 of each of the embodiments of the present invention, the reference positions X+1 and X−1 may be detected with high precision even when the input current to the photo sensor 214 (215 or 216) varies or even when the detection sensitivity of the photo sensor 214 (215 or 216) is degraded consequent to variation thereof over time. The radio-controlled timepiece 100 that always displays the correct time may thereby be provided.

The radio-controlled timepiece 100 of each of the embodiments according to the present invention may include the date indicator driving wheel that is coupled with the hand wheel 301 and that is rotatable around the axial center associated with the rotation of the hand wheel 301, and the date indicator wheel that is coupled with the date indicator driving wheel and that displays the date. The radio-controlled timepiece 100 is characterized in that, when the control unit 401 successfully executes the reference position setting operation, the control unit 401 drives and controls the motor 304 to rotate the date indicator driving wheel and thereby changes the date displayed by the date indicator wheel to the date advanced from the date of the time when the reference position setting operation is started, and when the control unit 401 fails in executing the reference position setting operation, the control unit 401 drives and controls the motor 304 to rotate the date indicator driving wheel and thereby changes the date displayed by the date indicator wheel to the date before the date of the time when the reference position setting operation is started.

According to the radio-controlled timepiece 100 of each of the embodiments of the present invention, whether the reference position setting operation is successfully executed or has failed may be guided even in a state where no hands are attached to the hand wheel 301 at a manufacturing step of the timepiece. The manufacturer of the radio-controlled timepiece 100 can thereby determine whether the setting of the reference position X+1 is successfully executed before any hands are attached to the hand wheel 301.

When the setting of the reference position X+1 has failed, a countermeasure may be taken such as reassembling of the radio-controlled timepiece 100 before the completion of the assembly of the radio-controlled timepiece 100, and reduction of the load on the worker may be facilitated during the manufacture of the radio-controlled timepiece 100 compared to a case where the success or the failure of the setting of the reference position X+1 is checked after the completion of the assembly of the radio-controlled timepiece 100.

The radio-controlled timepiece 100 of each of the embodiments according to the present invention includes the hour wheel that rotates associated with the rotation of the minute hand wheel 301 and that rotates by one rotation every time the minute hand wheel 301 rotates by predetermined number of rotations, the minute wheel 1404 that rotates associated with the rotation of the hour wheel and that rotates at the number of rotations higher than the number of rotations of the hour wheel and lower than the number of rotations of the detection wheel 305, the detection hole 1404*a* that penetrates the minute wheel 1404 in the axial direction of the minute wheel 1404, and the photo sensor 214 that emits light to the detection position on the orbit of the movement of the detection hole 1404*a*, associated with the rotation of the minute wheel 1404.

The radio-controlled timepiece 100 of each of the embodiments according to the present invention is characterized in that the number of rotations of the minute wheel 1404 is set to be the number of rotations by which the photo sensor 214 detects once the detection hole 1404*a* predetermined number of steps after the positioning of the detection wheel 305 at the reference position, each time the hour wheel rotates by one rotation; and the control unit 401 identifies the position of the minute wheel 1404 based on the amount of light received by the light receiving element of the photo sensor 214 a predetermined number of steps ($X_2$+$X_3$) after the positioning of the detection wheel 305 at the reference position.

According to the radio-controlled timepiece 100 of each of the embodiments of the present invention, the detection of the reference position of the hour hand 106*a* (hour detection) may be executed using the result of the detection of the reference position of the minute hand wheel 301 (minute detection). Thus, reduction of the thickness of the radio-controlled timepiece 100 may be facilitated and the number of manufacture steps may be reduced by reducing the number of parts concerning the setting of the reference positions X+1 and X−1. Reduction of the load on the worker may thereby be facilitated during the manufacture of the radio-controlled timepiece 100.

The radio-controlled timepiece 100 of each of the embodiments according to the present invention is characterized in that the control unit 401 identifies the position of the minute wheel 1404 based on the number of steps necessary for the photo sensor 214 to detect the bright state. The radio-controlled timepiece 100 may identify the position of the hand wheel 301 based on the number of steps necessary for the photo sensor 214 of the detection wheel 305 to detect the bright state, not limiting to the minute wheel 1404.

According to the radio-controlled timepiece 100 of each of the embodiments of the present invention, the bright state is detected for the time period during which the motor 304 is driven by plural steps, whereby the reference position may be identified precisely even when variation of the detected value for each step (the aperture variation) is small and enabling the radio-controlled timepiece 100 displaying the correct time to be provided.

However, with the traditional technique, a problem arises in that many restrictions are imposed on incorporation of the parts constituting the driving mechanism (the movement) such as the hand whose position is to be detected, a hand wheel to indicate the hand, the positional relation among the gears constituting the wheel train to transmit the rotation of the rotor to the hand wheel, the direction to disposed the motor, and the initial phase of a pulse signal output from an electronic circuit unit to the motor.

According to the timepiece of the present invention, an effect is achieved in that reduction of the load on a worker during the manufacture may be facilitated.

As described, the timepiece according to the present invention is useful for a timepiece that displays the time based on the identified positions of the hands, and is especially suitable for a timepiece that corrects the displayed time based on the time information included in a received radio wave.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A timepiece comprising:

a hand wheel configured to rotate around an axial center thereof;

a motor coupled with the hand wheel and configured to rotate the hand wheel;

a detection wheel configured to rotate around an axial center thereof, associated with rotation of the hand wheel;

a detection hole that penetrates the detection wheel in a direction along the axial center;

a photo sensor including:

a light emitting element that emits light to a detection position on an orbit along which the detection hole moves associated with the rotation of the detection wheel, and a light receiving element that is disposed facing the light emitting element with the detection wheel therebetween; and a control unit configured to drive and control the motor, wherein the control unit determines one of a first state and a second state different from the first state, based on an amount of light received by the light receiving element each time the motor is driven a predetermined number of steps, the control unit identifies a switching position at which the first state is switched to the second state when the control unit consecutively determines the first state for a first number of steps and thereafter consecutively determines the second state for a second number of steps, and the control unit sets a position one step shifted from the identified switching position to be a reference position and stores information concerning the reference position to a storage unit.

2. The timepiece according to claim 1, wherein the control unit determines one of the first state and the second state in a state where a detection sensitivity of the photo sensor is set to be two or more different sensitivities.

3. The timepiece according to claim 2, wherein the control unit sets the detection sensitivity of the photo sensor by adjusting at least one of a light emission intensity of the light emitting element and a light receiving sensitivity of the light receiving element.

4. The timepiece according to claim 1, wherein the control unit determines a bright state in which the amount of light received is equal to or greater than a predetermined amount as the first state, and a dark state with which the amount of light received is less than the predetermined amount as the second state, the control unit determines one of the bright state and the dark state based on the amount of light received by the light receiving element each time the motor is driven a predetermined number of steps, the control unit identifies a switching position at which the second state is switched to the first state when the control unit consecutively determines the second state for the first number of steps and thereafter consecutively determines the first state for the second number of steps, and the control unit sets a position one step after the identified switching position to be a reference position and stores information concerning the reference position to the storage unit.

5. The timepiece according to claim 1, wherein the control unit identifies the switching position and the reference position in a state where the detection sensitivity of the photo sensor is set to be a first sensitivity that is higher than a sensitivity used during normal movement of hands, the control unit determines whether the second state is established at a position one step before the switching position and determines whether the first state is established at the reference position in a state where the detection sensitivity of the photo sensor is set to be a second sensitivity that is equal to the sensitivity used during normal movement of the hands or that is lower than the sensitivity used during normal movement of the hands, and the control unit stores to the storage unit, information concerning a phase of the motor at the reference position when the second state is established at the position one step before the switching position and the first state is established at the reference position.

6. The timepiece according to claim 5, wherein the control unit determines a dark state in which the amount of light received is less than a predetermined amount as the first state, and a bright state in which the amount of received light is equal to or greater than the predetermined amount as the second state, the control unit determines one of the bright state and the dark state, based on the amount of light received by the light receiving element each time the motor is driven the predetermined number of steps, the control unit identifies a switching position at which the second state is switched to the first state when the control unit consecutively determines the second state for the first number of steps and thereafter consecutively determines the first state for the second number of steps, and the control unit sets a position one step before the identified switching position to be a reference position and stores information concerning the reference position to the storage unit.

7. The timepiece according to claim 1, wherein the control unit identifies the switching position and the reference position in a state where the detection sensitivity of the photo sensor is set to be a first sensitivity that is higher than a sensitivity used during normal movement of hands, the control unit determines whether the first state is established at a position one step after the switching position and determines whether the second state is established at the reference position in a state where the detection sensitivity of the photo sensor is set to be a second sensitivity that is equal to the sensitivity used during normal movement of the hands or that is lower than the sensitivity used during normal movement of the hands, and the control unit stores to the storage unit, information concerning a phase of the motor at the reference position when the first state is established at the position one step after the switching position and the second state is established at the reference position.

8. The timepiece according to claim 5, wherein the control unit identifies the switching position and the reference position by rotating forward the motor in a state where the first sensitivity is set, and the control unit, after identifying the switching position and the reference position, positions the detection wheel at a position one step or more before a detection position by rotating backward the motor and thereafter executes determination using the second sensitivity.

9. The timepiece according to claim 5, further comprising a time counting unit that counts time, wherein the control unit, when identifying the phase of the reference position, determines during normal movement of hands, one of the first state and the second state at a timing of the identified phase using a third sensitivity that is lower than the first sensitivity and that is equal to the second sensitivity or higher than the second sensitivity, and counts time using the time counting unit in a state where a determination result at a position at least one step before the switching position and a determination result at a position one step after the switching position differ.

10. The timepiece according to claim 5, wherein the control unit identifies a non-detection level at which the photo sensor does not detect the bright state, the control unit identifying the non-detection level by varying stepwise the detection sensitivity of the photo sensor at two or more different sensitivities and determining one of the first state and the second state in a state where the control unit sets the detection sensitivity at each of the sensitivities, the control unit identifies as the first sensitivity and identifies based on the identified non-detection level, a detection sensitivity by which the control unit does not detect the bright state at a position other than the reference position, and the control unit identifies the switching position and the reference position in a state where the first sensitivity is set.

11. The timepiece according to claim 1, further comprising a date indicator driving wheel coupled with the hand wheel, wherein the control unit, when successfully storing the information concerning the reference position in response to a predetermined input operation to execute identification of the switching position, drives and controls the motor so as to change a date displayed by the date indicator driving wheel to a date that is advanced from a date of a time when the predetermined input operation is received, and the control unit, when failing to store the information concerning the reference position in response to the predetermined input operation to execute the identification of the switching position, drives and controls the motor so as to change the date displayed by the date indicator driving wheel to a date that is before the date of the time when the predetermined input operation is received.

12. The timepiece according to claim 1, further comprising:

a second hand wheel that rotates associated with the rotation of the hand wheel, the second hand wheel rotating by one rotation each time the hand wheel rotates a predetermined number of rotations;

a second detection wheel that rotates associated with the second hand wheel, the second detection wheel rotating by a number of rotations higher than a number of rotations of the second hand wheel and lower than a number of rotations of the detection wheel;

a second detection hole that penetrates the second detection wheel in a direction of an axial center of the second detection wheel; and a second photo sensor including:

a second light emitting element that emits light to a detection position on an orbit along which the second detection hole moves associated with the rotation of the second detection wheel, and a second light receiving element that is disposed facing the second light emitting element with the second detection wheel therebetween, wherein a number of rotations of the second detection wheel is a number of rotations by which the second photo sensor detects the second detection hole a predetermined number of steps after positioning of the detection wheel at the reference position once every time the second hand wheel rotates by one rotation, and the control unit identifies a position of the second hand wheel based on an amount of light received by the second light receiving element a predetermined number of steps after positioning of the detection wheel at the reference position.

13. The timepiece according to claim 12, wherein the control unit identifies the position of the second hand wheel based on a number of steps during detection of the bright state by one of the photo sensor and the second photo sensor.

14. The timepiece according to claim 7, wherein the control unit identifies the switching position and the reference position by rotating forward the motor in a state where the first sensitivity is set, and the control unit, after identifying the switching position and the reference position, positions the detection wheel at a position one step or more before a detection position by rotating backward the motor and thereafter executes determination using the second sensitivity.

15. The timepiece according to claim 7, further comprising a time counting unit that counts time, wherein the control unit, when identifying the phase of the reference position, determines during normal movement of hands, one of the first state and the second state at a timing of the identified phase using a third sensitivity that is lower than the first sensitivity and that is equal to the second sensitivity or higher than the second sensitivity, and counts time using the time counting unit in a state where a determination result at a position at least one step before the switching position and a determination result at a position one step after the switching position differ.

16. The timepiece according to claim 7, wherein the control unit identifies a non-detection level at which the photo sensor does not detect the bright state, the control unit identifying the non-detection level by varying stepwise the detection sensitivity of the photo sensor at two or more different sensitivities and determining one of the first state and the second state in a state where the control unit sets the detection sensitivity at each of the sensitivities, the control unit identifies as the first sensitivity and identifies based on the identified non-detection level, a detection sensitivity by which the control unit does not detect the bright state at a position other than the reference position, and the control unit identifies the switching position and the reference position in a state where the first sensitivity is set.

* * * * *